US011910968B2

(12) United States Patent
Li et al.

(10) Patent No.: US 11,910,968 B2
(45) Date of Patent: Feb. 27, 2024

(54) SELF-LIFTING TOILET SEAT

(71) Applicant: Cleana Inc., Wyckoff, NJ (US)

(72) Inventors: Mingyuan Li, Cambridge, MA (US); Max Pounanov, Belmont, MA (US); Kevin Z. Tang, Wyckoff, NJ (US); Greg Blonder, Brookline, MA (US)

(73) Assignee: Cleana Inc., Wyckoff, NJ (US)

( * ) Notice: Subject to any disclaimer, the term of this patent is extended or adjusted under 35 U.S.C. 154(b) by 0 days.

(21) Appl. No.: 17/987,746

(22) Filed: Nov. 15, 2022

(65) Prior Publication Data

US 2023/0148804 A1 May 18, 2023

Related U.S. Application Data

(60) Provisional application No. 63/395,168, filed on Aug. 4, 2022, provisional application No. 63/325,523, filed on Mar. 30, 2022, provisional application No. 63/303,171, filed on Jan. 26, 2022, provisional application No. 63/279,646, filed on Nov. 15, 2021.

(51) Int. Cl.
*A47K 13/10* (2006.01)

(52) U.S. Cl.
CPC ..... *A47K 13/105* (2013.01)

(58) Field of Classification Search
CPC ..... A47K 13/10; A47K 13/12; A47K 13/24; A47K 13/26; A47K 13/30
See application file for complete search history.

(56) References Cited

U.S. PATENT DOCUMENTS

| | | | |
|---|---|---|---|
| 2,676,047 | A | 4/1954 | Gould |
| 3,182,857 | A | 5/1965 | Bischoff et al. |
| 3,404,411 | A | 10/1968 | Newkirk |
| 3,796,041 | A | 3/1974 | Boult |
| 4,053,961 | A | 10/1977 | Wilson et al. |

(Continued)

FOREIGN PATENT DOCUMENTS

| | | | |
|---|---|---|---|
| CA | 1113049 | A | 11/1981 |
| CN | 203207951 | U | 9/2013 |

(Continued)

OTHER PUBLICATIONS

Tang, K. Linkedin Post. Jan. 5, 2023. Retrieved on Jan. 6, 2023 from https://www.linkedin.com/feed/update/um:li:activity:7016893566668931073, 4 pages.

(Continued)

*Primary Examiner* — Erin Deery
(74) *Attorney, Agent, or Firm* — Nutter McClennen & Fish LLP

(57) ABSTRACT

A self-lifting toilet seat system includes a toilet seat configured to be sat upon by a user. The system has a hinge configured to rotatably couple the toilet seat and a toilet bowl. The hinge is configured so that the toilet seat is transitionable from an up position to a down position. A lifting system is configured to raise the toilet seat towards the up position. A sealed hinge housing has at least a portion of a delay system therein. The delay system is configured to cause a time delay before the lifting system causes the toilet seat to self-lift towards the up position. The delay system is configured so that the time delay begins after removal of a threshold downward force on the toilet seat.

23 Claims, 78 Drawing Sheets

(56) References Cited

U.S. PATENT DOCUMENTS

| | | | | |
|---|---|---|---|---|
| 4,220,266 | A | 9/1980 | Braden et al. | |
| 4,402,092 | A | 9/1983 | Smallwood | |
| 4,428,083 | A * | 1/1984 | Chuang | A47K 13/10 4/240 |
| 4,491,989 | A | 1/1985 | McGrail | |
| 4,910,810 | A | 3/1990 | Solomon | |
| 4,951,325 | A | 8/1990 | Tack | |
| 5,101,518 | A | 4/1992 | Phillips | |
| 5,138,724 | A | 8/1992 | Chien et al. | |
| 5,279,000 | A | 1/1994 | Mercier et al. | |
| 5,369,814 | A | 12/1994 | Denys | |
| 5,435,017 | A | 7/1995 | Pan | |
| 5,461,734 | A | 10/1995 | Faircloth | |
| 5,504,947 | A | 4/1996 | Robellop et al. | |
| 5,604,936 | A | 2/1997 | Mausolf | |
| 5,867,843 | A | 2/1999 | Robello et al. | |
| 5,896,592 | A | 4/1999 | Santa Cruz et al. | |
| 5,996,132 | A | 12/1999 | Sorimachi | |
| 6,138,289 | A | 10/2000 | Sardo | |
| 6,510,562 | B1 | 1/2003 | Bae et al. | |
| 6,684,416 | B1 | 2/2004 | Chao et al. | |
| 7,039,961 | B1 | 5/2006 | Kirk | |
| 7,293,297 | B2 | 11/2007 | Hayashi et al. | |
| 7,331,706 | B2 | 2/2008 | Gabathuler et al. | |
| 7,398,564 | B2 | 7/2008 | Andersen | |
| 7,788,741 | B2 | 9/2010 | Lohss | |
| 8,214,932 | B2 | 7/2012 | Shannon | |
| 8,347,423 | B2 | 1/2013 | Baumoel | |
| 9,044,122 | B2 | 6/2015 | Corbell et al. | |
| 9,901,224 | B2 | 2/2018 | Rubashkin | |
| 10,791,888 | B1 | 10/2020 | Doctor | |
| 11,096,530 | B2 | 8/2021 | Henderson et al. | |
| 2004/0168897 | A1 | 9/2004 | Heien | |
| 2004/0261164 | A1 | 12/2004 | Junkins | |
| 2005/0223480 | A1 | 10/2005 | Miller et al. | |
| 2007/0192949 | A1 | 8/2007 | Pan et al. | |
| 2008/0010733 | A1 | 1/2008 | Lambert | |
| 2008/0023967 | A1 | 1/2008 | King et al. | |
| 2009/0188029 | A1 | 7/2009 | Ta et al. | |
| 2010/0146689 | A1 | 6/2010 | Yang | |

FOREIGN PATENT DOCUMENTS

| | | | | |
|---|---|---|---|---|
| EP | 1462884 | A2 | 9/2004 | |
| EP | 2369971 | A1 | 10/2011 | |
| WO | WO-9306765 | A1 * | 4/1993 | A47K 13/10 |
| WO | WO-9923927 | A1 * | 5/1999 | A47K 13/10 |
| WO | WO-0187129 | A1 * | 11/2001 | A47K 13/12 |
| WO | WO-2005102135 | A1 * | 11/2005 | A47K 13/10 |
| WO | 2008133745 | A1 | 11/2008 | |
| WO | 2010134795 | A1 | 11/2010 | |

OTHER PUBLICATIONS

International Search Report and Written Opinion for International Application No. PCT/US2022/049993, dated May 10, 2023, 15 pages.

International Search Report and Written Opinion for International Application No. PCT/US23/22288, dated Aug. 18, 2023, 23 pages.

* cited by examiner

SELF-LIFTING TOILET SEAT

PRIORITY

This patent application claims priority from provisional U.S. patent application No. 63/279,646, filed Nov. 15, 2021, provisional U.S. patent application No. 63/303,171, filed Jan. 26, 2022, provisional U.S. patent application No. 63/325,523, filed Mar. 30, 2022, and provisional U.S. patent application No. 63/395,168, filed Aug. 4, 2022, the disclosures of which are incorporated herein, in their entireties, by reference.

FIELD OF THE INVENTION

Illustrative embodiments generally relate to toilet seats and, more particularly, illustrative embodiments relate to self-lifting toilet seats.

BACKGROUND OF THE INVENTION

Toilet seats in public restrooms are frequently soiled, particularly in male and gender-neutral restrooms because men often urinate standing up while the toilet seat is in the down position. Soiling of toilet seats can also occur in female restrooms. Because restroom facilities do not belong to the users, people often have little consideration for the messes they cause. This means that users are less likely to lift the seat up before use, more likely to make messes, and less likely to clean up after themselves if they do make a mess. Conversely, in the home, users of a toilet seat often lift the seat to urinate, only to forget to lower it after use.

SUMMARY OF VARIOUS EMBODIMENTS

In accordance with one embodiment of the invention, a self-lifting toilet seat system includes a toilet seat configured to be sat upon by a user. The system has a hinge configured to rotatably couple the toilet seat and a toilet bowl. The hinge is configured so that the toilet seat is transitionable from an up position to a down position. A lifting system is configured to raise the toilet seat towards the up position. A sealed hinge housing has at least a portion of a delay system therein. The delay system is configured to cause a time delay before the lifting system causes the toilet seat to self-lift towards the up position. The delay system is configured so that the time delay begins after removal of a threshold downward force on the toilet seat.

In various embodiments, the time delay is reset upon application of the threshold downward force on the toilet seat. The time delay may be paused upon the application of the threshold downward force on the toilet seat. The threshold downward force may be applied by a user sitting on the toilet seat or pushing the seat down. In various embodiments, the lifting system comprises a spring.

Among other things, the delay system may include a suction cup and an attachment surface. The temporary adhesion of the cup to the attachment surface delays the toilet seat from self-lifting to the up position. To that end, the attachment surface may include one or more controlled leakage channels. The suction cup may be configured to overlap with at least a portion of the controlled leakage channel when the user lowers the toilet seat to the down position. The one or more controlled leakage channels may be configured to be positioned to be under the suction cup when the suction cup is adhered to the attachment surface.

The one or more of the controlled leakage channels may be sealed by a porous film restricting fluid flow into the suction cup. The attachment surface may be fluid permeable. Thus, the time delay may be a function of the rate of fluid influx while the suction cup is adhered. Additionally, or alternatively, the suction cup elastomer may fluid permeable. Accordingly, the time delay may be a function of the rate of influx of fluid while the suction cup is adhered to the attachment surface. In various embodiments, the suction cup is coupled with the toilet seat through a linkage. The system may be configured to so the time delay is between about 1 second and about 5 minutes.

The hinge housing may be sealed. For example, the housing may be substantially sealed against external sources of contamination. The wall of the substantially sealed housing may contain a filter permeable to air and configured to trap or block contaminates. Among other things, the delay mechanism may be sealed in the housing of the hinge.

The delay system may be sealed in the toilet seat. The delay system may include one or more material flow loops that are internal to and fully contained within the seat. Various embodiments may have a quantity of material (e.g., liquid) within the one or more internal material flow loops. Furthermore, embodiments may include a material motion restricting element within each of the one or more material flow loops. The time delay may be a function of the material restricting element. Additionally, or alternatively, some embodiments may include a geared delay system that controls the time delay. Accordingly, various embodiments provide a passive lifting system and delay system, requiring no electronic power.

In accordance with another embodiment, a method automatically self-lifts a toilet seat. The method provides a toilet seat. The seat is configured to couple with a hinge that rotatably couples the toilet seat and a toilet bowl. The hinge is configured so that the toilet seat is transitionable from an up position to a down position. The method lowers the toilet seat to a down position. Lowering the toilet seat engages a substantially sealed delay system configured to cause a time delay before the toilet seat self-lifts. The toilet seat is self-lifted after the time delay using the lifting system.

In some embodiments, the method lowers the toilet seat to the down state, from any location of the seat about the hinge, to restart or pause the time delay. The delay system may include a suction cup and an attachment surface, and lowering the toilet seat to a down position causes the suction cup to couple with the attachment surface. Furthermore, the controlled admission of fluid into the suction cup may release the cup from the attachment surface. The toilet seat may then be self-lifted using a lifting device.

In accordance with yet another embodiment, a self-lowering toilet seat system includes a toilet seat configured to be sat upon by a user. The system includes a hinge rotatably coupling the toilet seat and a toilet bowl. The hinge is configured so that the toilet seat is transitionable between a down position and an up position. A lowering device is configured to self-lower the toilet seat towards the down position. The system includes a housing having a mechanical delay system therein. The delay system is configured to cause a time delay before the lowering device causes the toilet seat to lower towards the down position. The delay system is trigged by a user raising the toilet seat towards the up state and removing their applied force from the toilet seat. The system is further configured to restart the delay system if the user re-applies the raising force before the delay system has expired.

In various embodiments, the system is configured to restart when the user applies the raising force to lift the seat to an up state.

BRIEF DESCRIPTION OF THE DRAWINGS

Those skilled in the art should more fully appreciate advantages of various embodiments of the invention from the following "Description of Illustrative Embodiments," discussed with reference to the drawings summarized immediately below.

Figure 34:
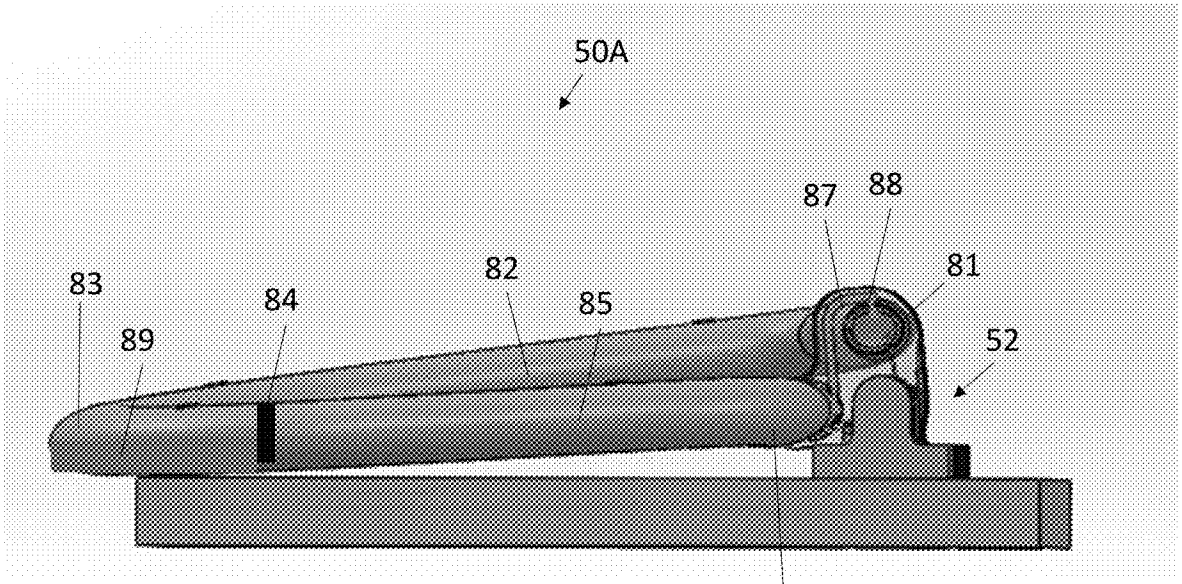
Figure 35:
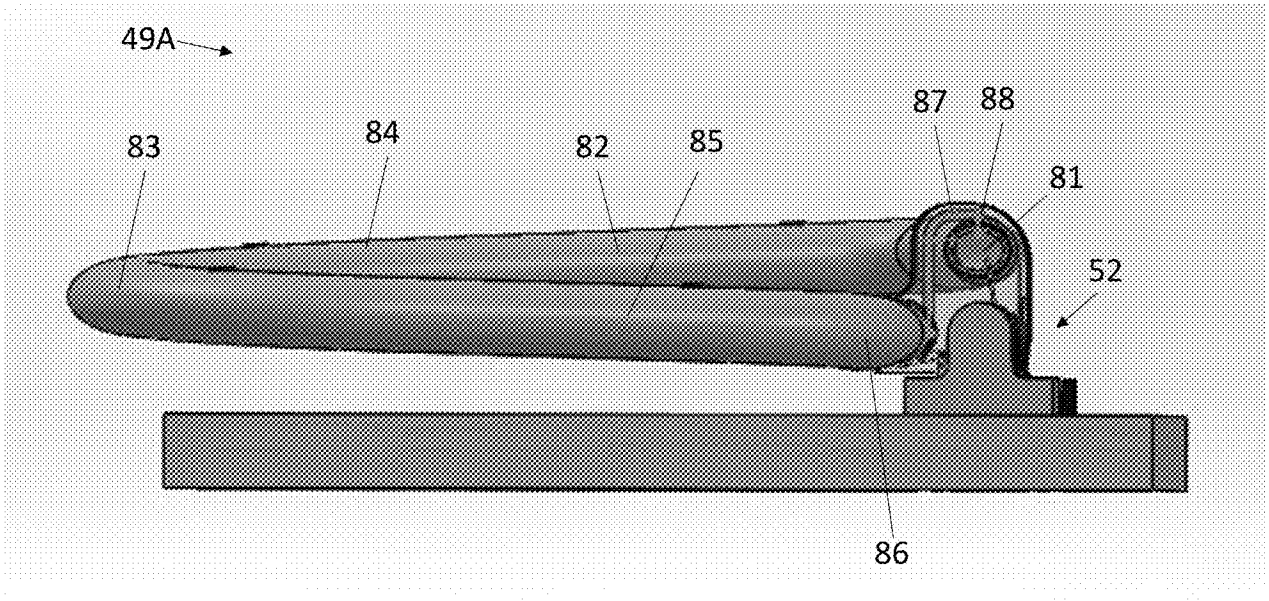
Figure 36:
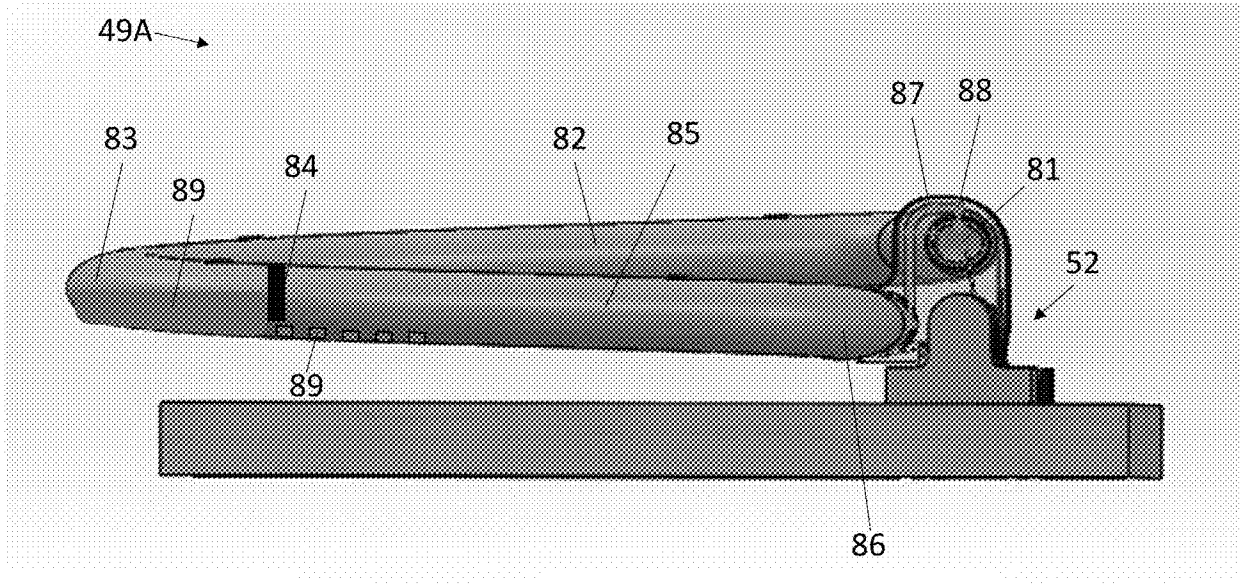

FIGS. 34-36 schematically show a process of activating the delay system of the self-lifting toilet seat in accordance with illustrative embodiments of the invention.

Figure 37:
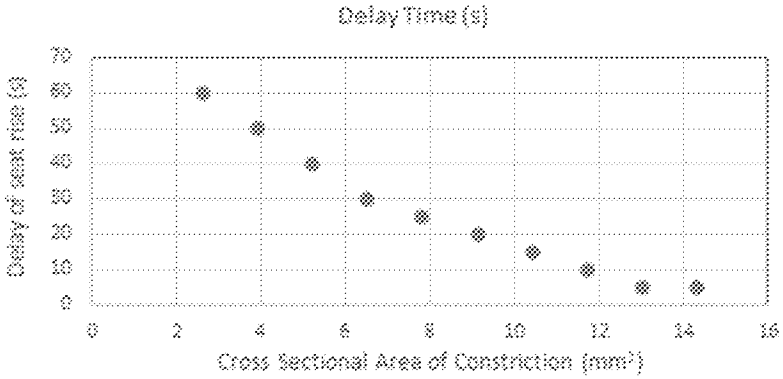

FIG. 37 shows a chart of estimated time delay plotted against a cross-sectional area of the flow constriction element in the return flow channel in accordance with illustrative embodiments.

Figure 38:
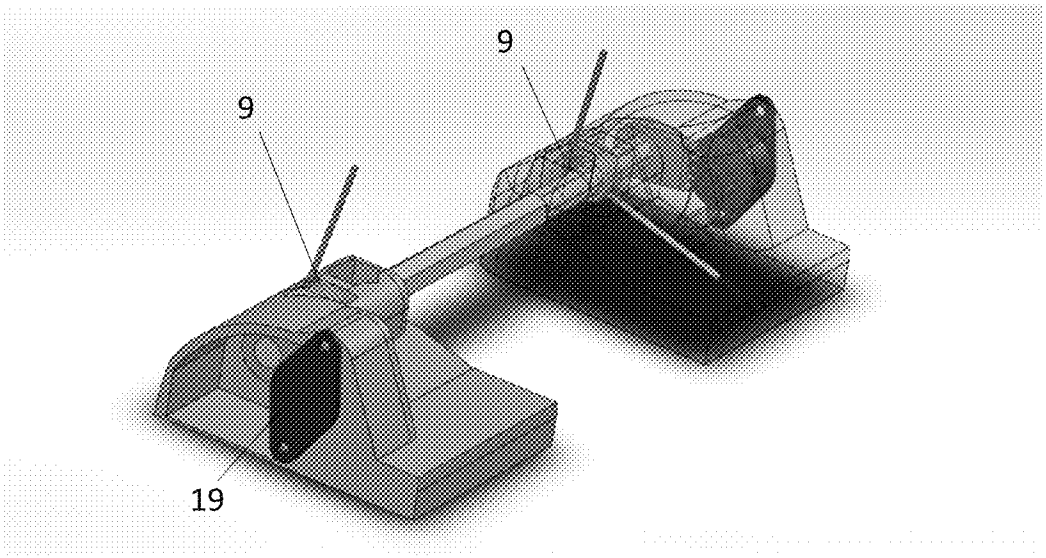

FIG. 38 schematically shows a rotary damper system in accordance with illustrative embodiments.

Figure 39:
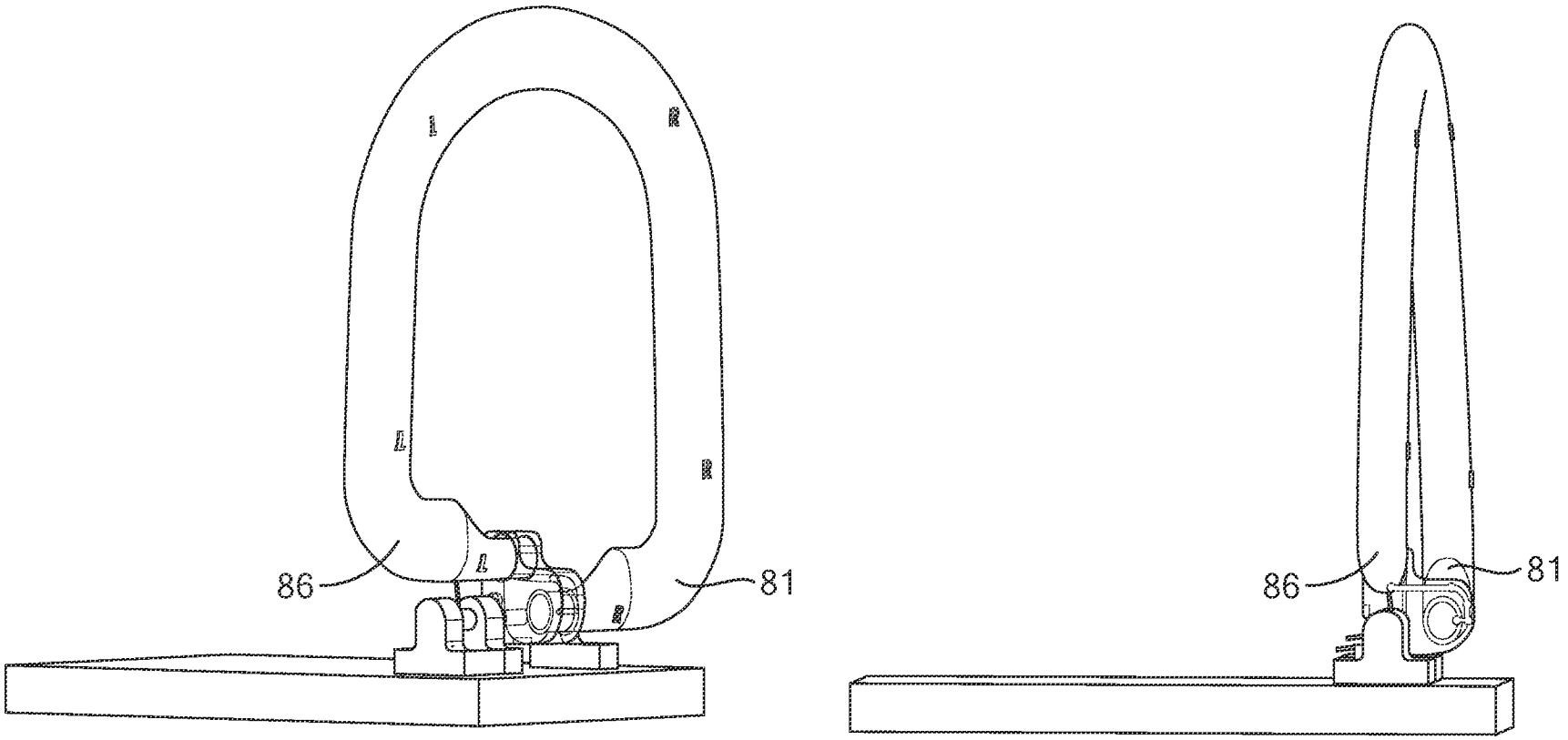

FIG. 39 schematically shows the seat in the up position with a recovery chamber that is offset vertically with respect to a starting chamber in accordance with illustrative embodiments.

Figure 40:
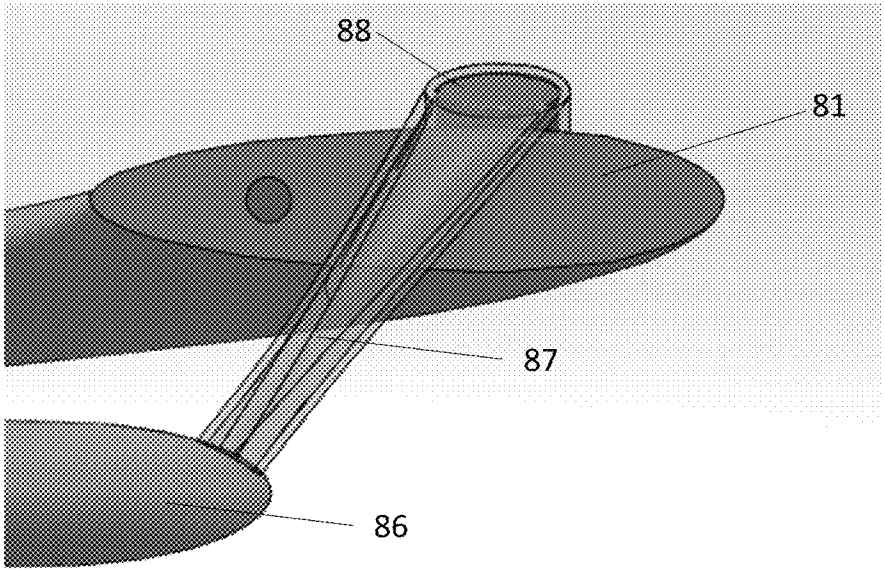

FIG. 40 schematically shows a close-up view of the liquid reset channel that connects the recovery chamber and the starting chamber in accordance with illustrative embodiments.

Figure 41:
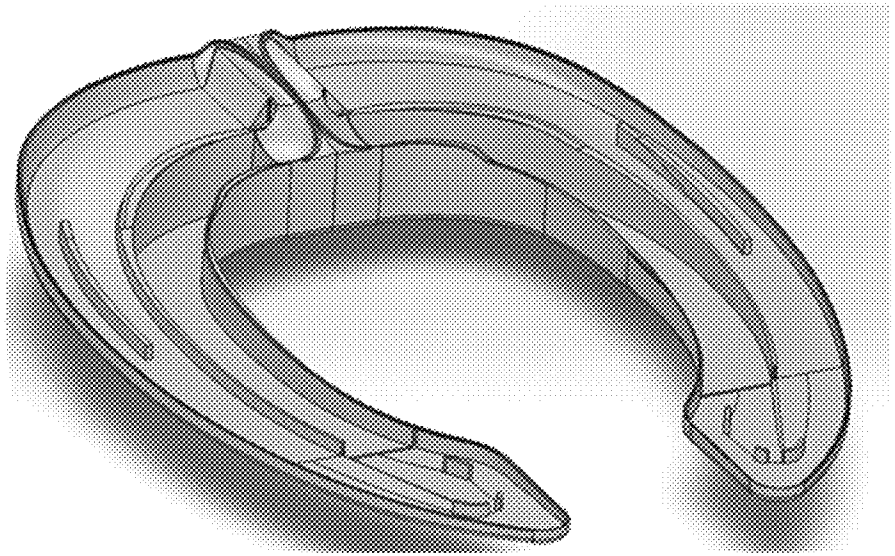

FIG. 41 shows a cross-sectional view of an internal channel geometry in accordance with illustrative embodiments.

Figure 42:
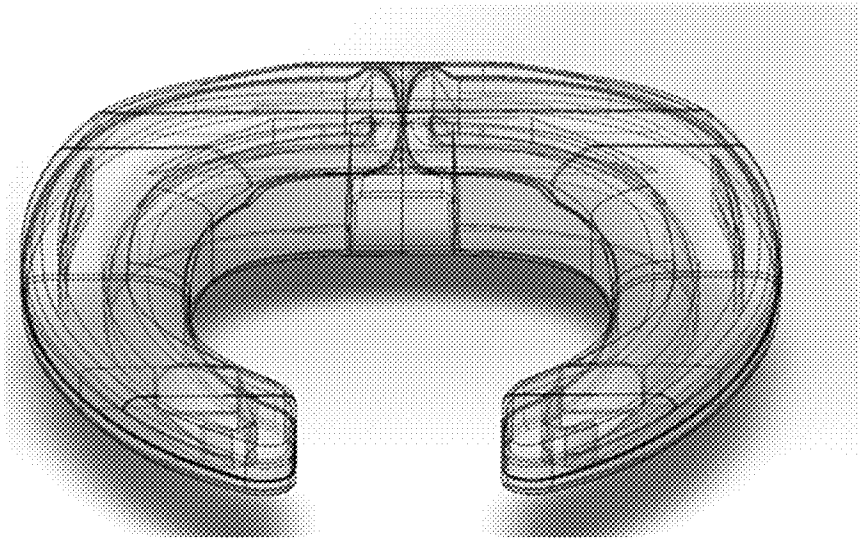

FIG. 42 shows a transparent frontal view of a toilet seat in accordance with illustrative embodiments.

Figure 43B:
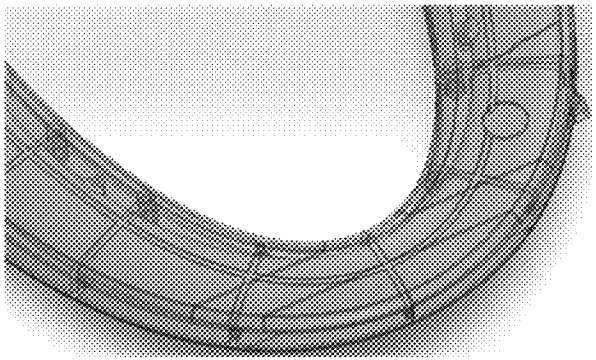
Figure 43A:
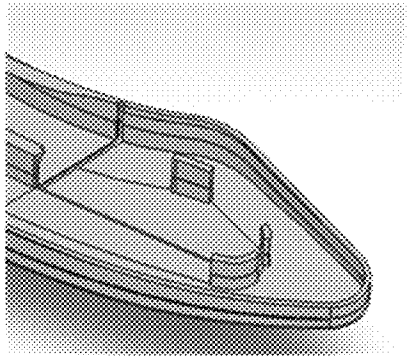

FIGS. 43A-B show a cross-sectional view of the front holding chamber in accordance with illustrative embodiments for a toilet seat with and without a gap at the front, respectively.

Figure 44:
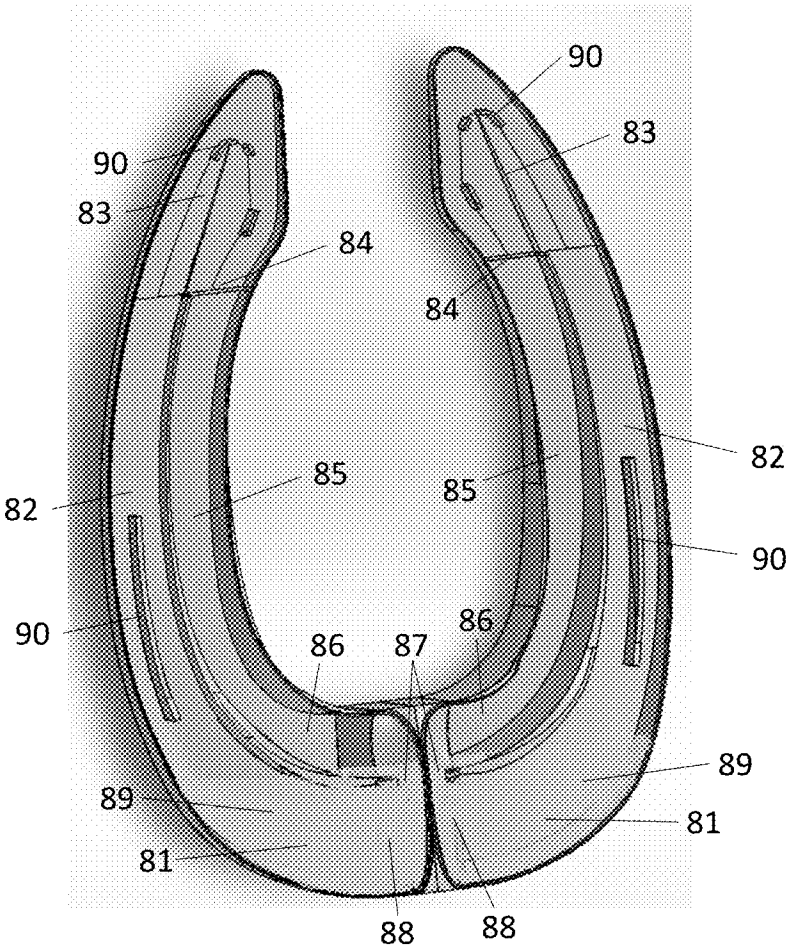

FIG. 44 shows a top cutaway view of a toilet seat with two independent liquid flow loops in accordance with illustrative embodiments.

Figure 45:
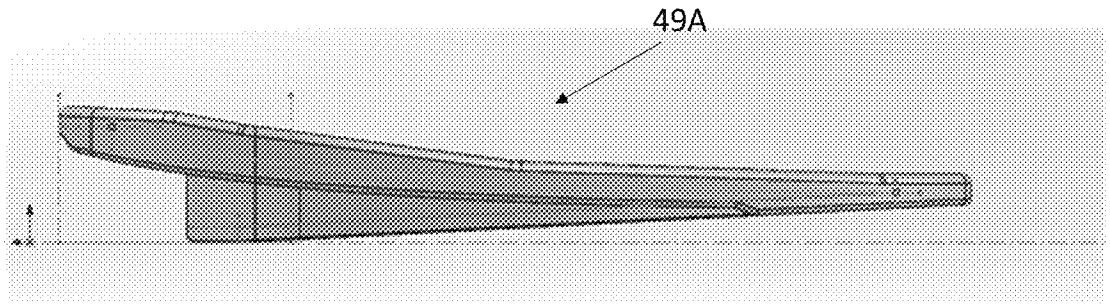

FIG. 45 schematically shows a side view of a toilet seat with a curved profile extending from the starting chamber to the frontal holding chamber in accordance with illustrative embodiments.

Figure 46:
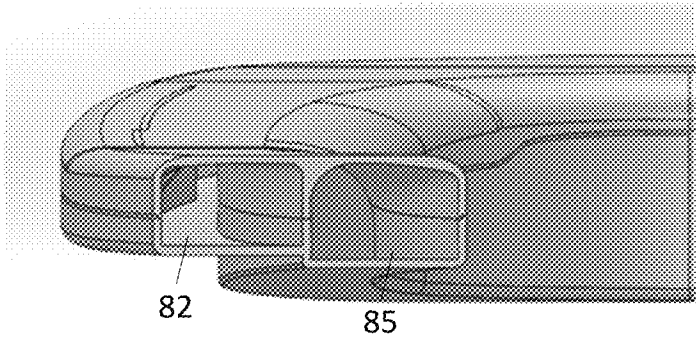

FIG. 46 schematically shows a cross-sectional view of a toilet seat in accordance with illustrative embodiments of the invention.

Figure 47:
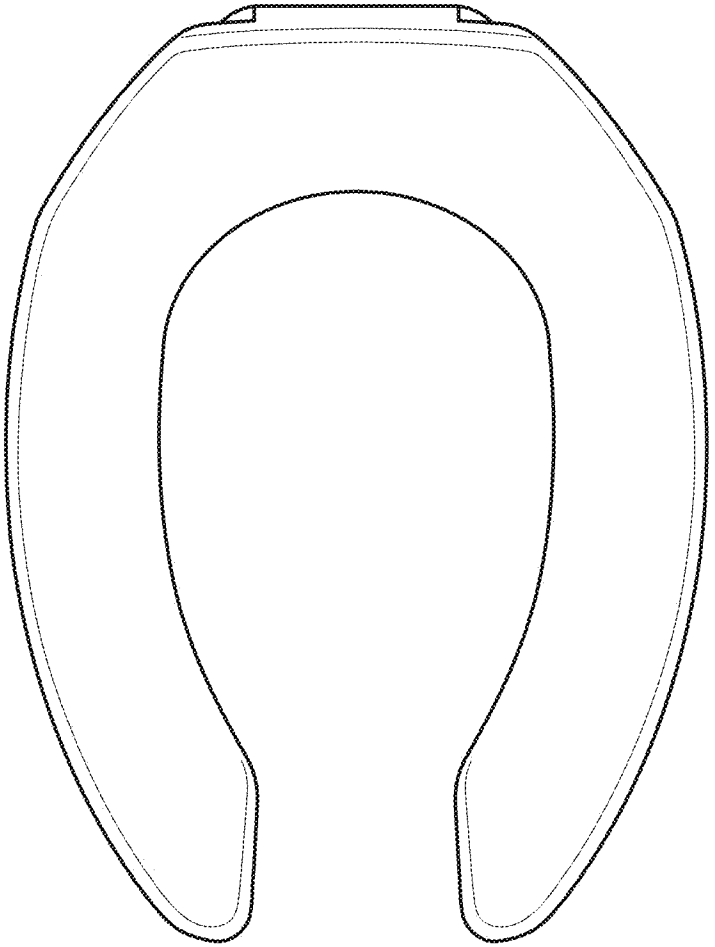

FIG. 47 schematically shows a top view of a standard toilet seat with a gap at the front in accordance with illustrative embodiments.

Figure 48:
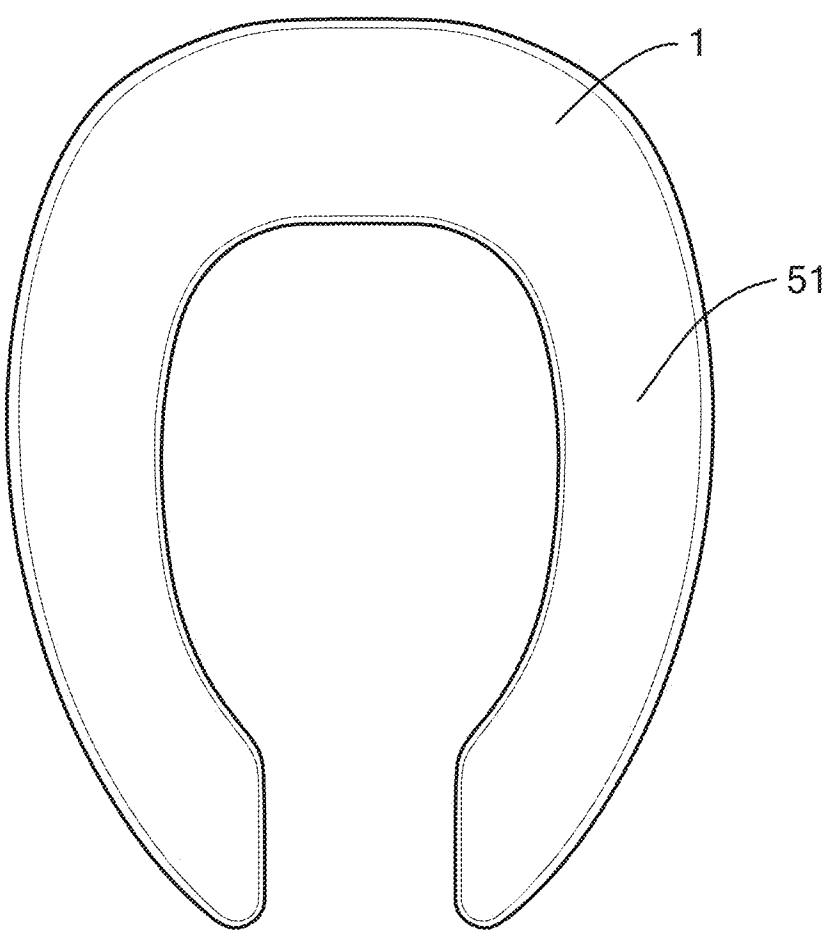

FIG. 48 schematically shows a top view of a toilet seat in accordance with illustrative embodiments.

Figure 49A:
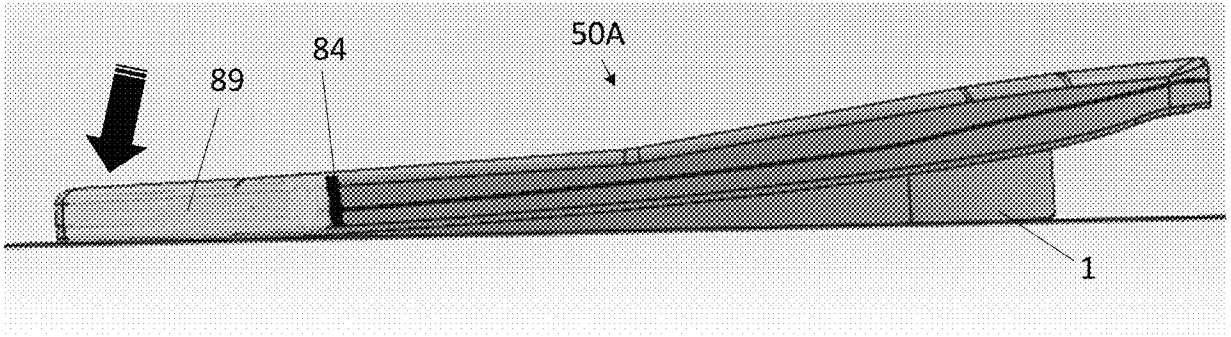
Figure 49B:
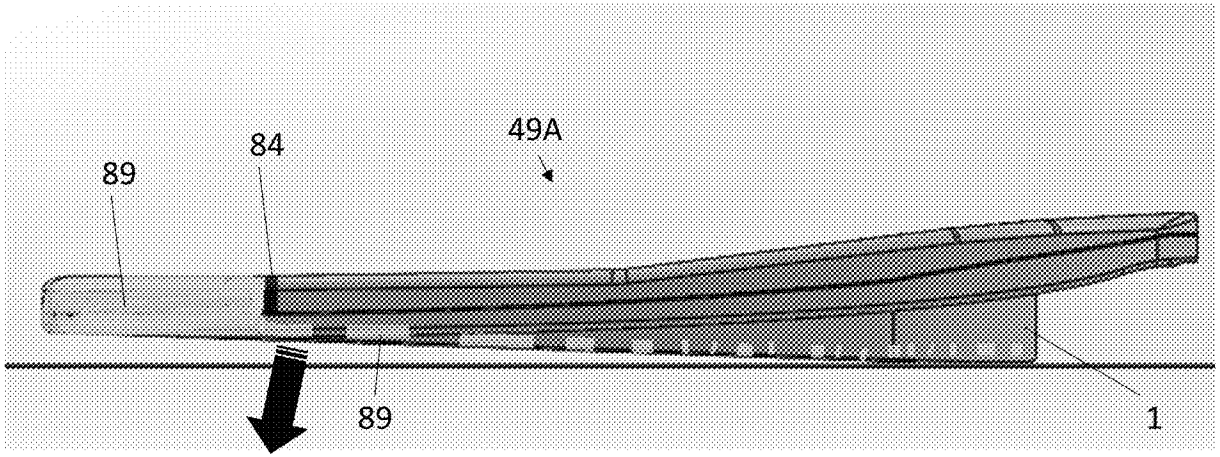

FIGS. 49A-49B show initiation of the delay system in accordance with illustrative embodiments.

Figure 50:
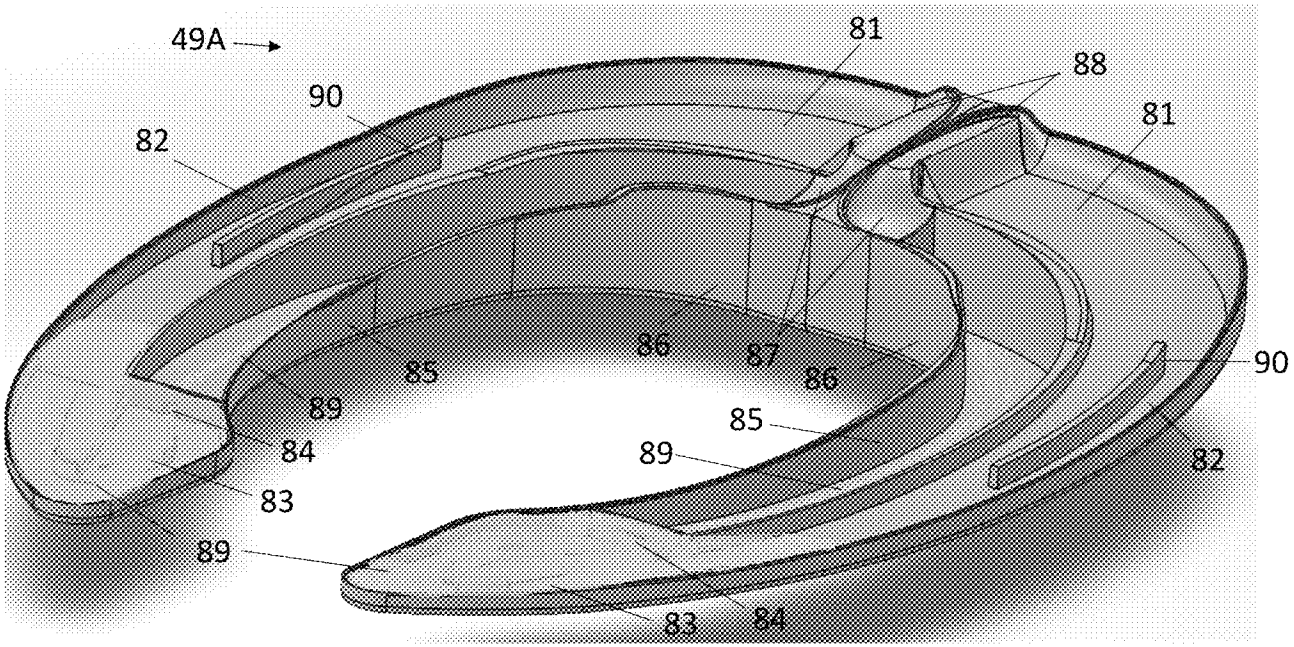

FIG. 50 shows liquid that has accumulated in the front holding chambers passing through the flow constrictions back to the recovery chambers in the rear of the seat in accordance with illustrative embodiments.

Figure 51:
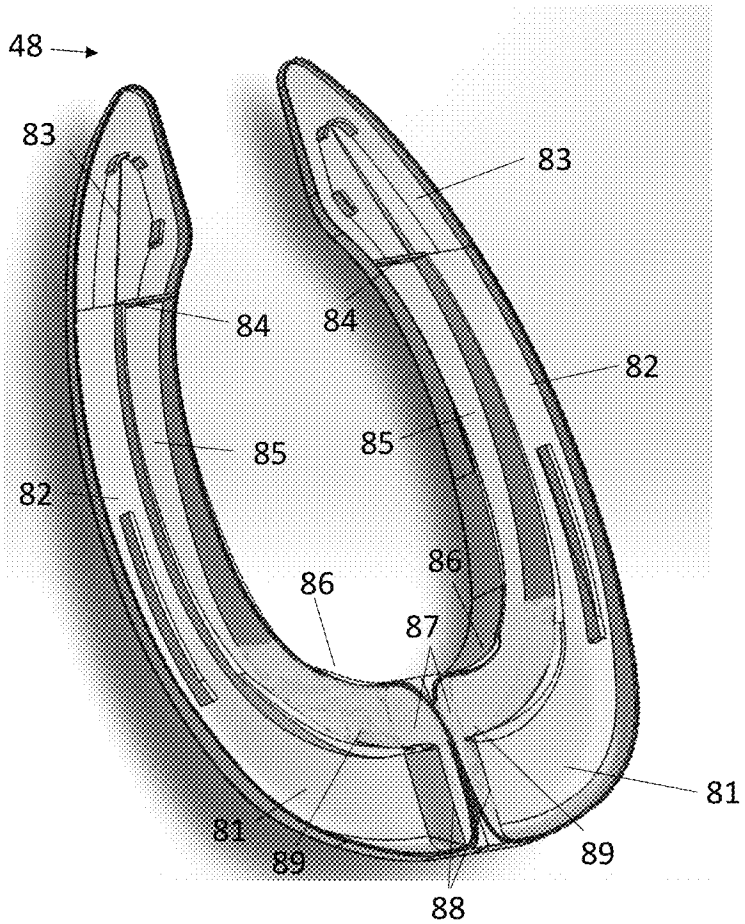

FIG. 51 shows another cutaway view of the toilet seat in a substantially lifted position where liquid that has accumulated in the recovery chamber flows back to the starting chamber through a reset channel in accordance with illustrative embodiments.

Figures 52A, 52B:
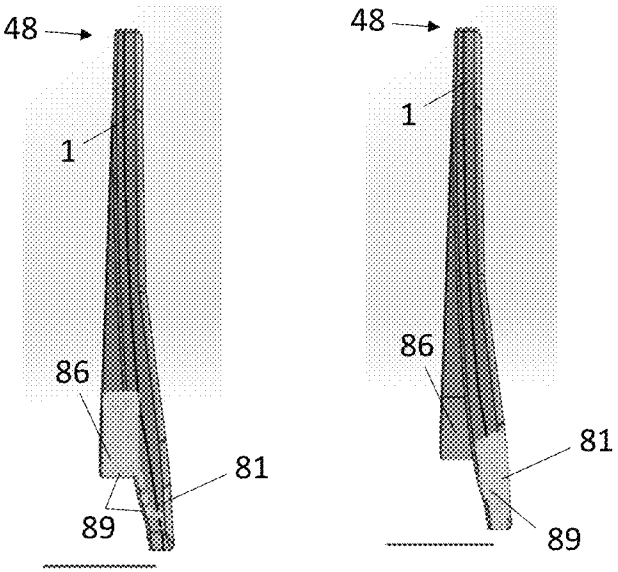

FIG. 52A shows liquid accumulation in the recovery chamber immediately after the seat reaches the up position in accordance with illustrative embodiments.

FIG. 52B shows liquid moving back to the starting chamber through the reset channel after reaching the up position in accordance with illustrative embodiments.

Figure 53:
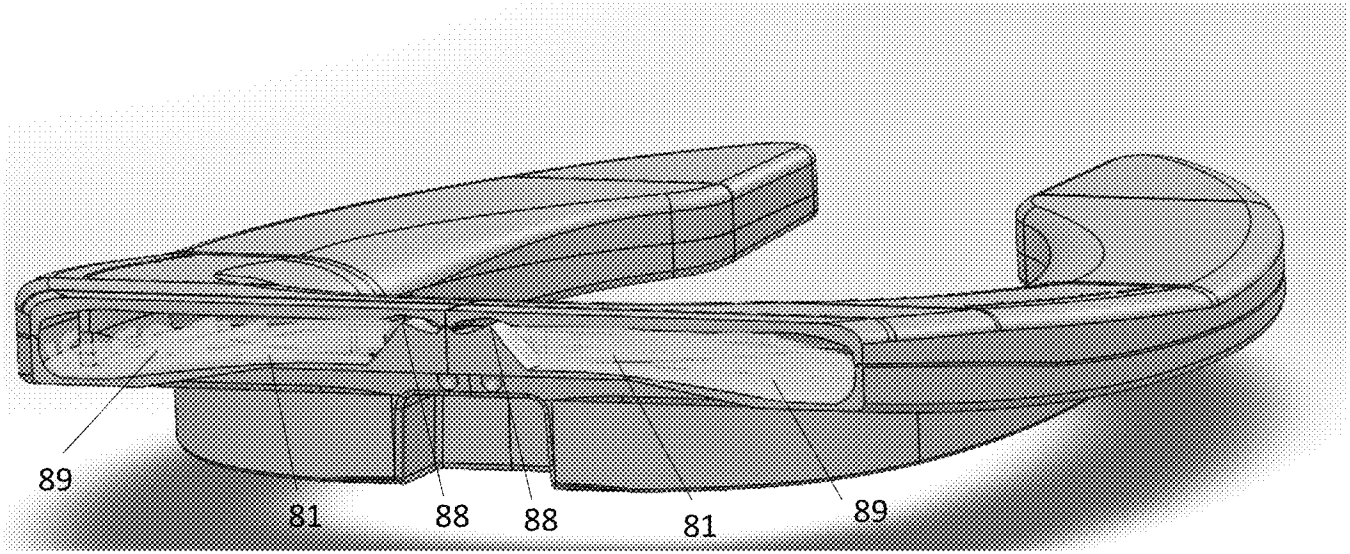

FIG. 53 shows a rear, cutaway view of reset flow from the recovery chamber entering the starting chamber through an elevated port in accordance with illustrative embodiments.

Figure 54A:
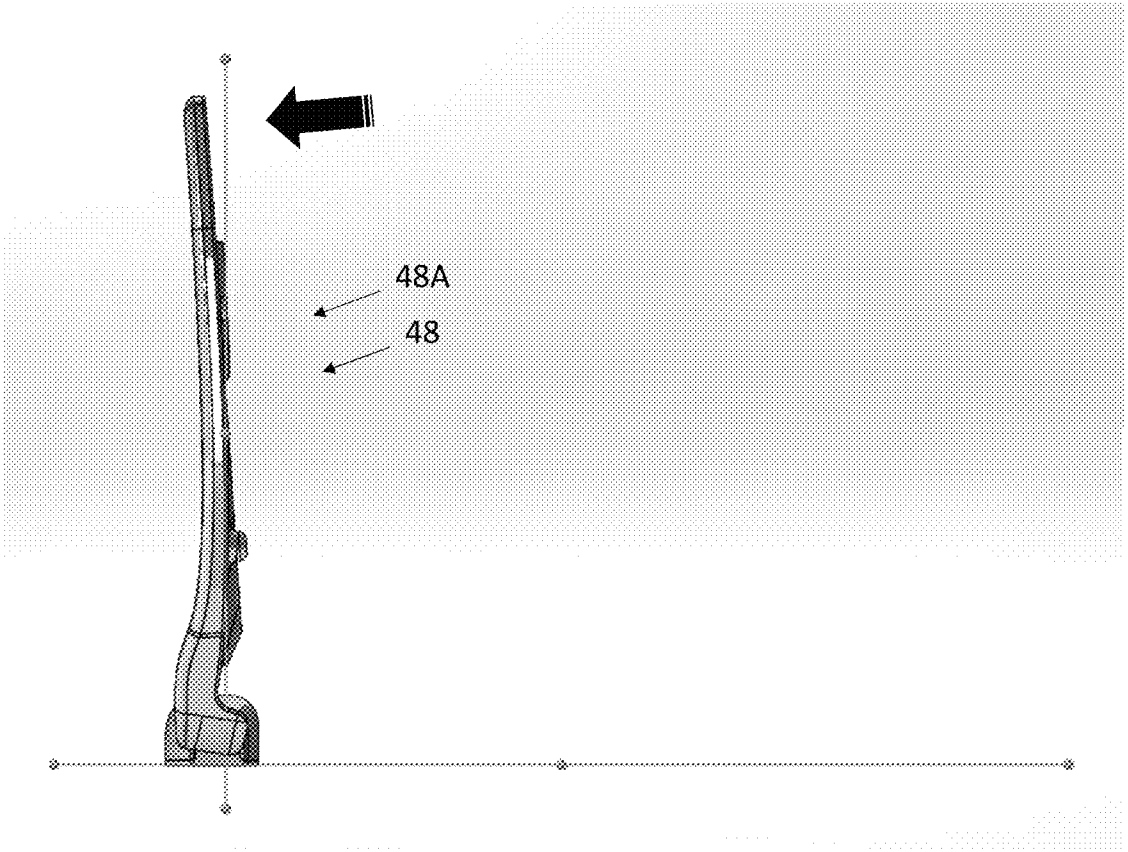
Figure 54B:
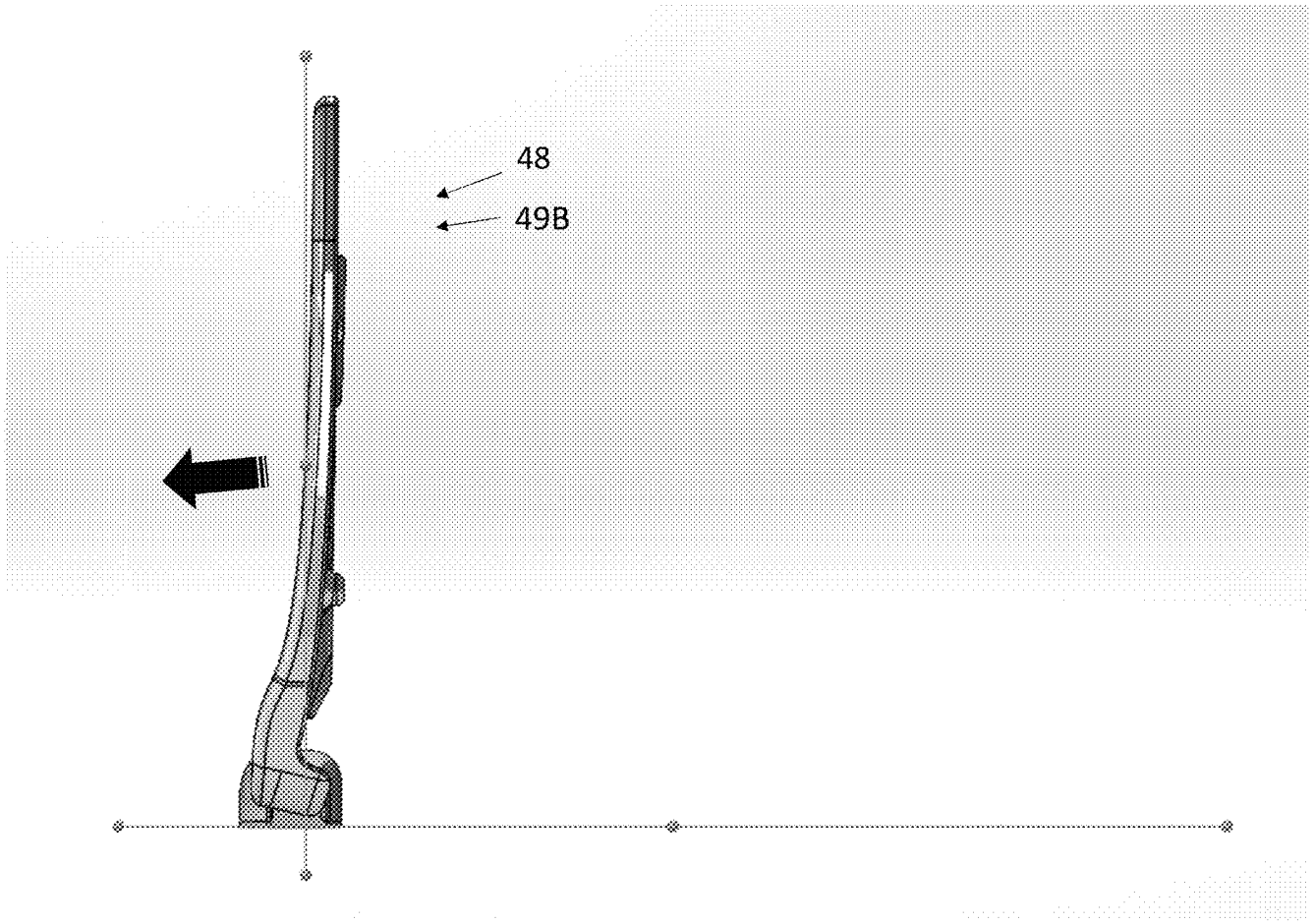
Figure 54C:
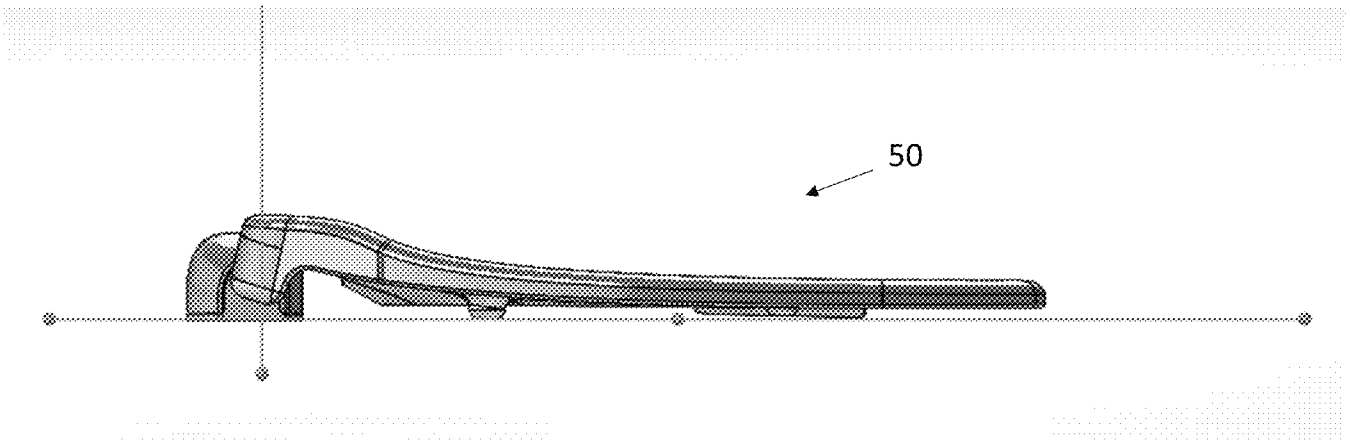

FIG. 54A-C schematically shows the seat of the self-lowering embodiment in various positions in accordance with illustrative embodiments.

Figure 55A:
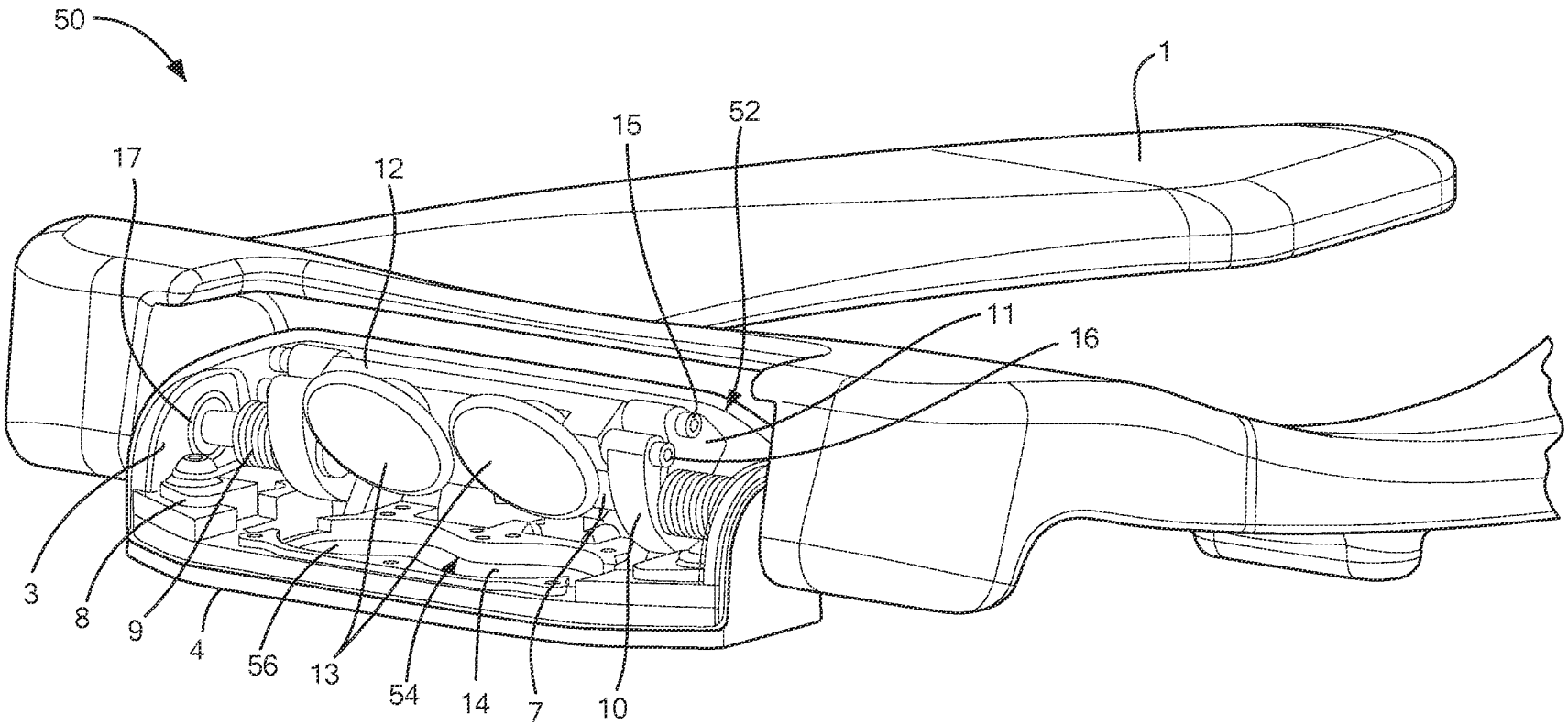
Figure 55B:
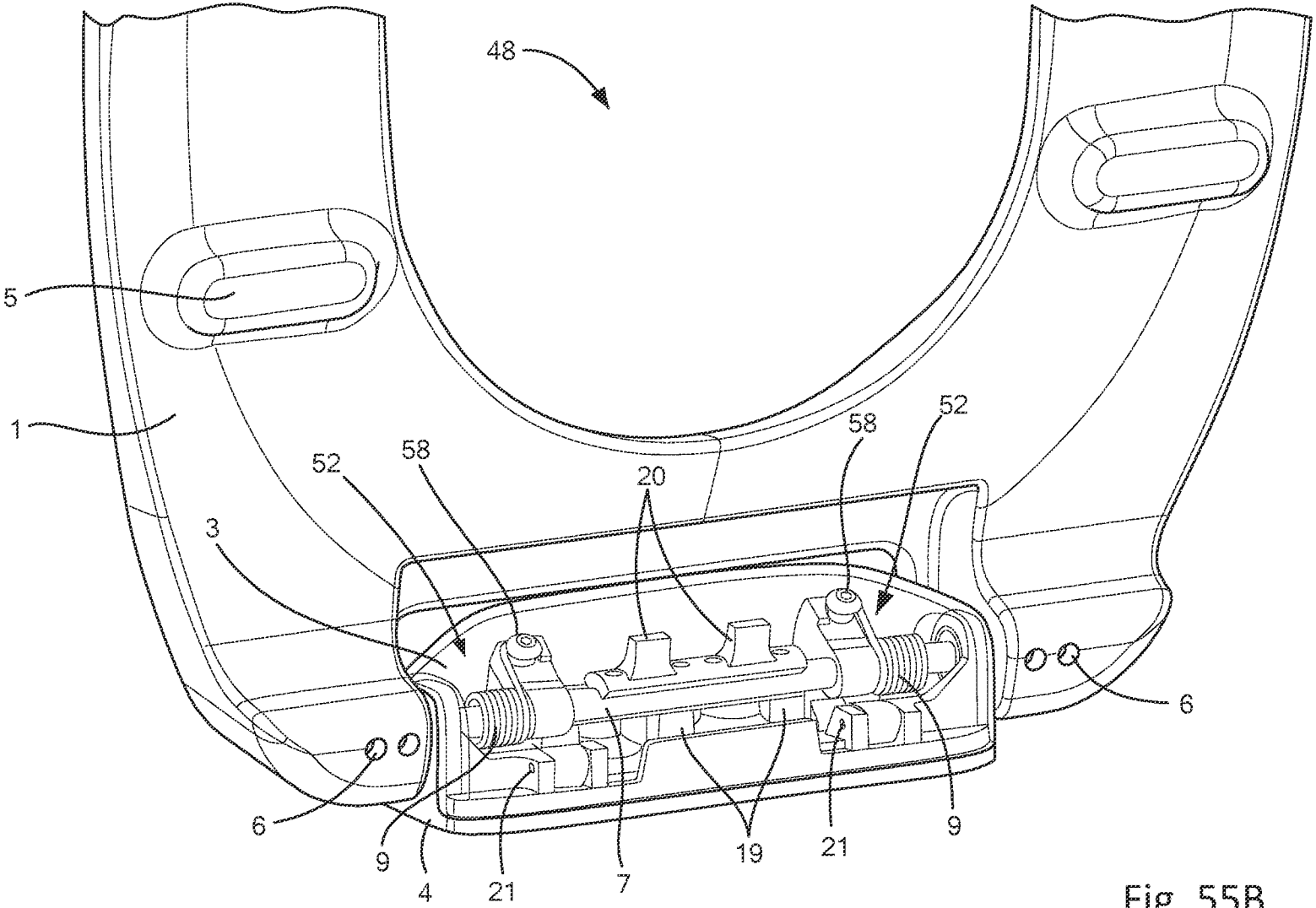

FIG. 55A schematically shows a rear view of the hinge of the self-lowering toilet seat system with the seat in the down position in accordance with illustrative embodiments FIG. 55B schematically shows a front view of the hinge of the self-lowering toilet seat system with the seat in the up position in accordance with illustrative embodiments.

Figure 56A:
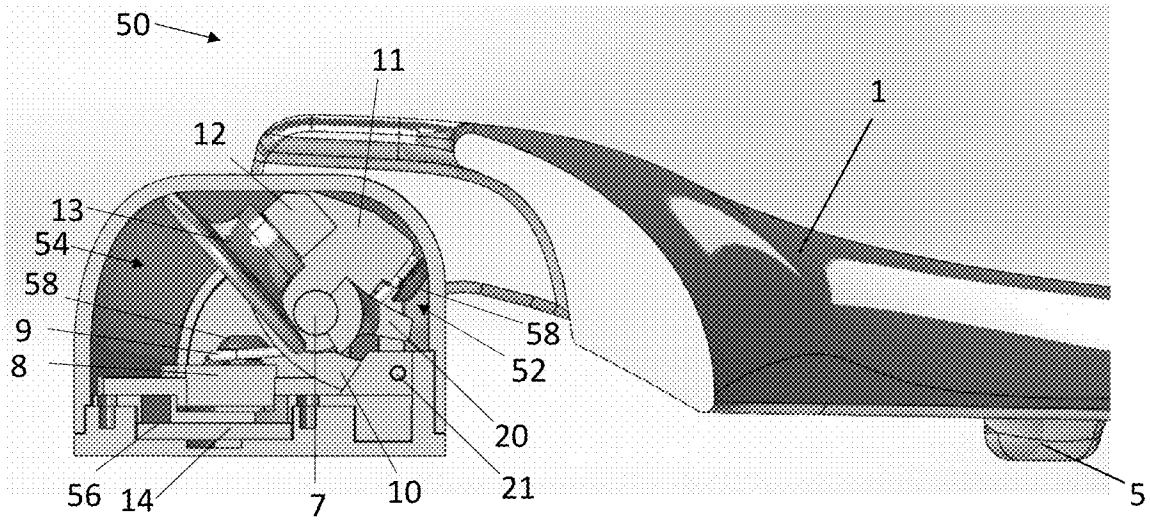

FIG. 56A schematically shows a cutaway side view of the toilet seat of FIG. 55A in the down position in accordance with illustrative embodiments.

Figure 56B:
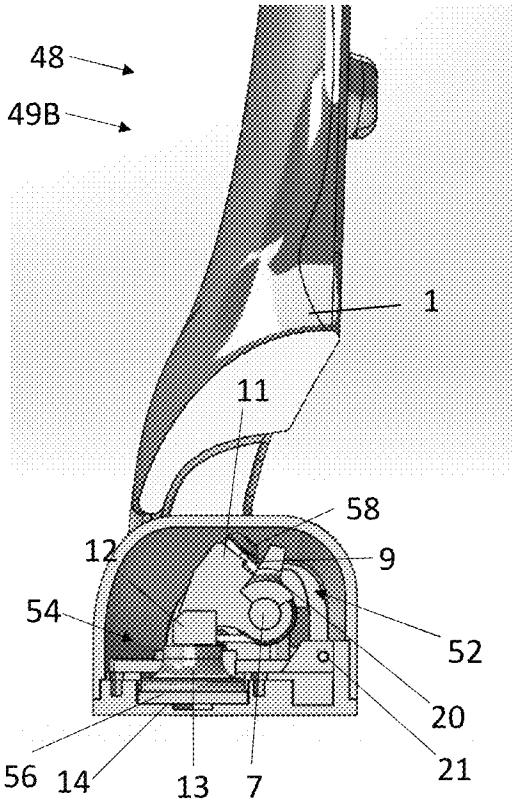

FIG. 56B schematically shows a cutaway side view of the toilet seat of FIG. 55A in the neutral state in accordance with illustrative embodiments.

Figure 56C:
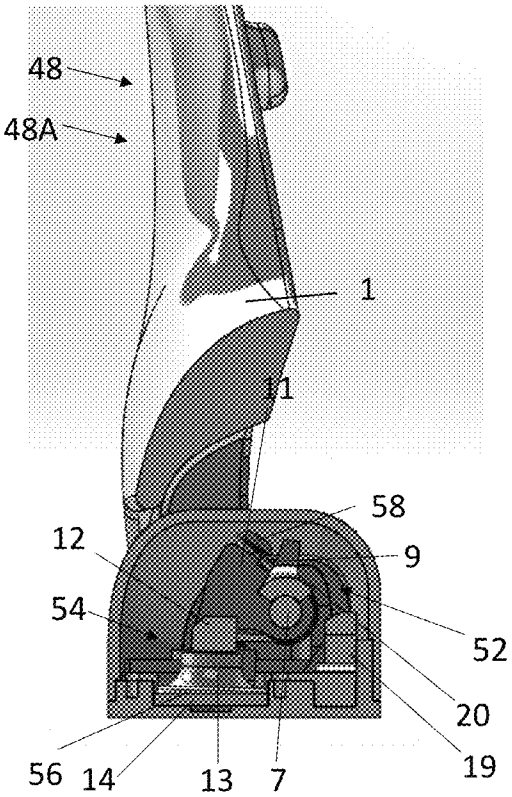

FIG. 56C schematically shows a cutaway side view of the toilet seat of FIG. 55A in the up state in accordance with illustrative embodiments.

DESCRIPTION OF ILLUSTRATIVE EMBODIMENTS

In illustrative embodiments, a toilet seat system is configured to automatically lift a toilet seat to an up position. To that end, the system includes a biasing system configured to lift the toilet seat to the up position. The toilet seat system may also be, referred to as a self-lifting toilet seat system. The self-lifting toilet seat system advantageously reduces the likelihood of waste (e.g., urine) contacting the toilet seat, particularly the surface upon which a user sits. Advantageously, when a user wishes to sit on the toilet seat, they may user-lower the toilet seat, without requiring additional cleaning of the toilet seat. After a user applied force is removed from the seat, the toilet seat system is configured to provide a delay prior to self-lifting the toilet seat back into the up position, so as to reduce the likelihood of the toilet seat accidentally hitting the user when preparing to sit, and to give the user time to leave the toilet seat without the seat impacting the user or their clothing. Additionally, the toilet seat system may be configured such that a user may lift the seat back to the up position at any time without significant difficulty, and without causing harm to the delay system. Accordingly, various embodiments advantageously provide improved cleanliness of the toilet seat and an overall improved user experience. Details of illustrative embodiments are discussed below.

In other embodiments, the toilet seat system is configured to self-lower a toilet seat to a down position. To that end, the system includes a biasing system configured to lift the toilet seat to the up position. The toilet seat system may also be referred to as a self-lowering toilet seat system. The self-lowering toilet seat system 100 advantageously reduces the likelihood that a user will forget to lower the toilet seat after use. Details of illustrative embodiments are discussed below.

Figure 1:
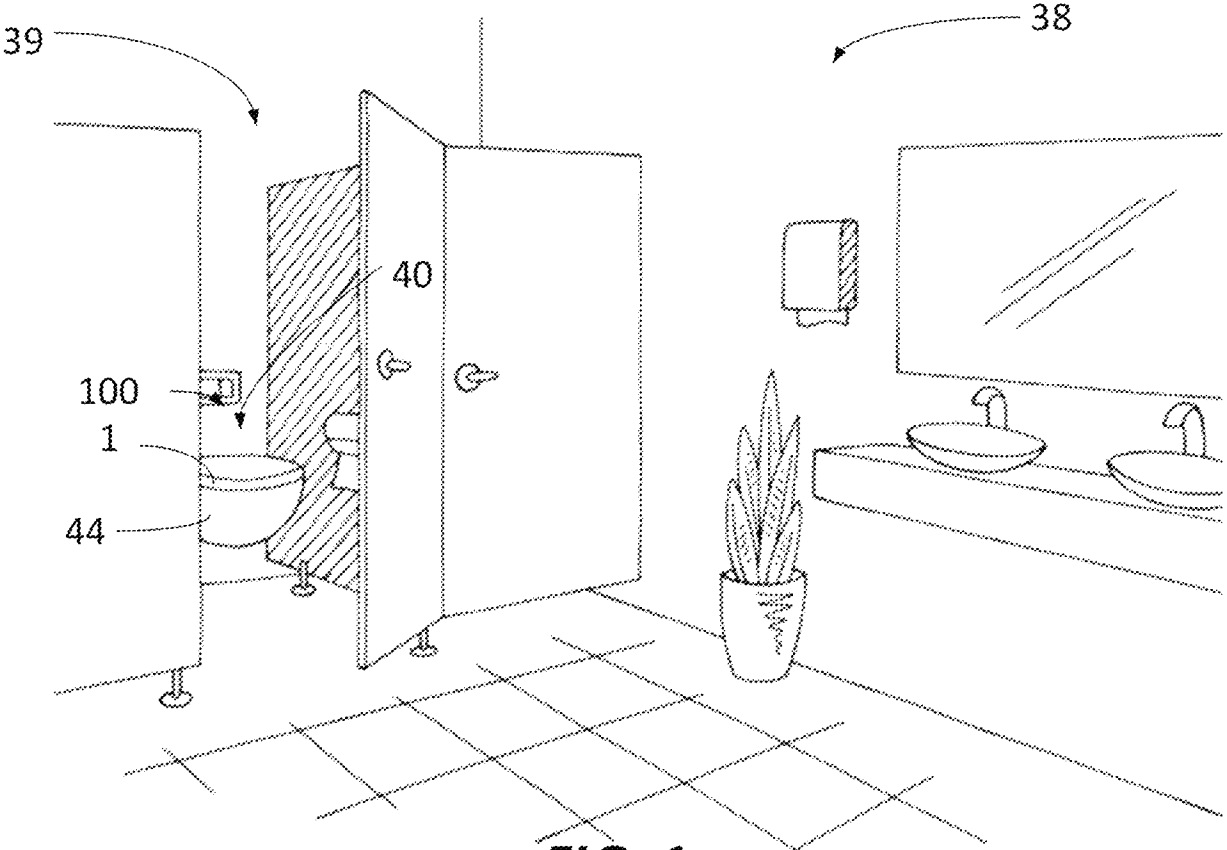
FIG. 1 schematically shows a public restroom in accordance with illustrative embodiments of the invention.

FIG. 1 schematically shows a public restroom 38 in accordance with illustrative embodiments of the invention. The restroom 38 includes one or more stalls 39 each having a toilet 40. In illustrative embodiments, the toilet 40 includes a self-lifting toilet seat system 100. The toilet 40 includes a toilet seat 1 upon which a user may sit, and a toilet bowl 44 configured to receive waste from the user. A hinge 46 couples the toilet seat 1 with the toilet bowl 44.

Figure 2:
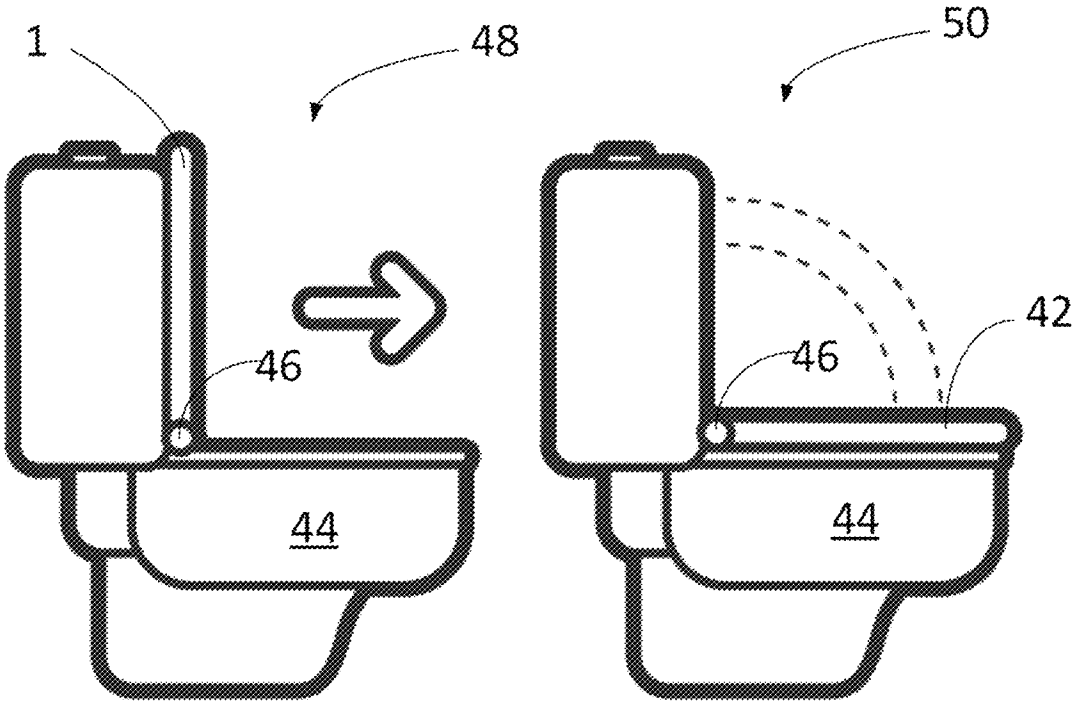
FIG. 2 schematically shows the toilet seat transitioning from an up position to a down position in accordance with illustrative embodiments.

FIG. 2 schematically shows the toilet seat 1 transitioning from the up position 48 to a down position 42 in accordance with illustrative embodiments. Like many standard toilet seats, the seat 1 is configured to transition from the down 42 position to the up 48 position, and vice-versa (e.g., by rotating about the hinge 46). The down position 42 is the position on which the toilet seat 1 is meant to be sat upon by a user. The up position is the lifted rested position of the toilet seat 1 (e.g., frequently employed when a male user is urinating). Some embodiments may also have a neutral position where the seats comes to rest after the user's weight is removed from the toilet seat 1 (e.g., the user no longer sits on the seat 1).

The hinge 46 allows the seat 1 to rotate from an up position 48 to a down position 50 (e.g., where the seat 1 contacts the bowl 44), and to a plurality of positions between the up position 48 and the down position 50. For example, as discussed further below, some embodiments (e.g., self-lifting) begin the time delay when the seat is user-lowered to a down state and released from the down state (i.e., force holding the seat in the down state is removed), while others (e.g., self-lowering) begin the time delay when the seat is user-lifted to the up state and released from the up state (i.e., force holding the seat in the up state is removed).

A self-lifting toilet seat system 100 is advantageous in a public restroom 38 for the reasons described below. The public restroom may have a considerable number of users throughout the day. For example, at sports events, music events, and other public venues, it is likely that hundreds of users may use a particular toilet 40. Throughout the day, it is likely that the toilet seat 1, if it remains in the down position 50, becomes soiled with user waste, and therefore, becomes undesirable sit upon. Large venues frequently require a large number of staff to maintain and clean the toilet seat 1. Advantageously, self-lifting embodiments allow the toilet seat 1 to remain cleaner than a toilet seat that remains horizontal, as they proactively remove the seat 1 from the proverbial "line of fire," thereby reducing the burden on cleaning staff and improving the user experience.

Although illustrative embodiments refer to toilets 40 in public restrooms 38 and large venues, it should be understood that illustrative embodiments apply to toilets 40 in any setting. For example, illustrative embodiments may be applied to portable toilets, and/or residential restrooms toilet seats 40. Illustrative embodiments provide a passive, non-electrically powered system, and therefore are particularly suited for high-volume settings without nearby electrical connections (e.g., portable toilets at sporting events/festivals). Battery-powered systems are high-maintenance, require the batteries to be replaced at regular intervals (and to be properly disposed of), and the battery connection and access may compromise long-term reliability.

Furthermore, as will be discussed later, various embodiments may advantageously be configured to be self-lowering, wherein the system self-lowers seat 1 to the down position, and therefore, may be particularly suited for residential settings where lowering of the toilet seat 1 is preferred after use. FIG. 2 schematically shows the toilet seat transitioning from the up position 48 to down position 50 in accordance with illustrative embodiments.

In illustrative embodiments of the self-lifting toilet seat system 100, the down position 50 is a general callout to the location of the seat 1, regardless of system states. In the down position 50, the bottom plane of the seat 1 (e.g., the intersection of the surfaces of nubs 5 of seat 1, if the seat has nubs, or whichever components first contact the bowl 44) is substantially parallel to the top plane of the bowl 44 (e.g., about −15 degrees to about 25 degrees).

In illustrative embodiments, the up position 48 is a general callout to the location of the seat 1, regardless of system states. In the up position 48, the bottom plane of the seat is substantially perpendicular to the top plane of the bowl 44 (e.g., about 80-115 degrees from the down position).

In the down state 50A a user force is applied sufficient to hold the seat in the down position 50 (e.g., by sitting on the seat 1 or holding the seat 1 down). In the down state 50A, the delay system is engaged, and the time delay begins right after or concurrently with the toilet seat 1 entering the neutral state (e.g., after the user removes their applied force from the toilet seat 1). In various embodiments, the time delay may be reset or paused by the user forcing the seat back to the down state 50A.

In self-lifting embodiments, the neutral state 49A is the state of the seat 1 after the seat 1 has been user-lowered to the down state and there is no more user applied force to the seat 1. In the neutral state 49A, the user force is removed and the seat remains in the down position 50 until a predetermined time delay expires. The delay system 54 prevents the lifting system 52 from self-lifting the toilet seat 1 towards the up position 48. Lifting the toilet seat 1 "towards" the up position 48 may include lifting the toilet seat 1 until the seat 1 reaches the up position 48. The angular position of the seat 1 about the hinge 46 relative to the top plane of the bowl 44 with such a loading case is the neutral position. Although still considered to be roughly in the down position 50, the neutral position may, in some embodiments, have an angular offset of between about 0 and about 20 degrees from the position of the toilet seat in the down state 50A.

For illustrative embodiments configured to be self-lifting, the seat 1 may be either in the neutral state 49A or the down state 50A and still considered to be in the down position 50.

Furthermore, in various embodiments, the seat is "self-lifted" when the lifting system 52 causes the seat 1 to rotate, forcing the seat 1 to the up position (e.g., from the down state through the neutral state to the up position).

Furthermore, the user-lowering transitions the seat 1 from the up position to the down position.

Figure 3A:
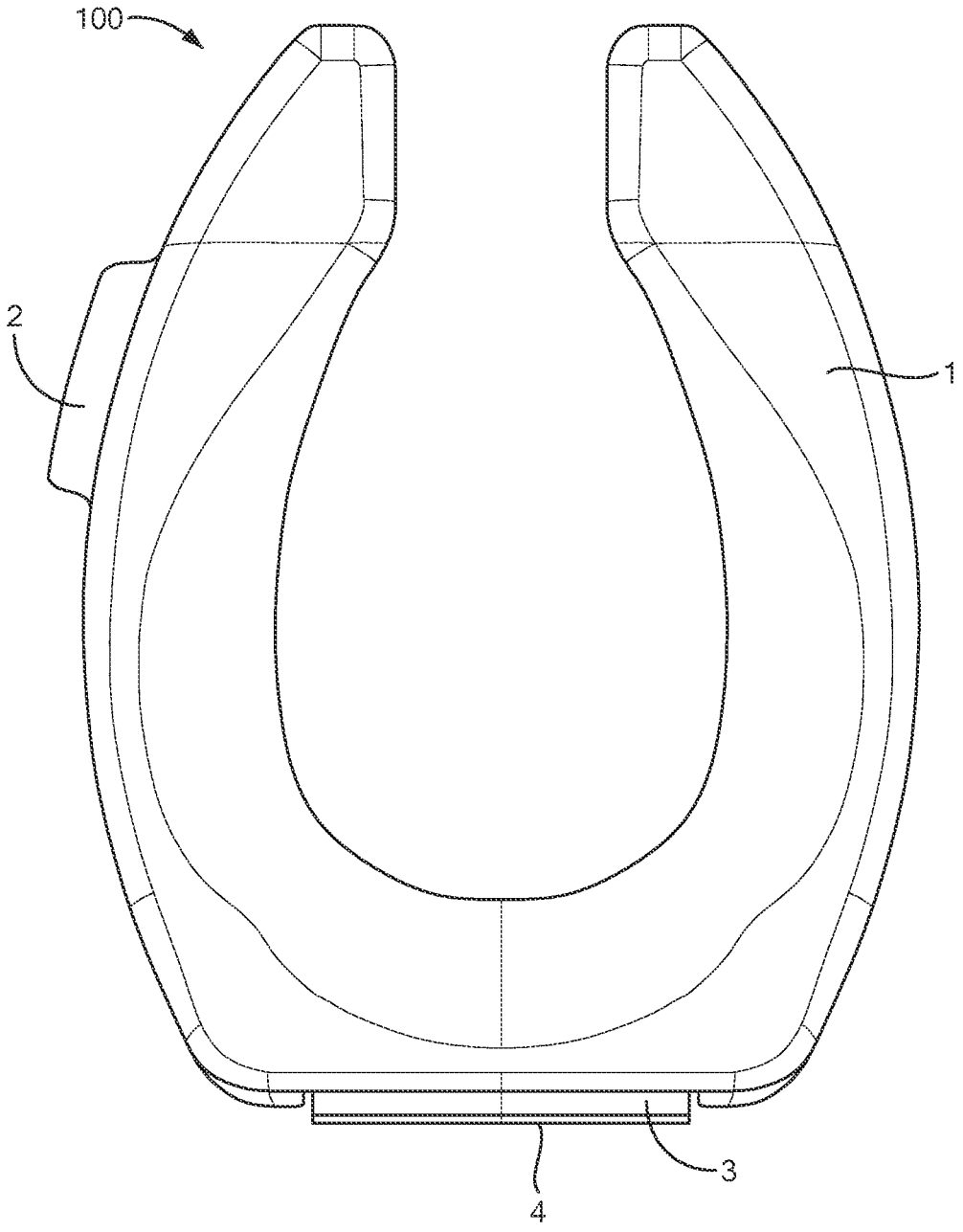
FIGS. 3A-3C schematically show the self-lifting toilet seat system in accordance with illustrative embodiments.
Figure 3B:
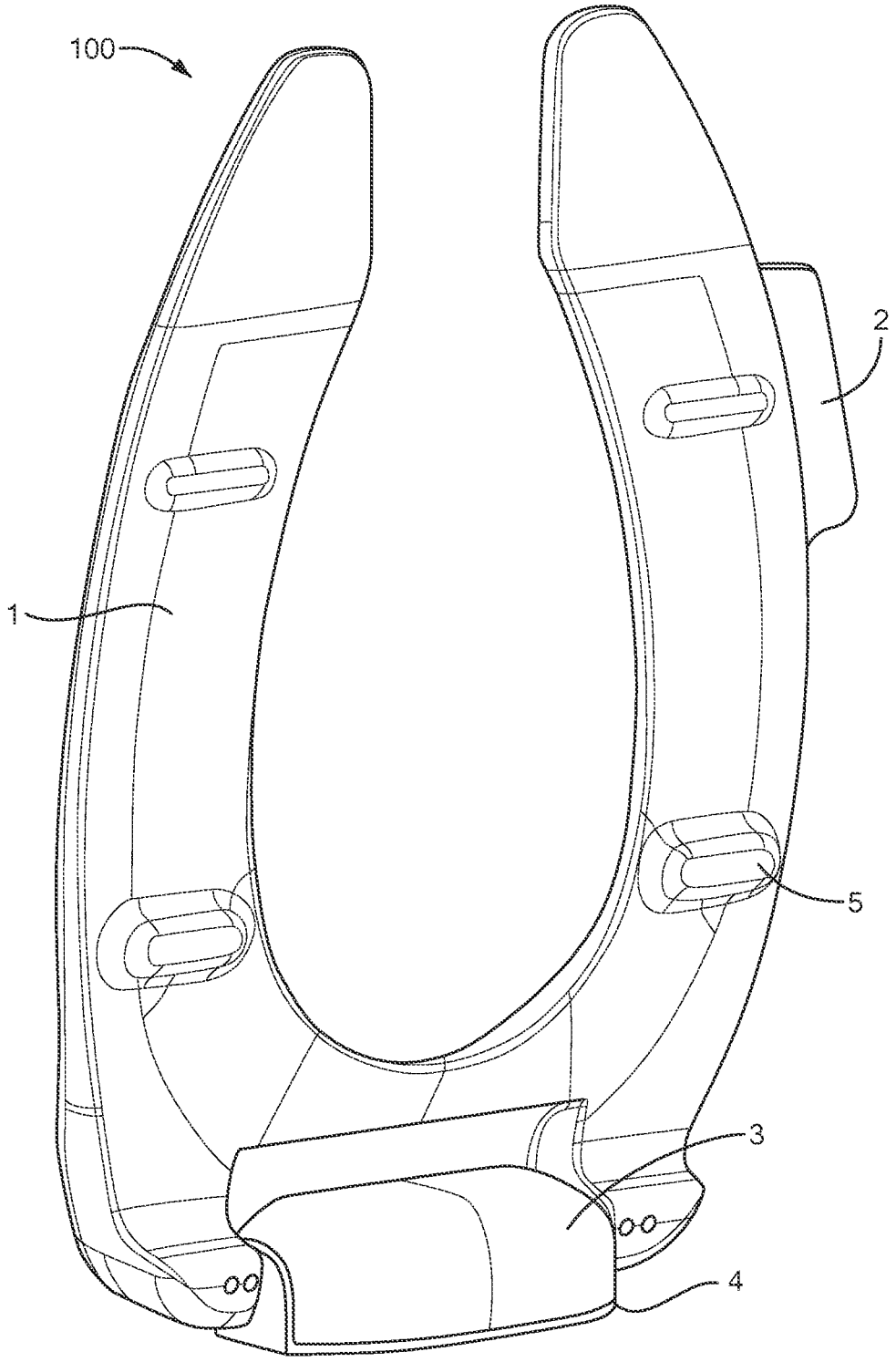
Figure 3C:
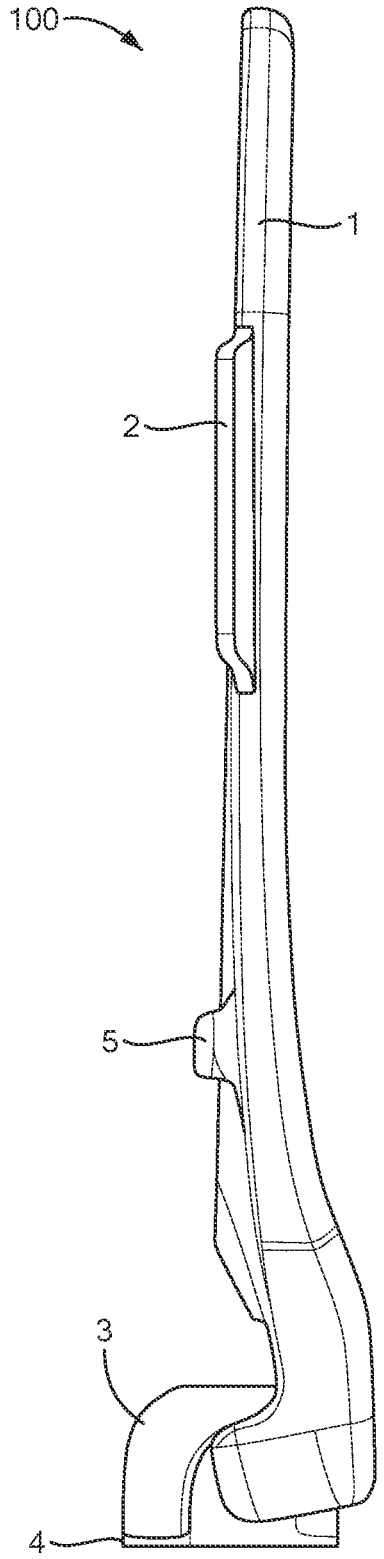

FIGS. 3A-3C schematically show the self-lifting toilet seat system 100 in accordance with illustrative embodiments. In particular, FIG. 3A shows a rear view of the toilet seat 1 in the up position. FIG. 3B shows a front perspective view of the toilet seat 1 in the up position. FIG. 3C shows a side view of the toilet seat 1 in the up position.

The toilet seat 1 has a contact surface 51 upon which a user sits when the seat 1 is in the down position. On the other side are one or more nubs 5 configured to contact the toilet bowl 44. The nubs 5 may be formed of a durable material, either as one piece with the toilet seat 1 or as separate parts later as attached. The nubs are sandwiched between the weight of the user on the toilet seat 1 and the toilet bowl 46. Optionally, the toilet seat 1 may include a handle 2 to assist the user with lifting and/or lowering the seat 1. The hinge 46 couples the toilet seat 1 with the toilet bowl 44 (not shown in FIGS. 3A-3C).

In various embodiments, the hinge 46 includes a substantially dust-proof and/or sealed hinge housing 3 and housing base 4, which couples with the toilet bowl 44. The connection between the hinge housing 3 and housing base 4 is sealed such that ingress of liquids and dust is prevented during normal usage and maintenance of the seat 1. Though considered substantially sealed, various embodiments may allow for a small leak of air such that the air pressure in the hinge 46 may equalize to ambient conditions. Additionally, the rotary seal 17 also allows for such a seal between hinge housing 3, housing base 4, and the rotating axle 7.

Figure 4A:
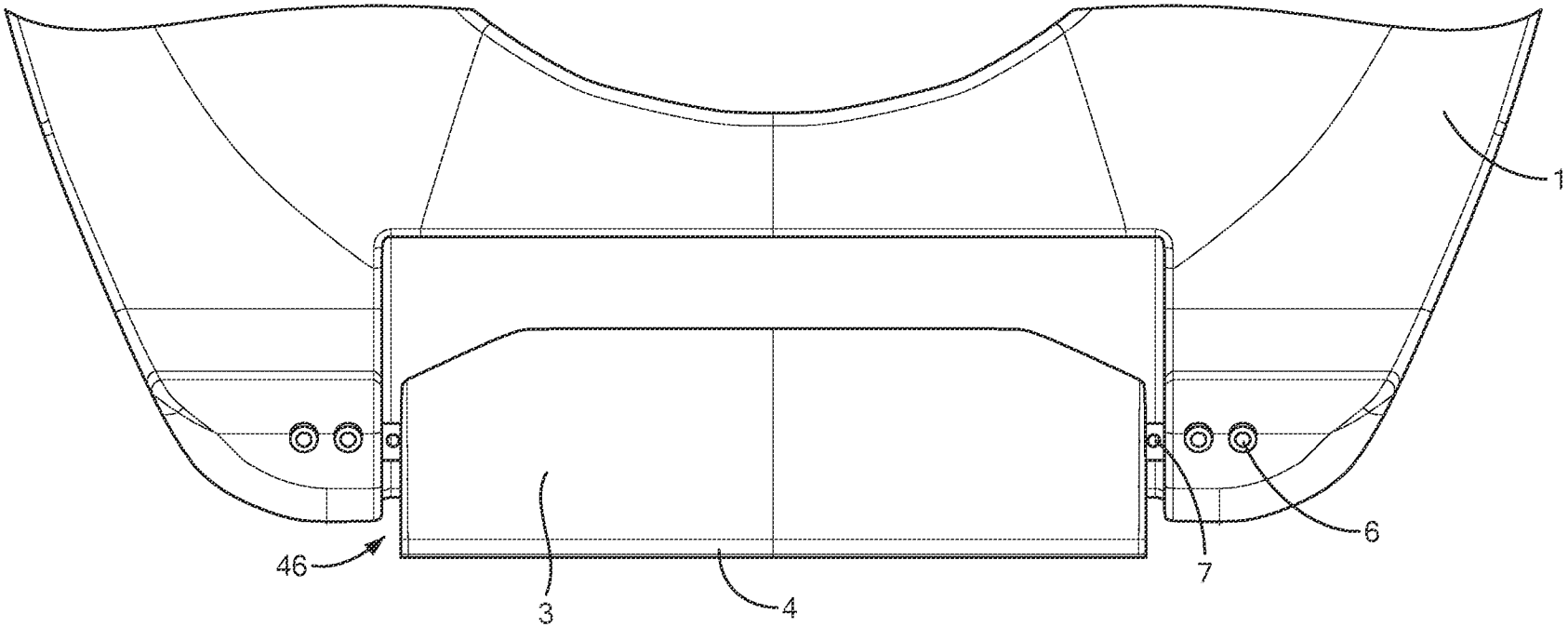
FIG. 4A schematically shows a close-up view of the portion of the toilet seat adjacent to the hinge housing in accordance with illustrative embodiments of the invention.
Figure 4B:
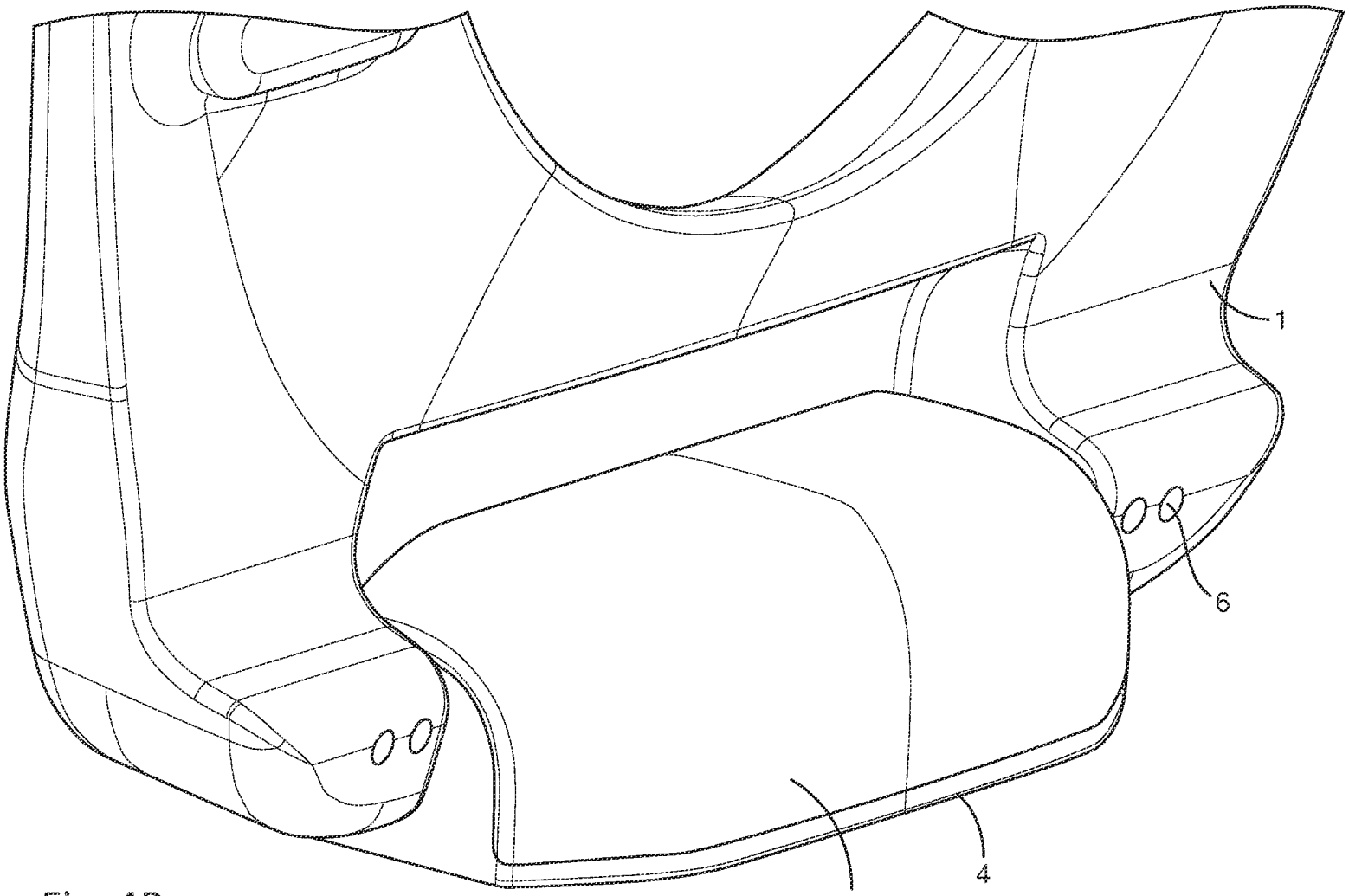
FIG. 4B schematically shows a perspective view of FIG. 4A.

FIGS. 4A and 4B schematically show a close-up view of the portion of the toilet seat adjacent to the hinge housing 3 in accordance with illustrative embodiments of the invention. The hinge 46 has a housing base 4 that is configured to couple with the bowl 44, and an axle 7 that rotatably couples with the seat 1. To that end, the housing base 4 may be bolted or otherwise fixed to the bowl 44. Additionally, the axle 7 may include one or more coupling portions (e.g., a bolt hole, D-shaft, etc.) that is configured to align with and couple with a seat coupling portion 6 (e.g., a corresponding bolt hole, a corresponding female D-shaft profile, etc.). The seat 1 is thus rotatably coupled with the hinge 46, and may rotate relative to bowl 44.

The self-lifting toilet seat system 100 includes a lifting system 52 configured to self-lift the seat 1 towards the up position 48. The system 100 also includes a delay system 54 configured to delay the lifting system 52 from self-lifting the toilet seat 1 to the up position 48. Preferably, the delay system 54 and/or the lifting system 52 are positioned within the sealed hinge housing 3 and housing base 4. For example, this prevents or reduces the amount of contamination, grime, waste (e.g., urine), and/or dust that may accumulate between the suction cup 13 and the attachment surface. This advantageously allows the delay system 54 to operate more reliably and to require reduced maintenance of components relative to an unsealed delay system 54.

Figure 5A:
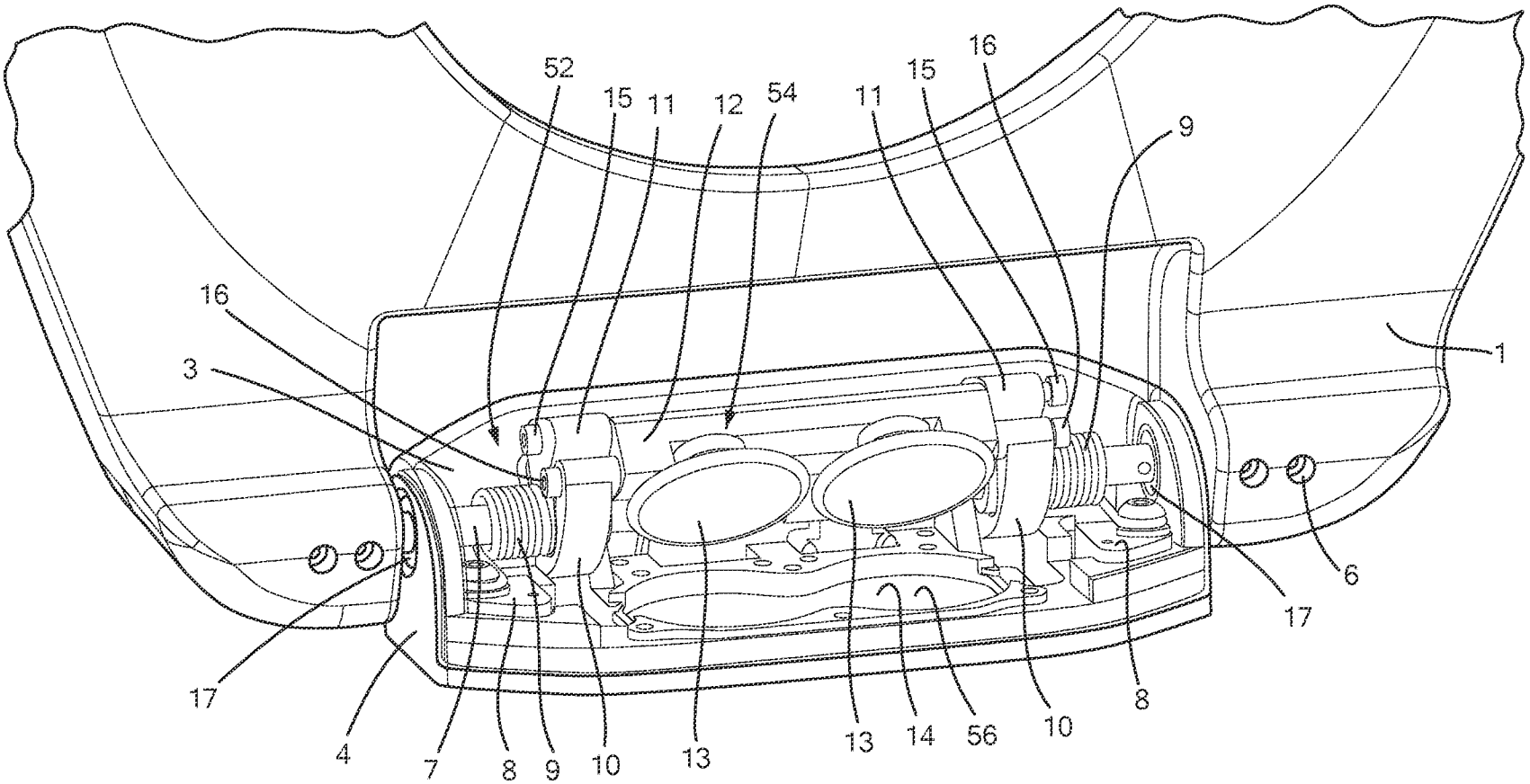
FIGS. 5A-5B schematically show the hinge of FIG. 4A.
Figure 5B:
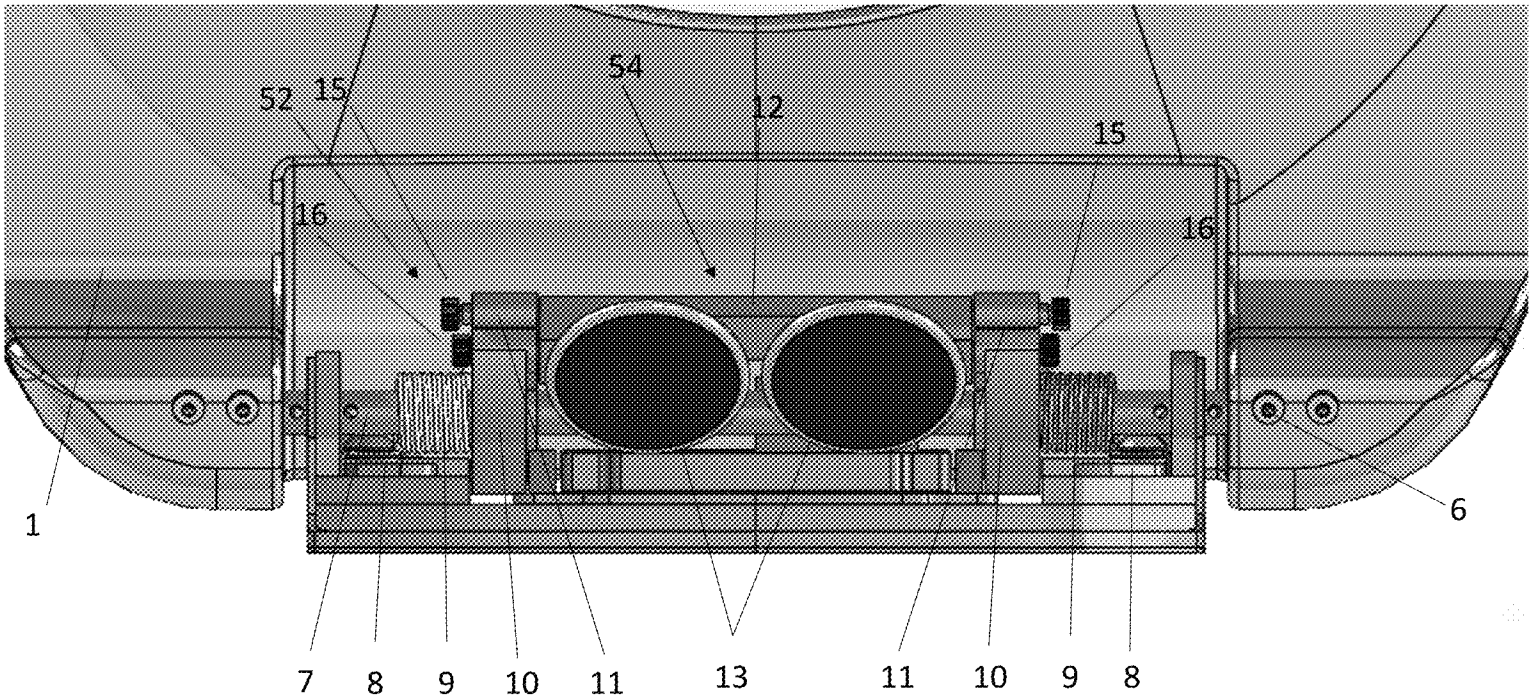

FIGS. 5A-5B schematically show the hinge 46 of FIG. 4A with a transparent housing 3. In particular, FIG. 5A schematically shows a front perspective view of the toilet seat 1 in the up position 48 (similar to FIG. 3B). FIG. 5B schematically shows a front view of the toilet seat 1 in the up position 48.

In some embodiments, the self-lifting toilet seat system 100 includes a lifting system 52 configured to self-lift the toilet seat 1 towards the up position 48. In various embodiments, the lifting system 52 may be comprised of a spring 9, such as a torsion spring 9, but may also be comprised of a linear compression or extensions spring, and/or a spiral torsion spring.

Figure 6A:
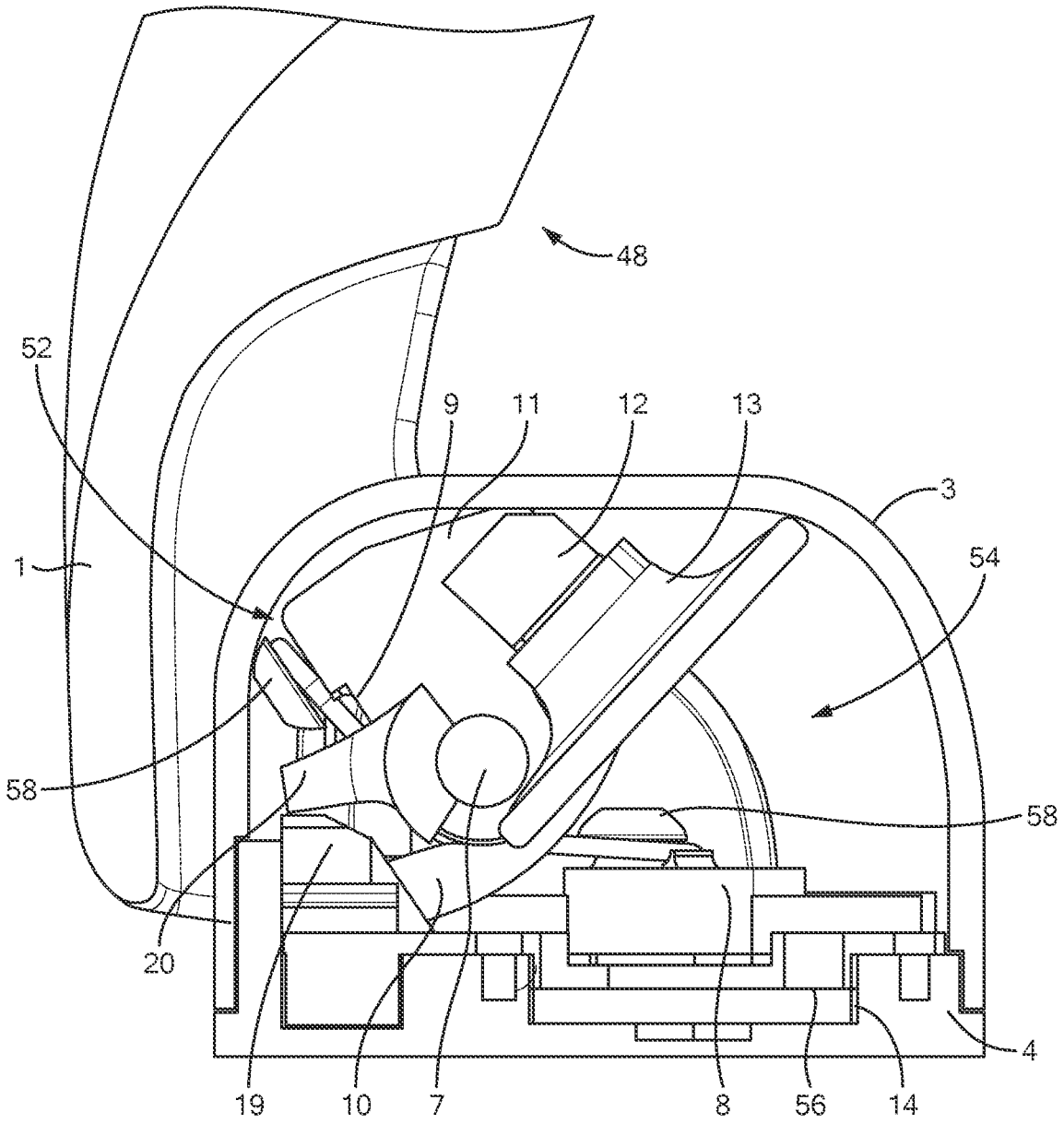
FIG. 6A schematically shows a cutaway side view of the toilet seat of FIG. 5A in the up position in accordance with illustrative embodiments.

As best seen in FIG. 6A, the torsion spring 9 of this configuration may be coupled (e.g., via a first bolt 58) to a fixed spring mount 8. On the other end, the torsion spring 9 couples with an axle link 11 (e.g., via a second bolt 58, best shown in FIG. 6A). The axle link 11 is fixed to the axle 7, and therefore, rotates with the axle 7 when the seat 1 is rotated. Thus, when the seat 1 is user-lowered, the torsion spring 9 is loaded (e.g., via the connection of the axle link 11), and begins to apply a torque in the direction of self-lifting the seat 1 back to the up position 48.

Figure 6B:
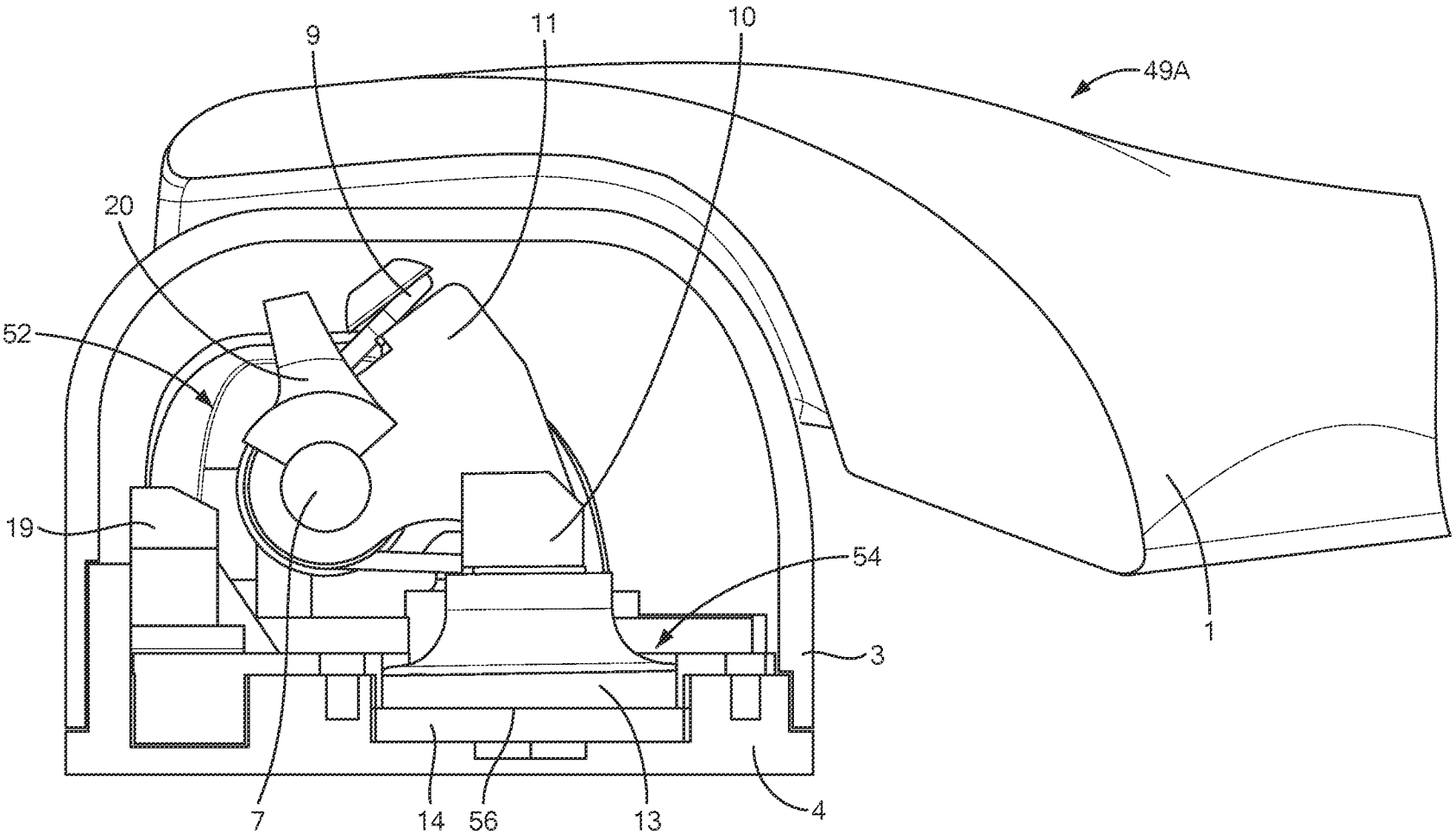
FIG. 6B schematically shows a cutaway side view of the toilet seat of FIG. 5A in the neutral state in accordance with illustrative embodiments.
Figure 6C:
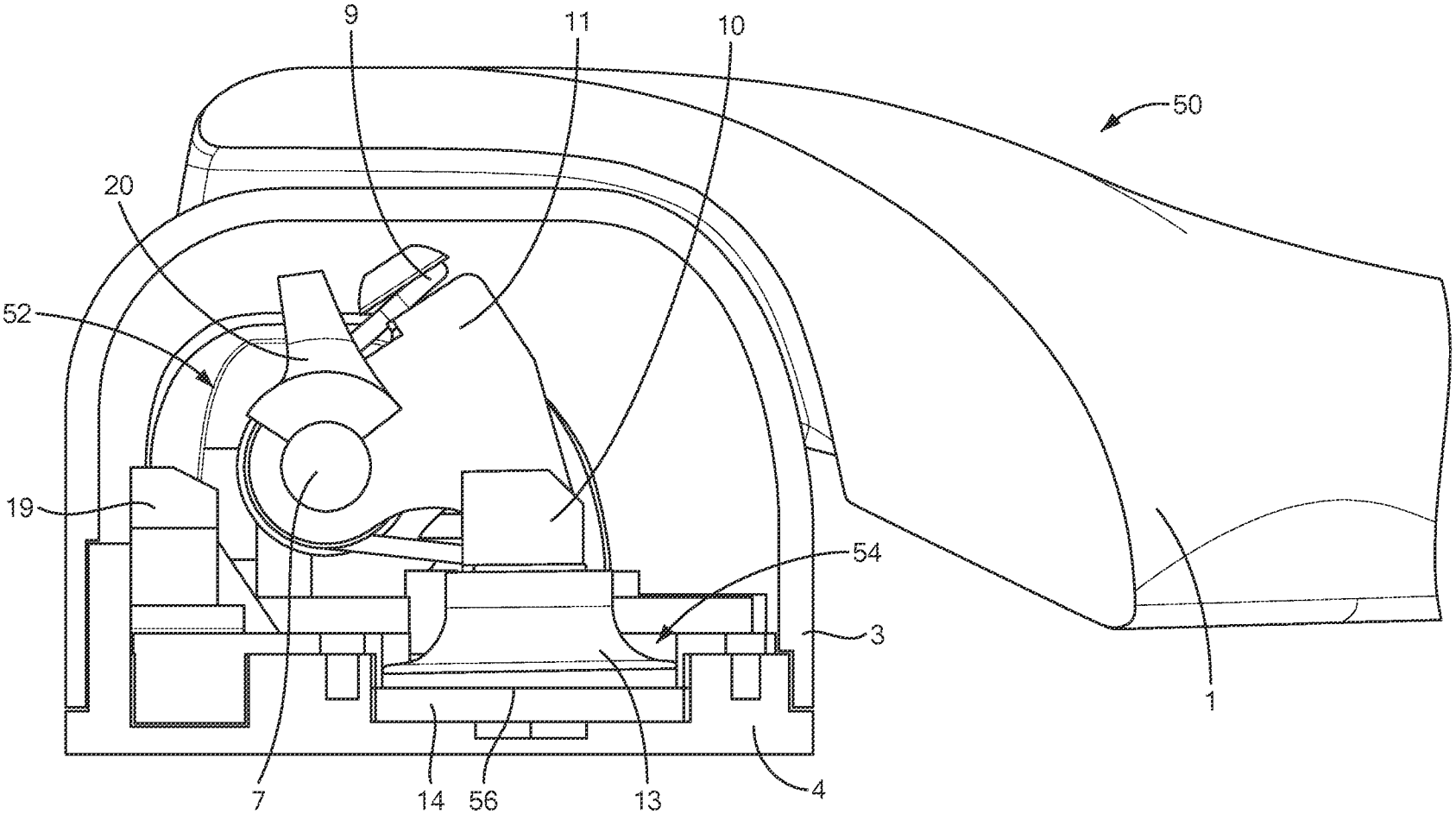
FIG. 6C schematically shows a cutaway side view of the toilet seat of FIG. 5A in the down state in accordance with illustrative embodiments.

FIGS. 6A-6C schematically show a side view of the seat 1 as it is lowered by the user. In FIG. 6A, the seat is in the up position 48. In FIG. 6B, the seat 1 is in the neutral state 49A. In FIG. 6C, the seat 1 is in the down state 50A. Although the position of the seat 1 is shown as being slightly different in the down state 50A and the neutral state 49A, it should be understood that some embodiments may have an identical position for the toilet seat 1 in the down position and the neutral position.

Figure 7A:
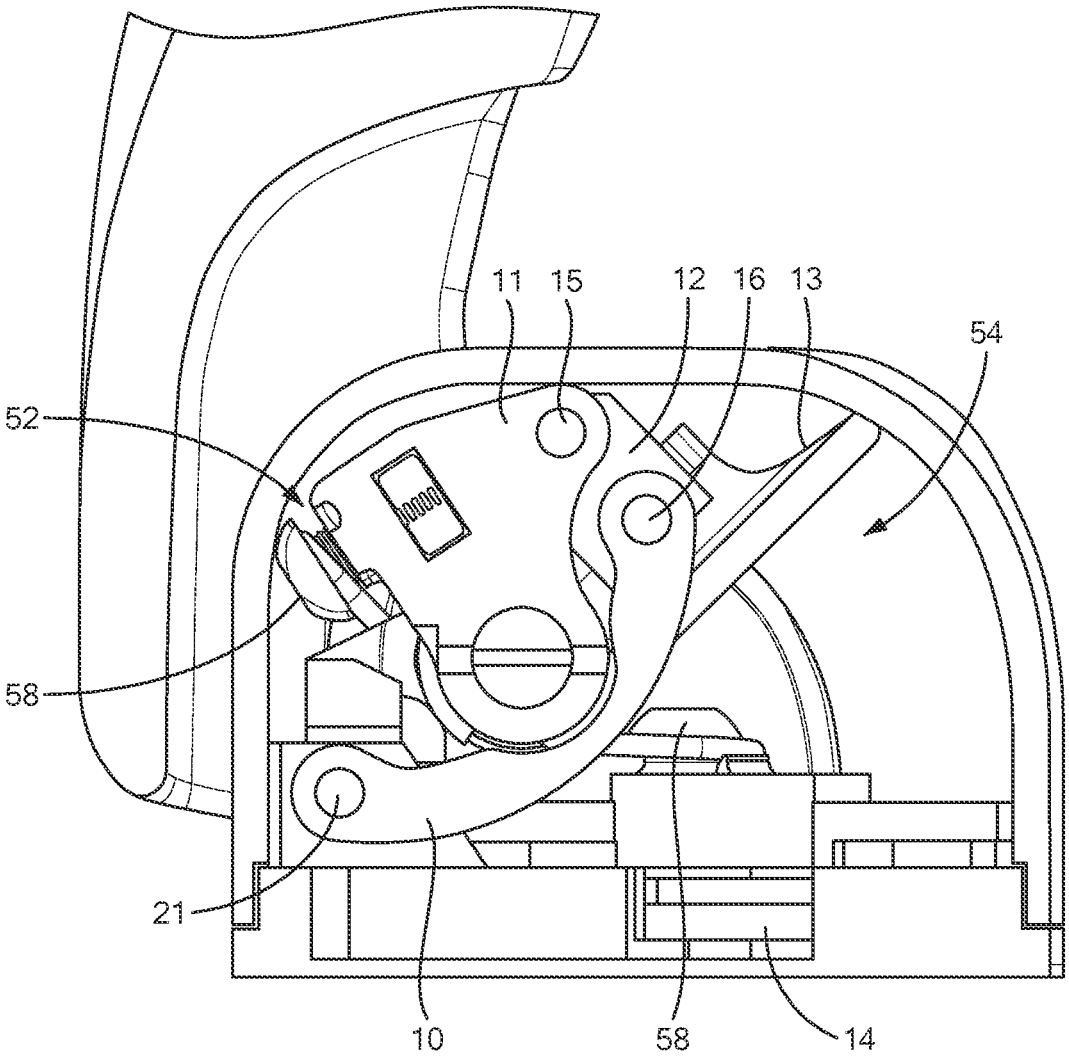
FIGS. 7A-7B schematically show a side view of the biasing system in accordance with illustrative embodiments of the invention.
Figure 7B:
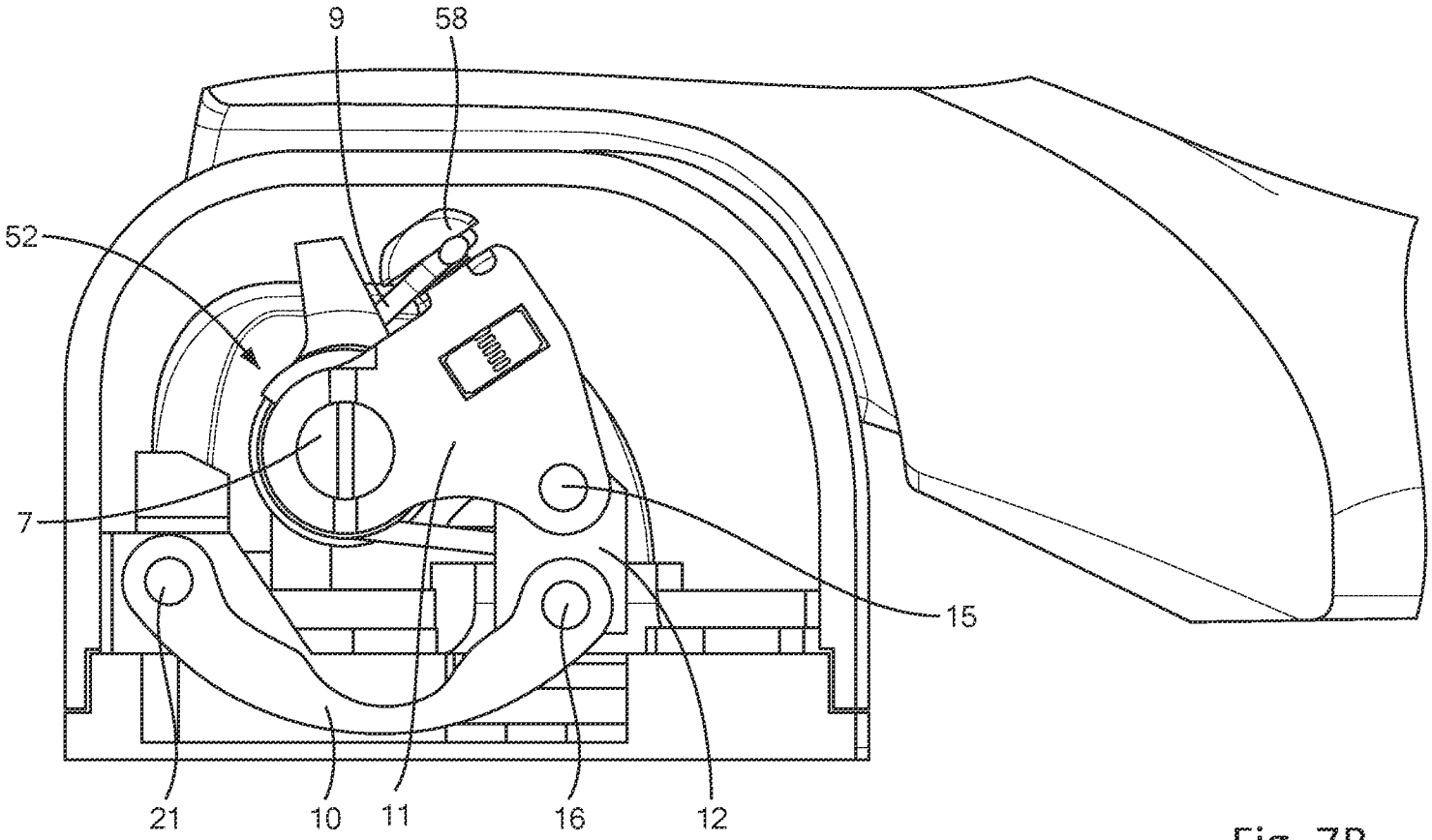

FIGS. 7A-7B schematically show a side view of the lifting system 52 in accordance with illustrative embodiments of the invention. FIG. 7A shows the lifting system 52 when the delay system 54 is not engaged (e.g., as the toilet 42 is in the up position 48). FIG. 7B shows the lifting system 52 when the delay system 54 is engaged (e.g., when the toilet seat 1 is in the down position 50).

The side view of FIG. 7A more clearly shows the axle link 11 coupled with the axle 7 as well as with one end of the spring 9. As the seat 1 is user-lowered towards the down position 50 (shown in FIG. 7B), the spring 9 is loaded and applies a counter torque back towards the direction of the unloaded, up position 48. Because the spring 9 is coupled with the axle link 11, the torque of spring 9 is applied to the axle link 11, which relays that torque to the axle 7, and thus to seat 1. Lowering the toilet seat towards the down position 50 may include lowering the toilet seat until the seat 1 reaches the down position 50.

Figure 10:
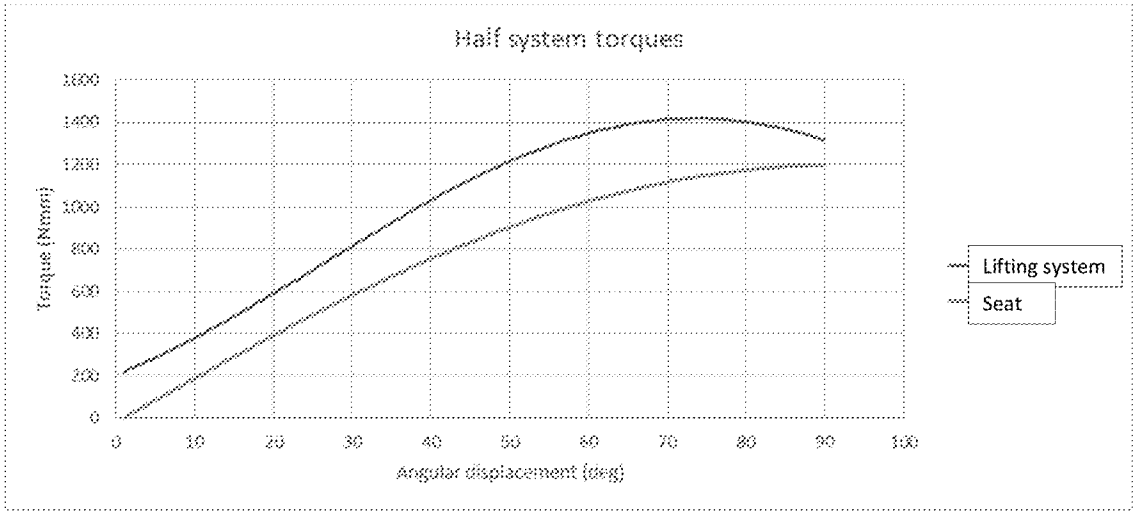
Figure 11A:
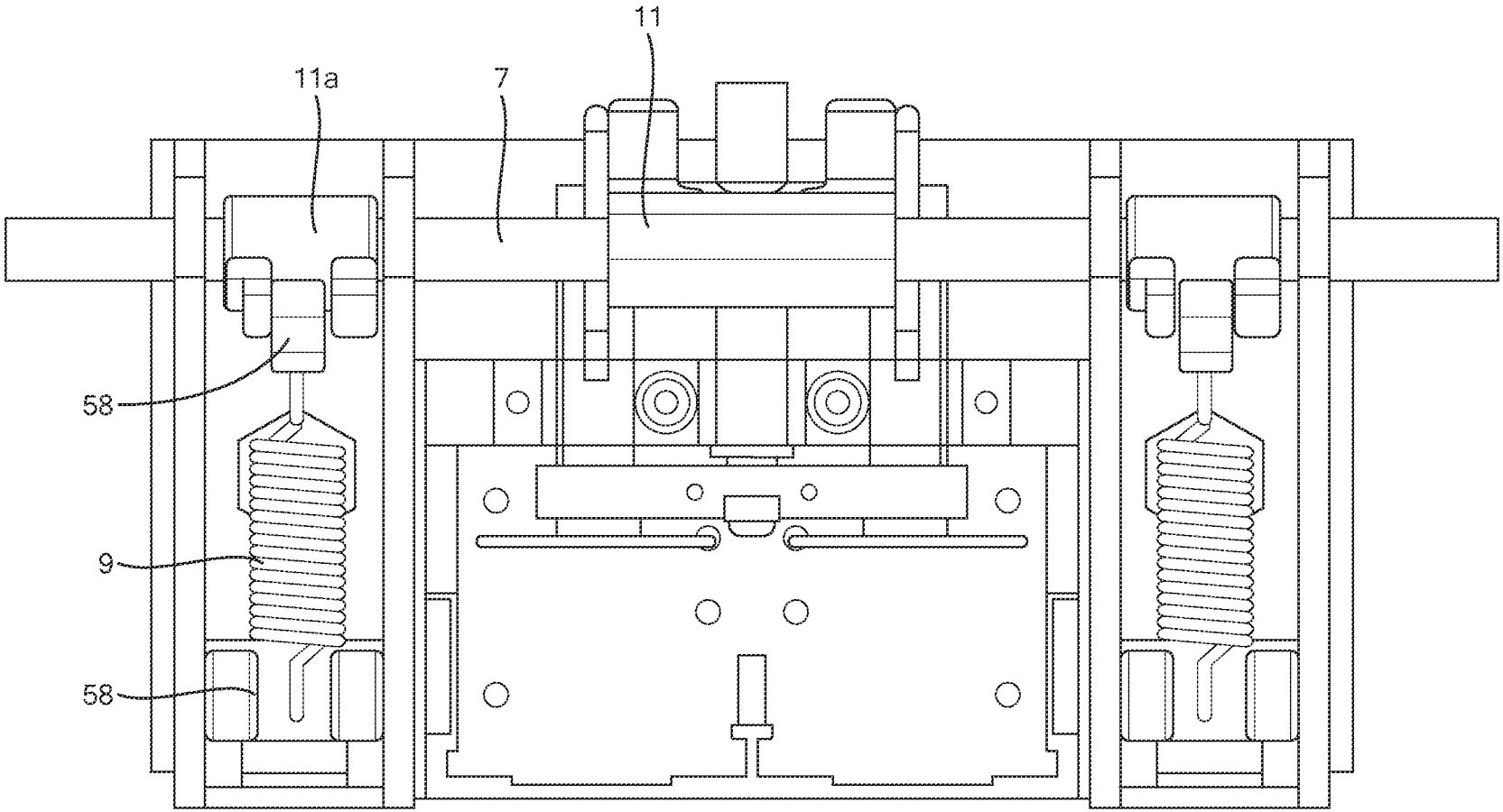
FIGS. 11B-C schematically show a perspective view of the device of FIG. 11A in the up position and down position, respectively.
FIG. 11D schematically shows a perspective view of the delay system of the device of FIG. 11A.

FIGS. 11A-11D schematically show an alternative embodiment of the lifting system 52 in accordance with illustrative embodiments. In various embodiments, the lifting system 52 may include a torsional spring 9 (shown in FIGS. 5A-5C), but in alternative embodiments, a linear spring 9 on a lever arm (as shown in FIG. 11A). FIG. 10 schematically shows the associated torque profiles for a linear spring in accordance with illustrative embodiments. For the linear spring 9 embodiment, a relatively close match of seat 1 to spring 9 torque may be created, which reduces the net torques experienced by all downstream components when the seat 1 is actuated. Additionally, spiral torsion springs, compression springs, and other types may be used as well.

FIGS. 6B and 6C schematically show a side view of the toilet seat 1 the down position 50 in accordance with illustrative embodiments. As mentioned previously, it is desirable to provide a delay in the self-lifting of the toilet seat 1. Accordingly, illustrative embodiments provide a delay system 54 configured to delay and/or slow the self-lifting of the toilet seat 1 effectuated by the lifting system 52. Preferably, the delay system 54 provides a sufficient delay to allow the user to get ready to use the toilet 40, as well as finish using the toilet 40 and to prepare themselves to exit the stall 39. In illustrative embodiments, the delay system 54 delays and/or slows the self-lifting of the toilet seat 1 to the up position 48, for between about 1 second and about 5 minutes.

When the toilet seat 1 is user-lowered to the down state 50A (e.g., by a user who wishes to sit on the seat 1), the motion of the seat 1 causes a corresponding motion that engages the delay system 54 (e.g., within the housing 3 and housing base 4). For example, as shown in FIGS. 6B and 6C, the delay system 54 is configured such that the suction cup 13 couples to the attachment surface 56 when the toilet seat 1 approaches or reaches the down position 50.

In illustrative embodiments, when the seat approaches the down position 50, the cups 13 come in contact with the attachment surface 56. As the seat 1 comes to the down state 50A, the suction cups 13 compress onto the surface 56 and expel the majority of the fluid (for example, air or oil) between the cups 13 and the surface 56. This creates a pressure imbalance such that when the seat 1 experiences a torque from the lifting system 52 towards the up position 48, the cups 13 are able to use that pressure imbalance to "stick" to the surface and delay the self-lifting of the seat 1.

The delay of the self-lifting of the seat 1 by the delay system 54 is created by integrating a controlled leakage channel 18 (discussed in further detail below) into cup 13 or plate 14 to allow for a slow leak of fluid back into the cup 13. Due to the force separating the cup 13 and plate 14 that is translated from the lifting system 52 to the delay system 54 through the linkage components 10,11, and 12, (as well as the elastomeric memory of the suction cup) fluid is forced to leak into the cup 13. Once enough fluid has entered so as to substantially equalize the internal and external cup 13 pressures, the cup 13 and the plate 14 are easily separable. Carefully controlling this flow back into the cup 13 allows for an adjustable delay system 54 to be created such that when enough fluid has re-entered the cup 13 to equalize the pressure, the cup 13 no longer has any holding power and the springs 9 simply self-lift the seat 1 back into the up position 48. When this happens, the cups 13 are driven back to their starting position through the linkage. Thus, the cups 13 coupled with plate 14 act as a delay system 54, and the toilet seat 1 does not immediately self-lift after a user removes their lowering force, giving the user time to sit down or rise up before the delay expires.

Advantageously, the pressure differential-based force that holds the cup 13 down to plate 14 allows for a user to self-lift the seat 1 to the up position 48 at any time during the duration of the delay system 54. If the force that is translated to the delay system 54 by the user's exerted force on the seat 1 is larger than the holding force of cup 13 onto plate 14, then the delay system 54 will disengage and allow the user to self-lift the seat to the up position. Thus, the user is able to overcome the holding force of the cup 13 on the plate 14 with relative ease because of the significantly longer lever arm that the user has at the tip of the seat 1, compared to the relatively short lever arm of the cup 13 inside the hinge 46. Additionally, the elasticity of the cup 13 means that the cup 13 is able to easily disengage from plate 14 under the relatively low lifting force from the user, thereby not causing any injury to the user, or damage to the seat and internal linkage components (discussed below).

The suction cup 13 may be mounted relative to the axle 7 such that rotary motion from the toilet seat 1 is relayed through the axle 7 to the suction cup 13. Although the suction cup 13 is shown as engaging the plate 14 when the toilet seat 1 is near the down position 50, it should be understood that the position and/or dimensions of the plate 14, as well as the internal linkages (e.g., 10, 11, 12), position, and size of the suction cup 13 may be tuned to engage at any point along the transition of the seat 1 from the up position 48 to the down position 50.

In the current embodiment, the axle link 11 may be coupled to an interlink 12 (e.g., through rotary link 15) that is fixed to the delay system 54 (e.g., suction cup 13 and plate 14), as discussed further below. Thus, movement of the toilet seat 1 may be relayed through the axle 7 and various links (e.g., 10, 11, 12, etc.) to the delay system 54. In some embodiments, a second link 10 is coupled to the interlink 12 (e.g., through rotary link 16) to maintain a desirable orientation of the delay system 54.

Furthermore, some embodiments may include a linkage (e.g., 10, 11, 12) to transfer the rotational motion of the seat 1 to the suction cup 13, as a suction cup may function most effectively when it is travels linearly and is applied normally to a contact surface, such as the surface 56 of timing plate 14. The linkage may be comprised of a driving link 11 (also referred to as the axle link) and a secondary link 10 rotatably affixed to pivot point 21. These two links may be rotatably affixed to another intermediate link 12 via rotatable connection points 15 and 16, thus forming a four-bar linkage. Such a configuration is advantageous as the suction cup 13 may be fixed to the intermediate link 12 so as to achieve a substantially linear motion of the suction cup 13 as the seat 1 moves into the down position 50 and contacts the timing plate 14, but rotation of the cup 13 when the seat 1 is in any other position. This allows for a compact design of case 3 and a robust, low-friction coupling between the suction cup 13 and plate 14.

Figure 11B:
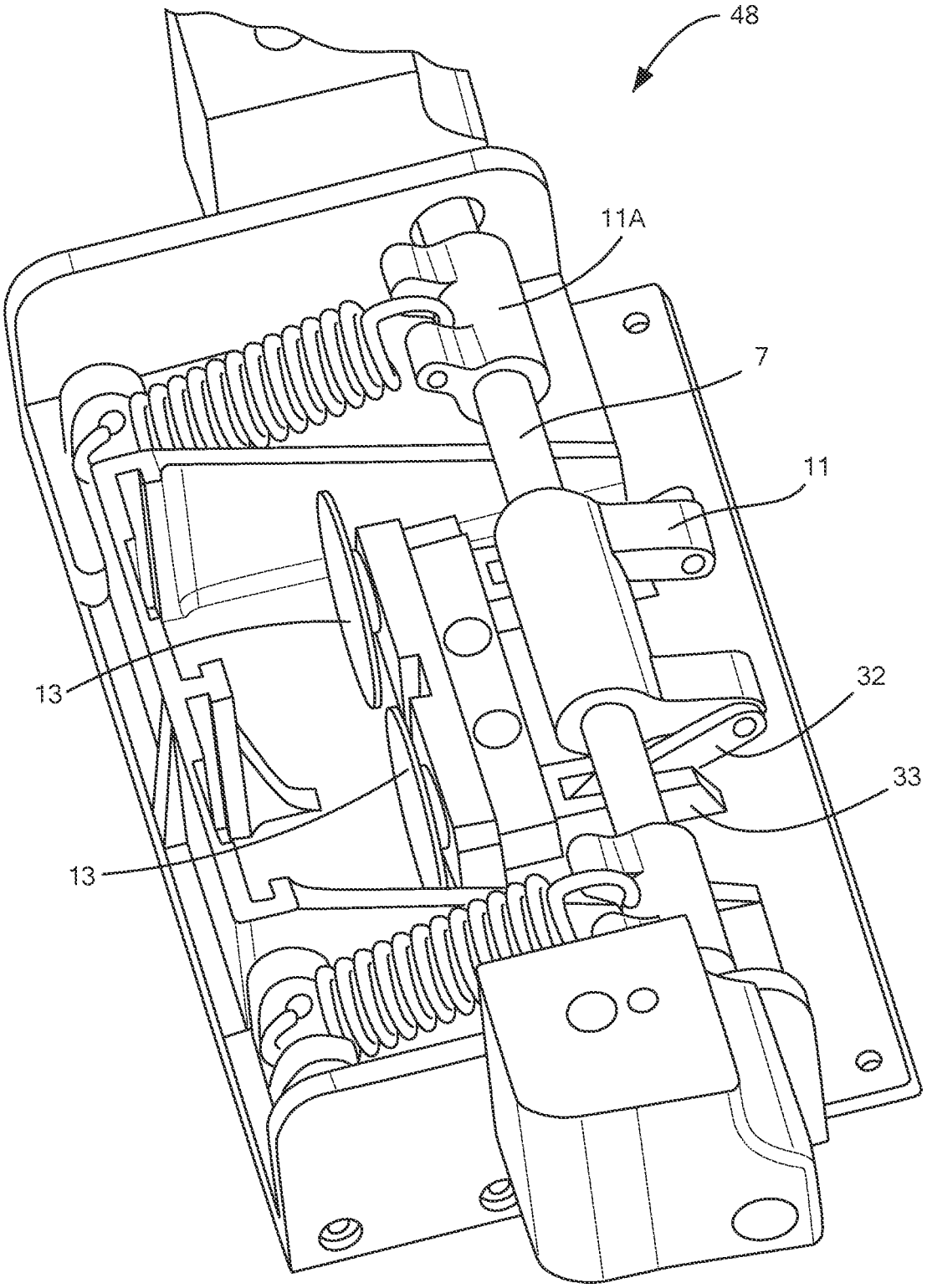
Figure 11C:
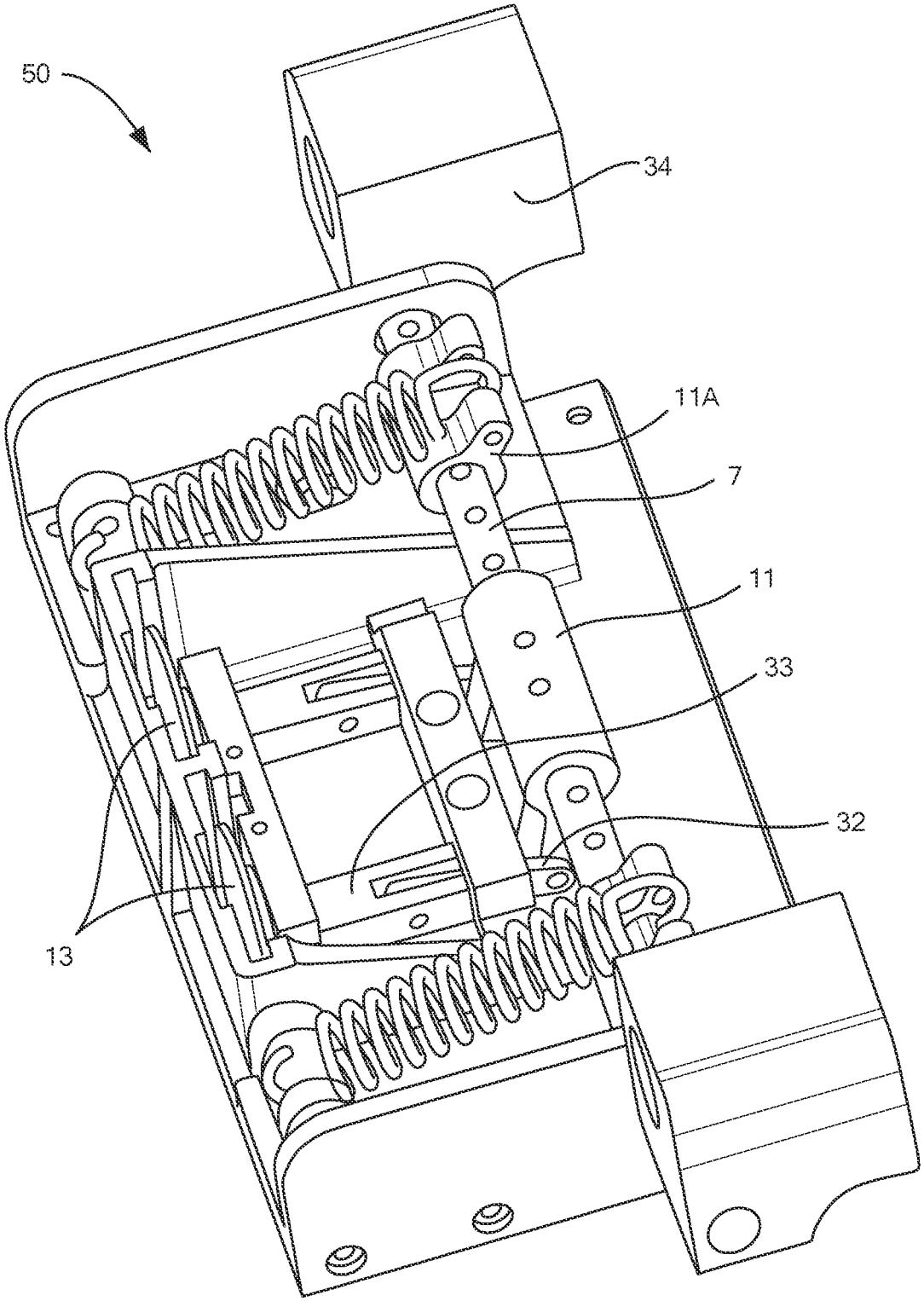

In alternative embodiments, the seat 1 remains fixed to the rotating axle 7 shaft at the housing base of the seat 1. As seen in FIG. 11A, the axle 7 translates the rotary motion of the seat 1 to axle link 11 that is rotatably fixed to the axle 7. As seen in FIGS. 11B and 11C, the axle link 11 in turn drives the link 32, which in turn drives link 33, onto which the delay system 54 is mounted. Link 33 is constrained to travel linearly, and thus, in some embodiments, the linkage shown in FIGS. 11A-11C convert the rotational motion of the seat 1 into linear motion (e.g., similar to linear piston actuation). This method is advantageously suitable for delay system 54 integration with viscous fluid.

Figure 11D:
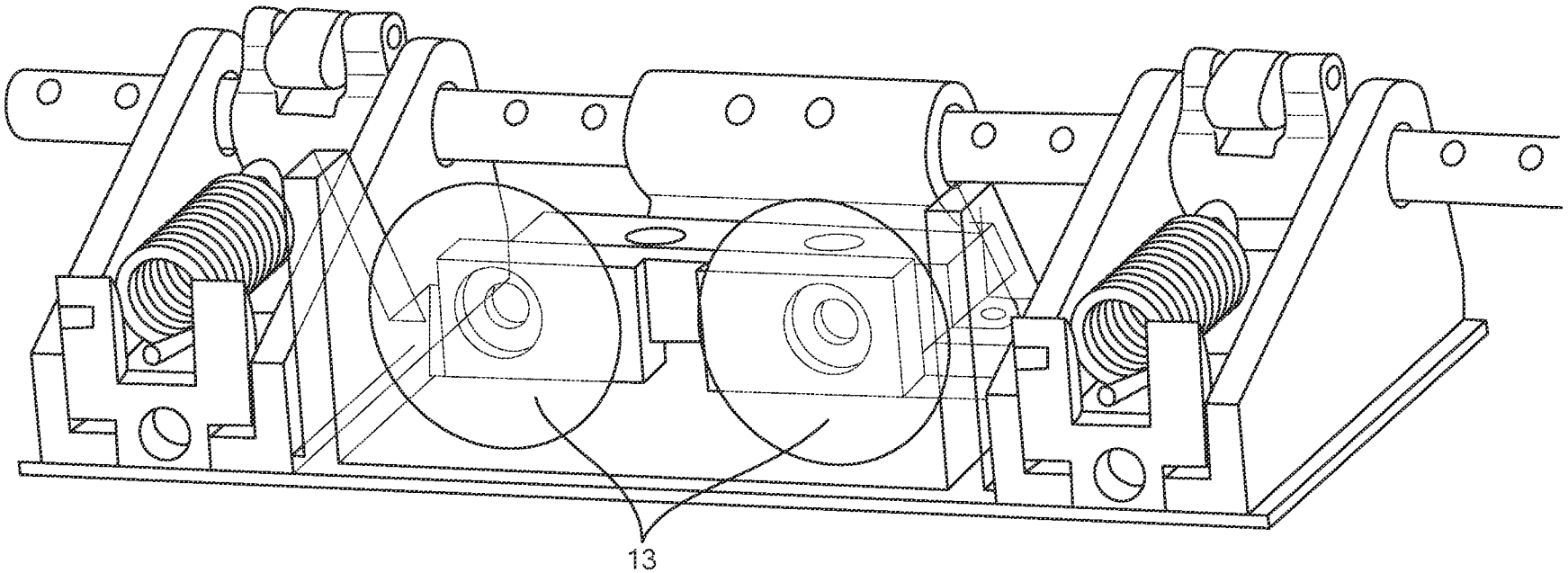

FIGS. 11B-11C schematically show a perspective view of the device of FIG. 11A. FIG. 11D schematically shows a rear perspective view of the device of FIG. 11A. In FIG. 11B, the delay system 54 is disengaged. In FIG. 11C, the delay system 54 is engaged. When the seat 1 is lowered, the axle link 11, via pinned links 32 and 33, moves the cups 13 through a fluid medium relatively unimpeded, until the seat 1 approaches the down position 50.

Figure 12A:
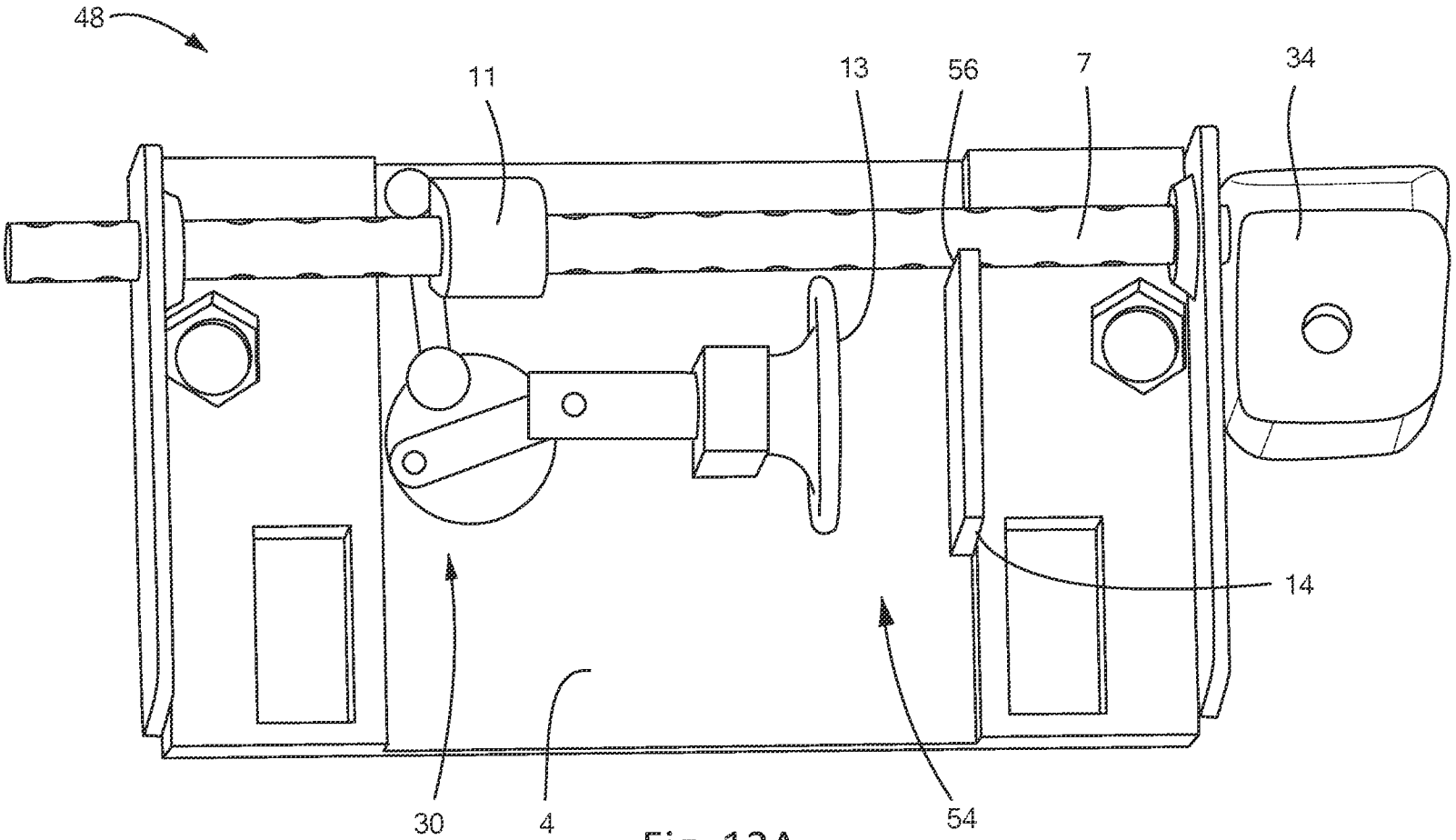
FIGS. 12A-12B schematically show an alternative embodiment of the delay system in the up position and down position, respectively.
Figure 12B:
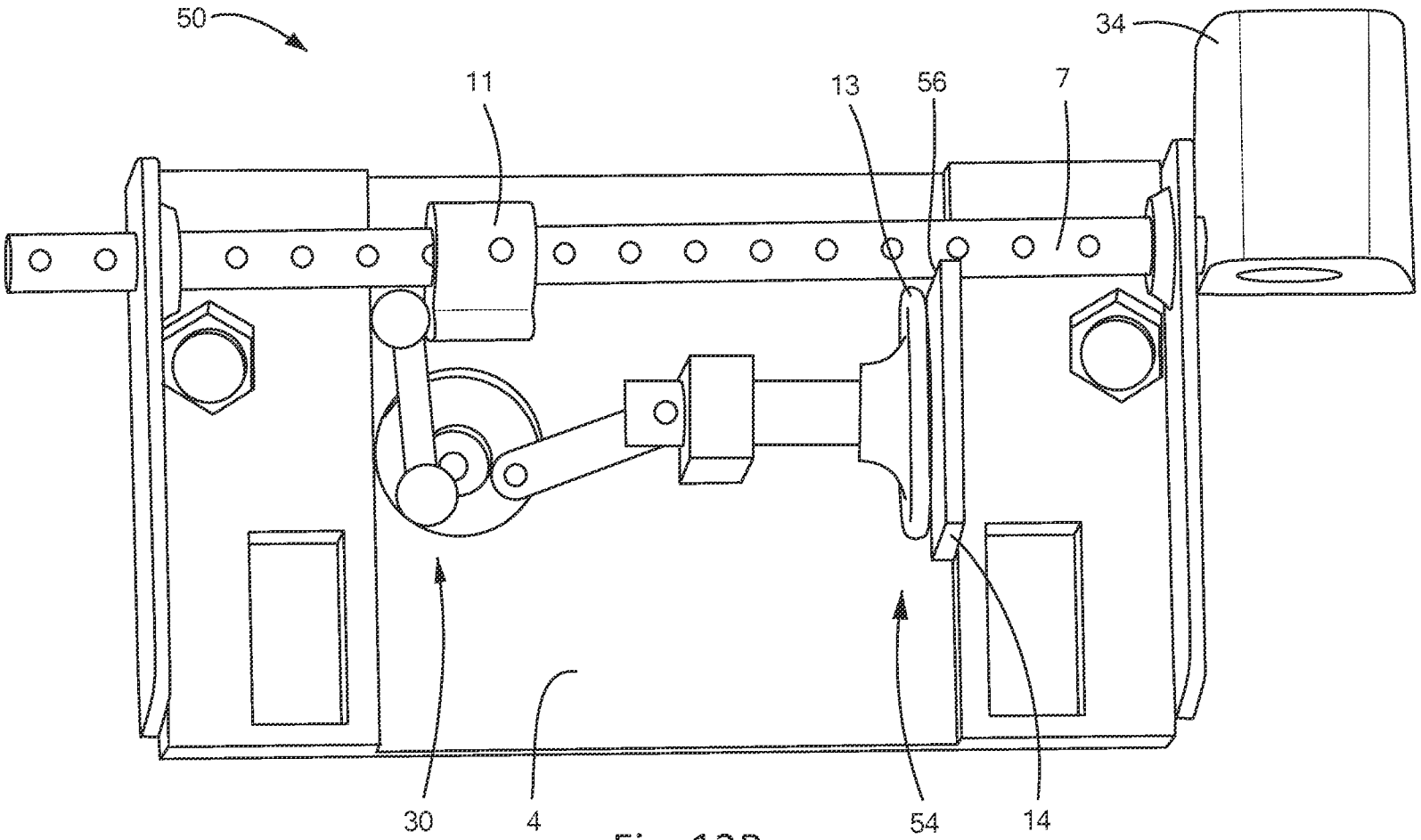
Figure 13:
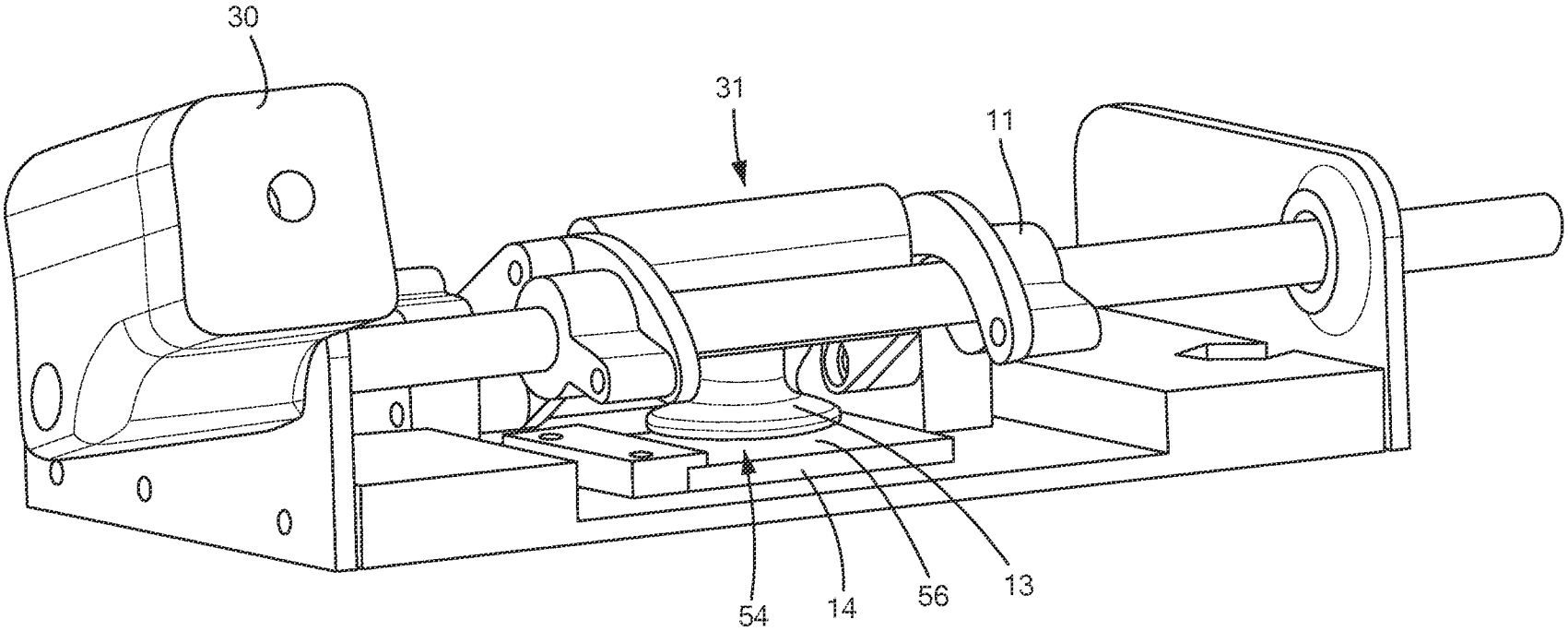
FIG. 13 schematically shows an alternative embodiment of the delay system in accordance with illustrative embodiments.

Other linkages, such as a plane change linkage 30 as shown in FIGS. 12A and 12B, a six-bar linkage 31 as shown in FIG. 13, and others such as a barrel cam linkage, rack and pinion style linkage, etc. are other embodiments of this motion translation system which allow for linear, or substantially linear motion of the suction cup as the cup 13 approaches and contacts the plate 14. In some other embodiments, there is a direct linkage between the seat 1 and delay system 54, wherein the suction cup 13 is affixed directly to the axle link 11. Accordingly, the delay system 54 may have a non-normal pull off force due to the rotation of the seat 1, and therefore cup 13. Though this may advantageously simplify the linkage, a taller housing is undesirably required to accommodate the end effector 13 of the delay system 54 rotating a full 90 degrees or more with the seat. Undesirably, the non-normal force may also distort the shape of the suction cup, causing an unpredictable/inconsistent timing delay.

In various embodiments, the delay system 54 may include one or more suction cups 13 configured to couple with a timing plate 14 having a contact surface 56. In various embodiments, the shape, hardness, and/or positioning of the suction cup 13 is configured in conjunction with the size and placement of the fluid leakage channels 18 to provide the desired time delay. Specifically, when the suction cup 13 disengages from the contact surface 56, the seat 1 begins to self-lift due to the torque from the lifting system 52. Preferably, both the contact surface 56 and the suction cup 13 are kept clean of surface contaminants to allow for consistency in the time delay. For example, getting waste and/or dust on either the contact surface 56 or the suction cup 13 cause an unreliable and/or premature time delay. Thus, various embodiments seal the contact surface 56 and/or the suction cup 13 within a dust-proof housing 3 via rotary seals 17.

However, as discussed further below, the suction cup 13 and/or the timing plate 14 may include one or more controlled leakage channels 18. In some embodiments, the controlled leakage channel 18 may be integrated into the suction cup 13 by using a material with a known and appropriate bulk porosity. In the same manner, the timing plate 14 can itself function as the controlled leakage channel 18 when the material used for the plate 14 has an appropriate bulk porosity. The controlled leakage channels 18 may also be covered by an additional filter or other flow reduction device, should the controlled leakage channels themselves be insufficient in achieving the desired time delay. In other embodiments, as shown in FIG. 9B, a carefully configured groove 57 may be installed onto the plate 14, such that when the suction cup 13 is in contact with the plate 14, the groove 57 spans the distance between the inside and outside of the cup, allowing a controlled amount of fluid to flow into the cup and function as the controlled leakage channel 18. Such a configuration is advantageously simple from a mass manufacturing perspective as the plate 14 may be integrated directly into the housing base 4. In further embodiments, the plate 14 or cup 13 may be coated with an adhesive substance, such that when the suction cup 13 contacts the plate 14, it adheres to it using temporary adhesive forces. In such an embodiment, the cup 13 may consist of a rigid material.

Figure 9A:
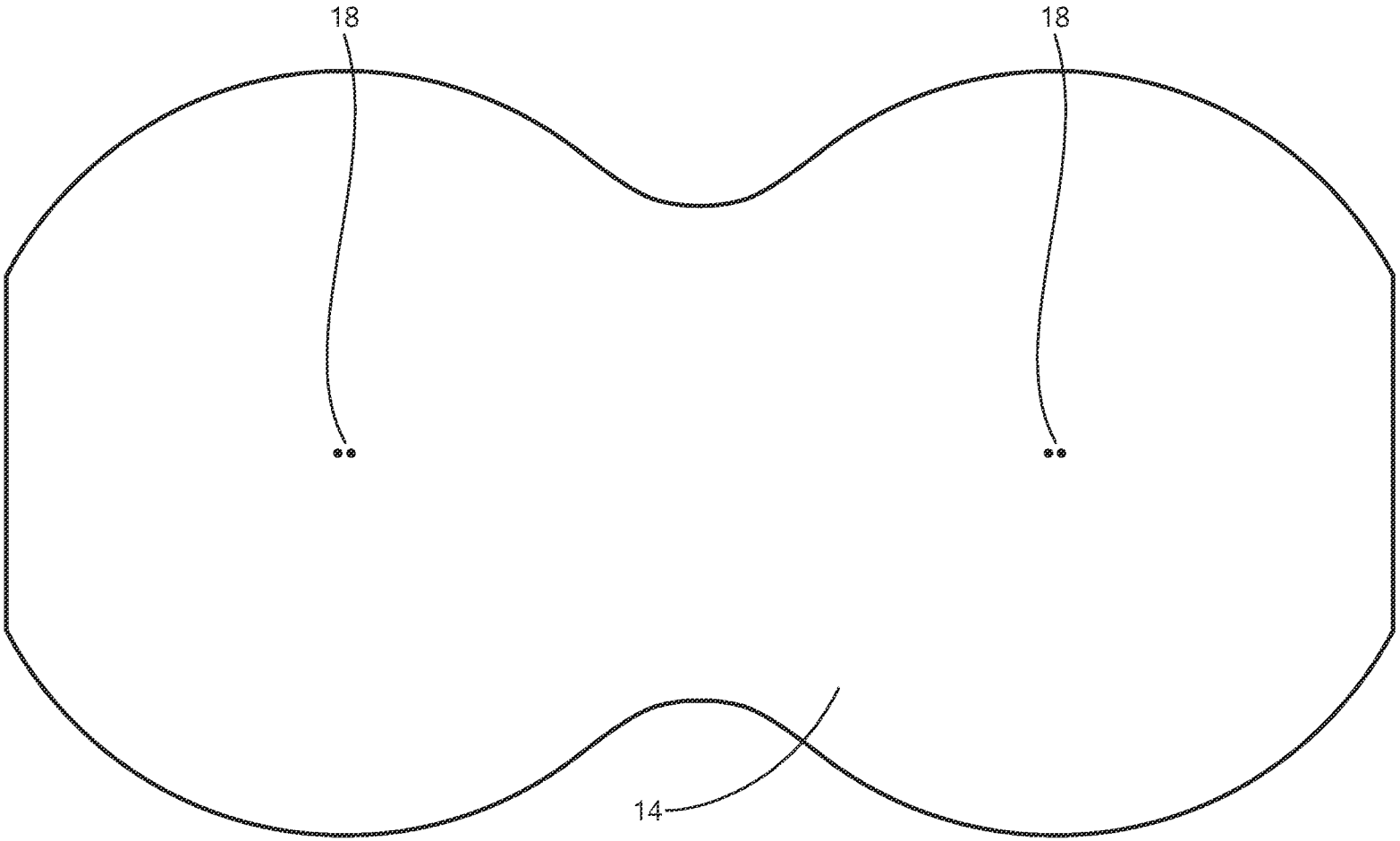
FIG. 9A schematically shows an embodiment of the timing plate in accordance with illustrative embodiments.

FIG. 9A schematically shows the timing plate 14 in accordance with illustrative embodiments. In some embodiments, the timing plate 14 has a smooth surface 56 to ensure a strong seal between the cup 13 and the surface 56. Various embodiments may form the plate 14 or the surface 56 from, for example, a smooth, glossy plastic. Some other embodiments may form the plate 14 or the surface 56 from an acrylic, HDPE, Teflon, glass and/or or polished metal.

As mentioned previously, the timing plate 14 may include one or more controlled leakage channels 18. The controlled leakage channels 18 may be one or more small holes/vias in the plate 14 that are configured to allow a slow and controlled flow of fluid (e.g., air, viscous oil) between the cup 13 and the plate 14 when cup 13 is engaged with plate 14. Placing these controlled leakage channels 18 in the plate 14 such that they align with the center of the cup 13 allows for fluid to be constantly drawn back into the cup 13 as the linkage pulls on the cup 13 via the lifting springs 9. Preferably, various embodiments use several holes of diameter 0.1 mm-0.5 mm to achieve a preferred timing range of 5-45s, however some embodiments may have larger holes (e.g., >0.5 mm diameter) which advantageously reduce the likelihood that the controlled leakage channels 18 are clogged by dust particles or other contaminants. Additionally, or alternatively, the controlled leakage channel 18 may include a groove 57, porous material, and/or textured material.

To assist with preventing dust particles from passing through the controlled leakage channels 18, as well as assist in reducing the fluid flow through the controlled leakage channels, some embodiments may include a filter over the controlled leakage channels 18. Examples of filter materials include Tyvek, sintered Teflon powder such as Porex, densely woven fabrics and vapor permeable air barrier tapes. The diameter of the channels 18 as well as the filter permeability strongly influence timing. While a hole/filter arrangement is advantageous for the delay system, other methods to induce a controlled flow through the controlled leakage channels for controlling the delay system 54 include a needle valve, textured surface, porous surface 56, porous suction cup 13, etc.

Figure 9C:
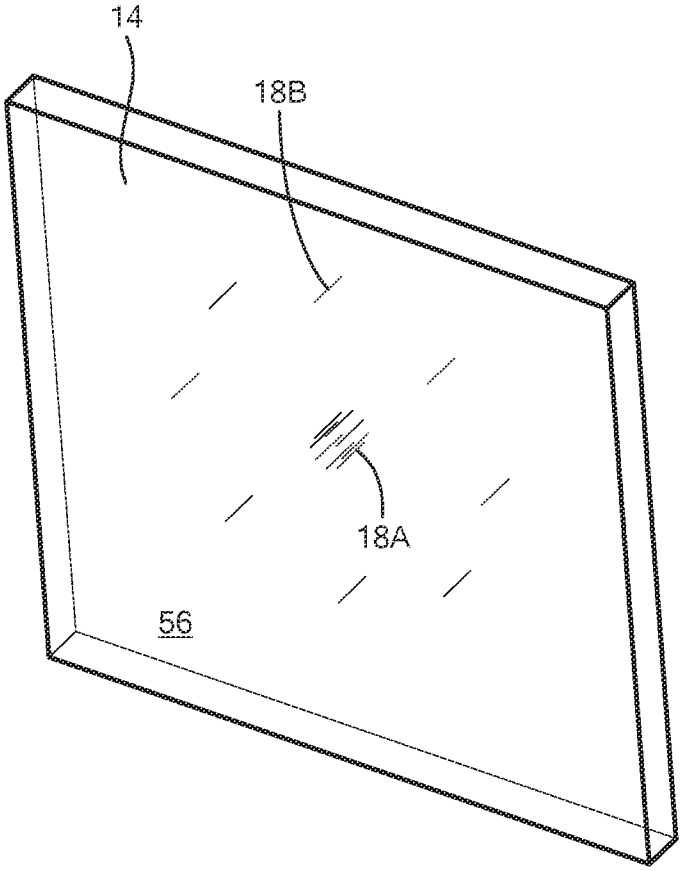
FIGS. 9B-9C schematically show alternative embodiments of the timing plate with included quick release channels FIG. 9D schematically shows an alternative embodiment of the timing plate with a groove FIG. 10 schematically shows the associated torque profiles of the system and seat in accordance with illustrative embodiments FIG. 11A schematically shows a top view of an alternative embodiment of the self-lifting and delay system in accordance with illustrative embodiments.
Figure 9B:
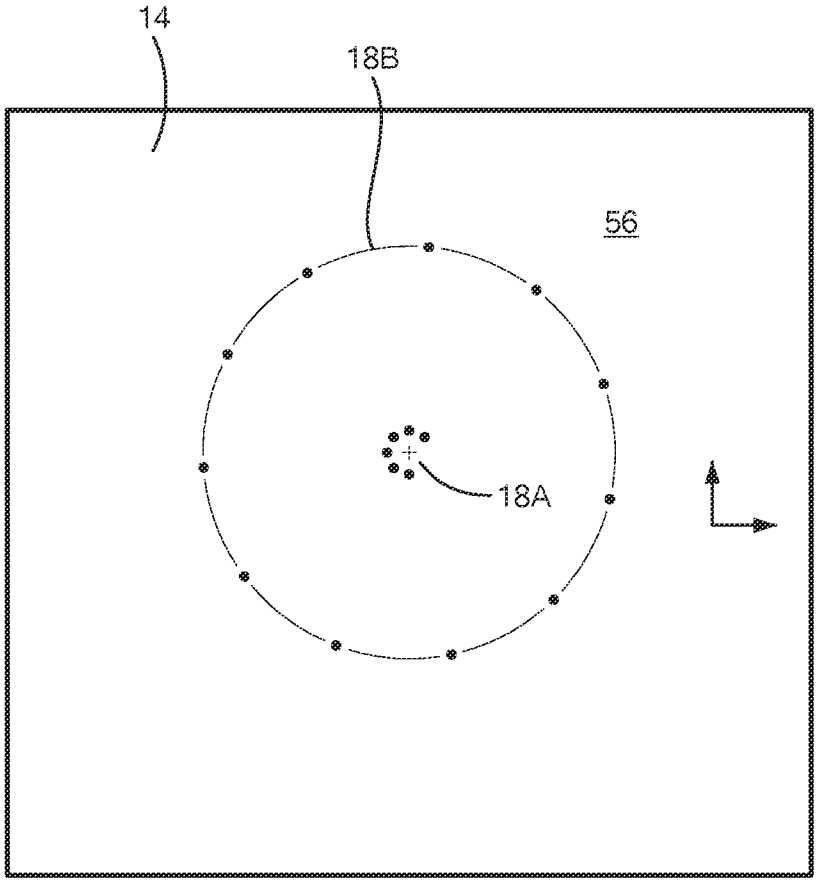
Figure 9D:
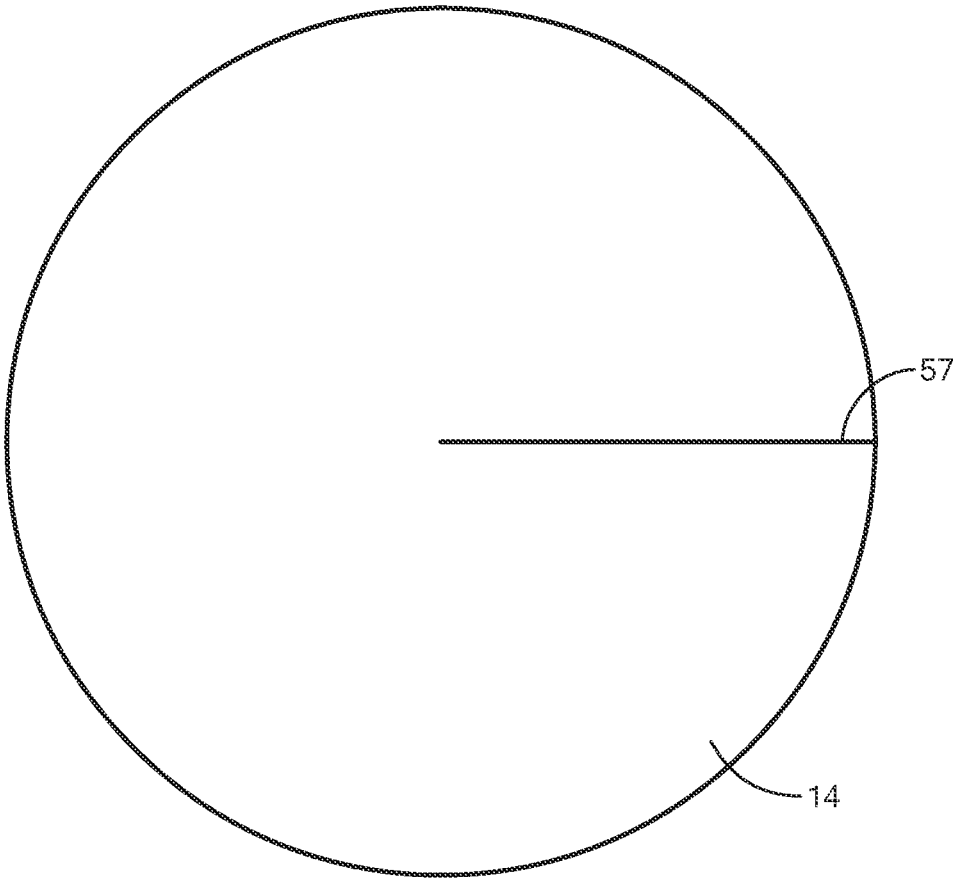

FIGS. 9B-9C schematically show another embodiment of the plate 14 in accordance with illustrative embodiments. The plate 14 may include quick release channels 18B at a designated distance from the controlled leakage channels 18A. Since the suction cups 13 stick to the plate 14 due to a pressure imbalance as well as adhesive stiction, it can be difficult to control the exact point of release of the cups 13. When the seat 1 is in the neutral state and the delay system 54 is soon to expire, the cup 13 may be tenaciously holding on to plate 14 by only its outermost rim. At this point, the release point uncertainty may be high. To avoid dealing with this uncertainty, quick release channels 18B may be added to the plate 14 at a particular radial distance away from controlled leakage channels 18A. When the cup 13 is first compressed, these holes 18B are covered by the cup 13 material and are therefore not able to transmit any fluid into the cup 13. However, when the cup 13 deflects to a certain level after enough fluid has flown in through the controlled leakage channels 18A, the quick release channels 18B (optionally covered by a filter) are exposed to the fluid pooling in the center of the cup 13. The quick release channels 18B allow for a large flow rate and substantially instantly allow enough flow so as to equalize pressure and quickly release the cup 13.

In various embodiments, characteristics of the cup 13 can negate the issues presented by the uncertain release point seen in non-ideal cups 13. Various embodiments may use flat cups 13 with low nominal deflection. It should also be noted that the cups 13 and the linkage(s) move through room temperature air in various embodiments. However, some embodiments provide a new ambient fluid, such as viscous oil. Accordingly, the controlled leakage channel 18 size needed to achieve the same flow rate as with air becomes much larger, while the suction cup 13 elastomer is protected from oxidation. This also advantageously addresses issues like dust clogging the system. Additionally, if the cups 13 are mounted on the end of a piston actuating through a cylinder filled with oil, a circular plate 14 can be affixed to the piston, with an outer diameter similar to that of the inner diameter of the cylinder. Doing so creates a damping effect that eliminates any potential slamming of the seat 1 on the way to the up position 48 (e.g., by the lifting system 52) and further may eliminate the need for an additional damper component (e.g., damper 19).

It should be appreciated that various embodiments may provide a passive opening system 52 and/or delay system 54. The biasing system 52 and/or delay system 54 may operate without the use of electrically powered components. Thus, the opening system 52 and/or delay system 54 advantageously operate without the need for an electrical power connection or changing of batteries. The opening system 52 and/or delay system 54 therefore reduce the need for maintenance, and additionally, allows for use in toilets 40 that are not near to an electrical connection (e.g., portable toilets). Furthermore, illustrative embodiments provide a single action for initiating the lifting system 52 and the delay system 54 (e.g., lowering the toilet seat 1).

Figure 14:
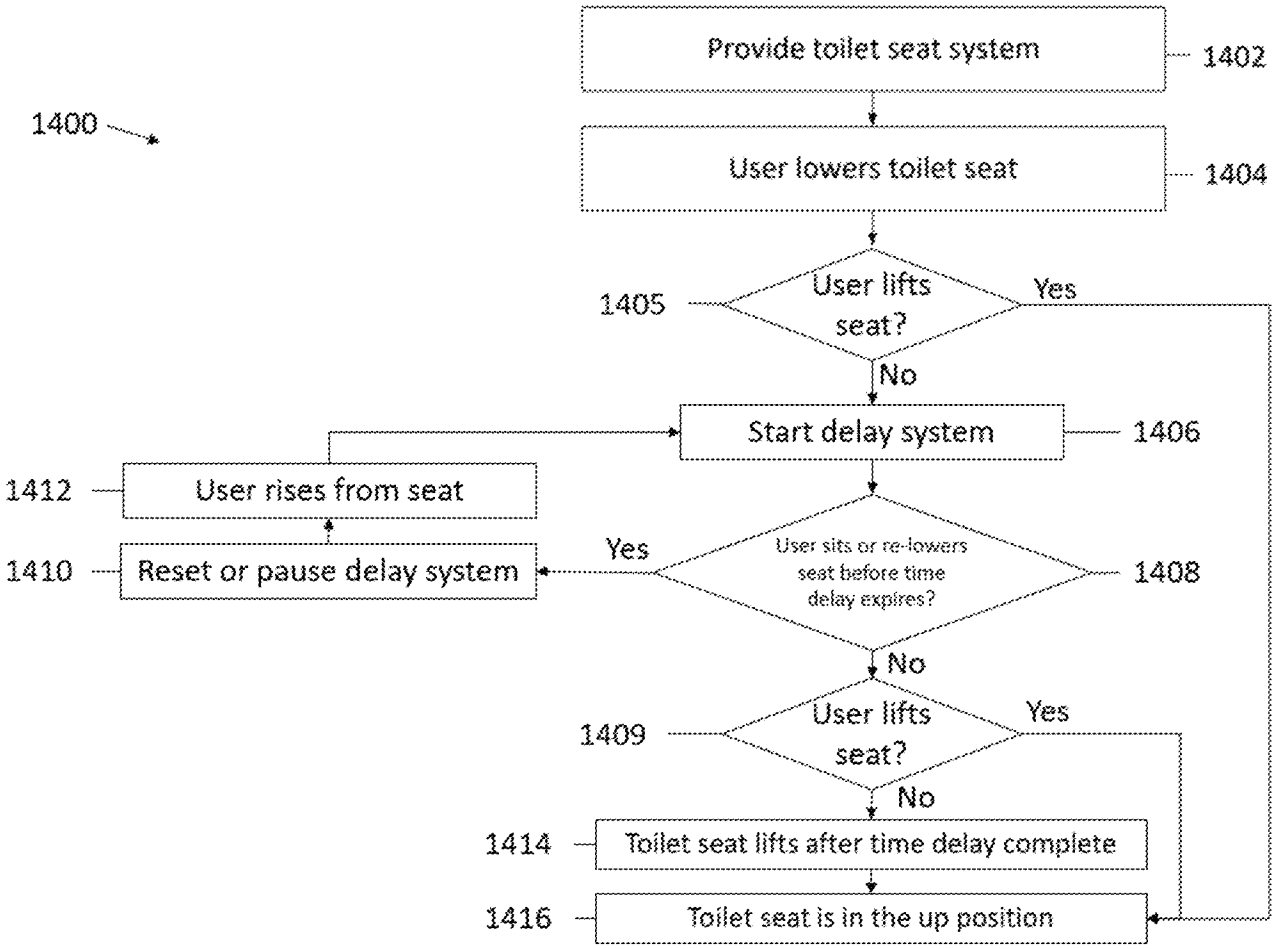
FIG. 14 shows a method of self-lifting a toilet seat in accordance with illustrative embodiments of the invention.

FIG. 14 shows a process of self-lifting the toilet seat 1 in accordance with illustrative embodiments of the invention. The process begins at step 1402, which provides the toilet seat system 100 as described herein. In various embodiments, the toilet seat system 100 includes the toilet seat 1, the toilet bowl 44, and the hinge 46. In some embodiments, the toilet bowl 44 may already be installed at a desired location. Therefore, the system may include the toilet seat 1 and the hinge 46, which may be retrofitted to couple with the toilet bowl 44. In various embodiments, the hinge 46 (e.g., the housing 3 and housing base 4) may be configured to bolt or otherwise couple with the toilet bowl 44. As discussed below, the hinge 46 also couples to the seat 1 and preferably allows the seat 1 to move and/or rotate relative to the bowl 44.

Figure 8:
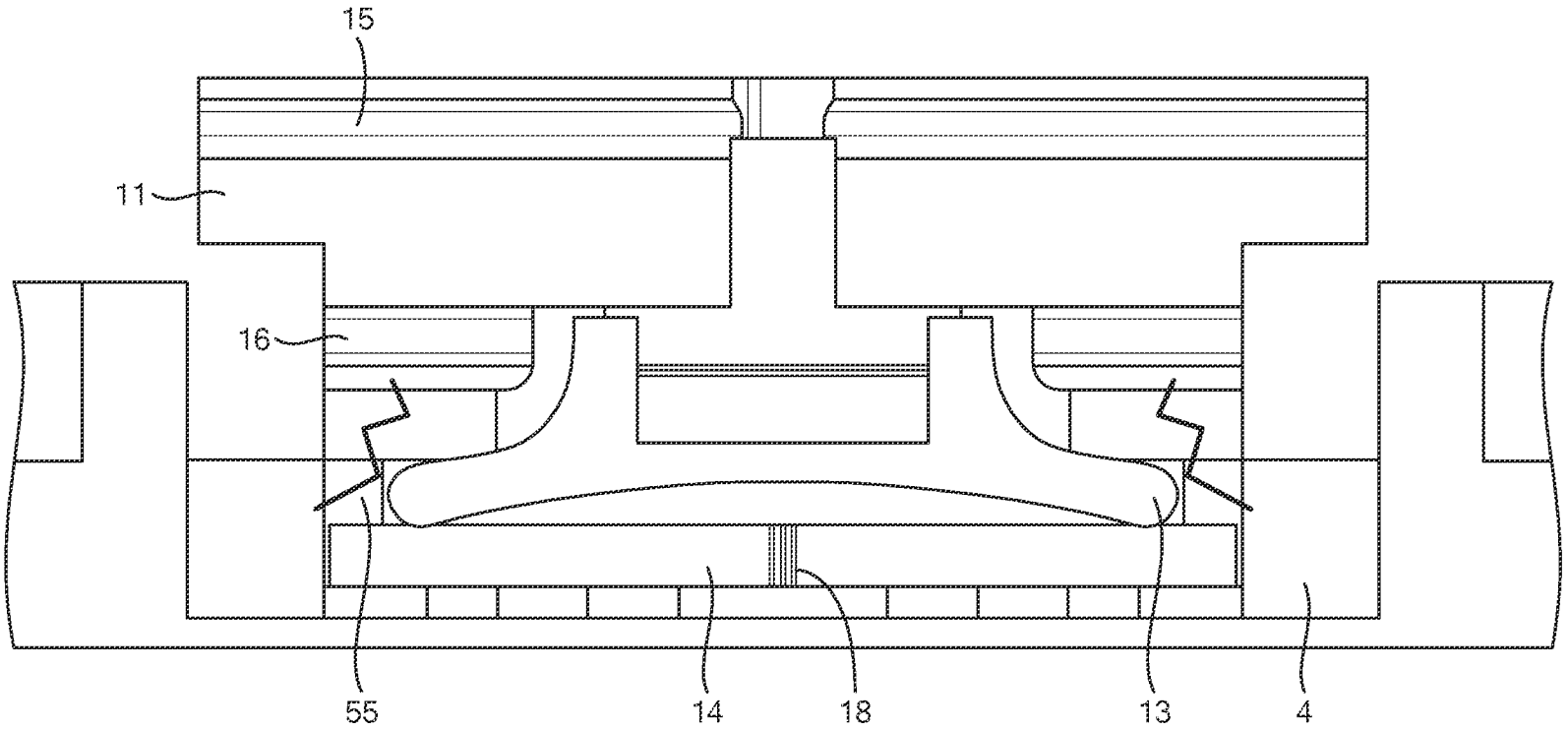
FIG. 8 schematically shows a cutaway view of the delay system in accordance with illustrative embodiments.

In various embodiments, the hinge 46 preferably includes a housing 3 and housing base 4. Preferably, the housing 3 and housing base 4 are sealed and waterproof. Preferably, the rotation of the axle 7 is also sealed via rotary seal 17. Inside of the housing 3 and housing base 4 is the delay system 54. Additionally, the housing 3 and housing base 4 may contain the lifting system 52 and the linkages (e.g., 10-12, 30-33). In some embodiments, as shown in FIG. 8, the cup 13 and the plate 14 is further isolated within this housing 3 using a bellows 55 or other seal that encloses the plate 14 and cup 13 in a fully dustproof manner while continuing to allow the full range of motion of the suction cup 13.

At step 1404, the user lowers the toilet seat 1. When the toilet seat 1 is user-lowered, the lifting system 52 begins to provide a counter torque to the seat 1 towards the up position 48. At some point during the lowering of the seat 1, preferably when the seat approaches the down state 50A, a delay system 54 engages, causing the toilet seat 1 to remain in the in the down state 50A until the user removes their applied force from the seat 1.

The process then proceeds to step 1406, which begins the time delay once the user's applied lowering force is removed. When the user applied lowering force is removed, the seat will transition to the neutral state 49A due to the torque applied to the system by the lifting system 52, which is configured to overcome the torque of the seat 1 when the time delay of delay system 54 expires. As described previously, the delay system 54 may include a suction cup 13 and a plate 14. In some other embodiments, the delay system 54 may include some other type of adhesive. Furthermore, some embodiments may include a gear based delay system 54 or a fluid-channel based delay system 54, as described in alternative embodiments further below.

At step 1408, the process asks whether a user sits or applies lowering force before the time delay expires? If so, in some embodiments, the time delay is reset. However, in some other embodiments, the time delay is paused as the user sits. Thus, if a user sits on, or otherwise applies a threshold-lowering force to the toilet seat 1 prior to the expiration of the delay system, the toilet seat 1 will not self-lift via the lifting system 52 to the up position 48. Instead, the process moves to step 1410 where the delay system 54 will experience a reset or pause to its delay.

When the user sits on the seat 1, their weight is applied to the toilet seat 1. Although the delay system 54 may be engaged by the user sitting on the toilet seat 1, the weight of the user is preferably not directly on the delay system 54. For example, some embodiments may position suction cups 13 underneath the toilet seat 1 such that the suction cups 13 engage a surface of the toilet bowl 44. However, this is not preferred for a number of reasons. First, the weight of the user is likely to damage the suction cups 13 over time. Also, the toilet bowl 44 surface is not sealed, and is likely to become contaminated over time, reducing the quality and reliability of the time delay over time. Thus, illustrative embodiments have linkages between the toilet seat 1 and the delay system 54 to indirectly use the weight of the user on the toilet seat 1 to engage the delay system 54.

Figure 16A:
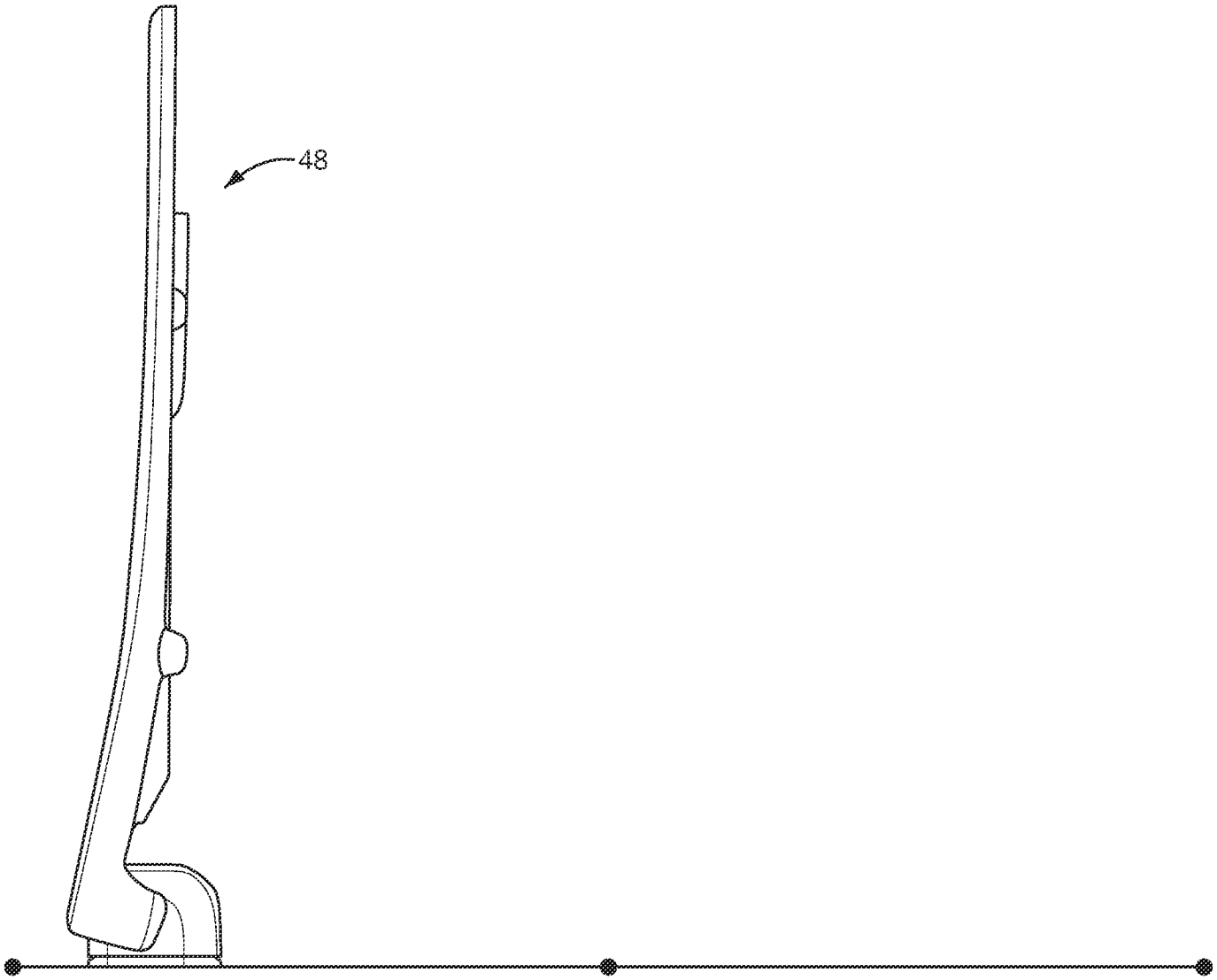
FIG. 16A-C schematically shows the seat of the lifting system in various positions in accordance with illustrative embodiments.
Figure 16B:
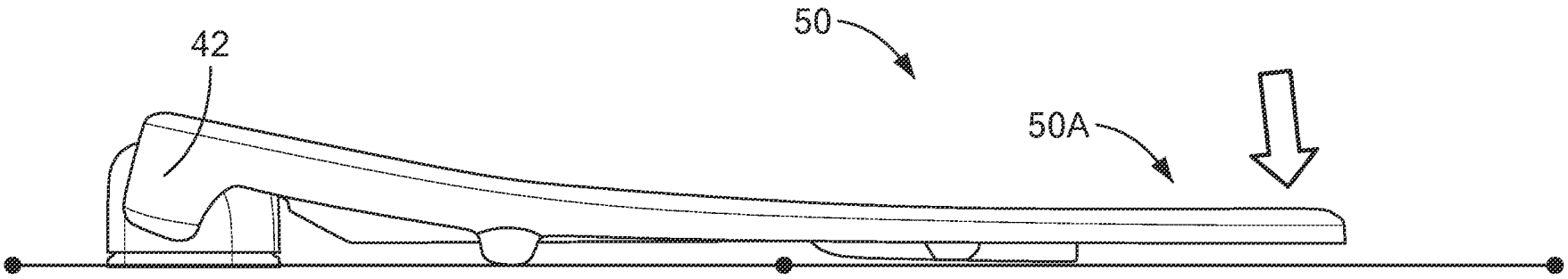
Figure 16C:
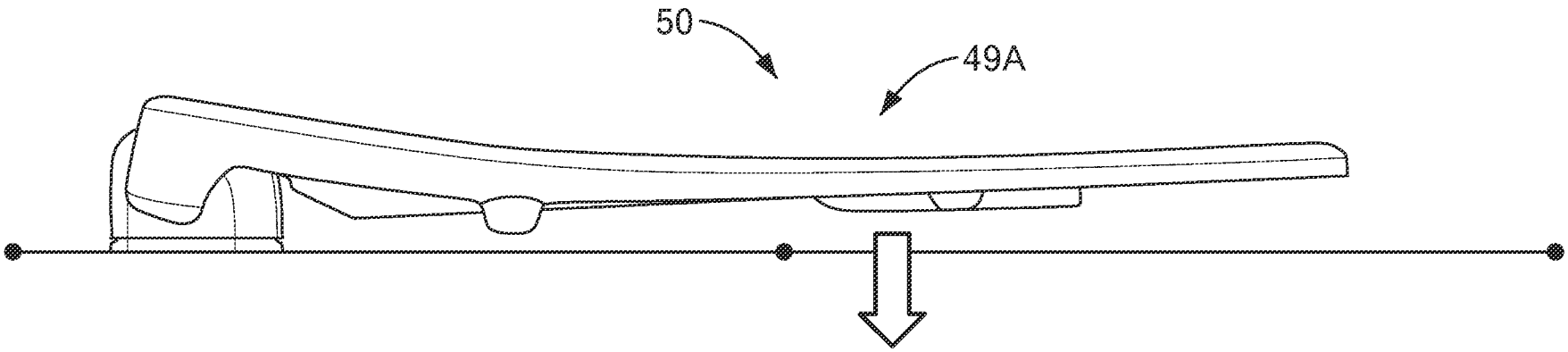

Furthermore, after the user has finished using the toilet 40, the user stands up from the toilet seat 1 at step 1412. By standing up, the user removes the threshold weight from the seat 1. In some embodiments, removing the weight from the seat 1 causes the seat to transition to a neutral position 49A. FIGS. 16A-16C schematically show the seat 1 in different positions. FIG. 16A schematically shows the seat 1 in the up position 48. FIG. 16B schematically shows the seat 1 in the down state 50A, and FIG. 16C schematically shows the seat 1 in the neutral state 49A. To that end, some embodiments may include a component that pushes the seat 1 back to the neutral position 49A as soon as the user rises (i.e., before the time delay expires). Additionally, or alternatively, the delay system 54 may have some slack that causes the seat 1 to move to the neutral position 49A as the user rises.

After the user stands up from the seat 1 in step 1412, the system loops back to step 1406 and the delay system 54 resumes or restarts, after which the process once again asks whether a user lifts the seat. If not, the system once again asks if the user sits before the time delay expires. If they do, the cycle continues as described above, however, if a user does not sit or otherwise apply a threshold lowering force to the toilet seat 1 prior to the expiration of the delay system 54, the process moves to step 1414 14, and the toilet seat 1 self-lifts to the up position, and the process is complete at step 1416 with the seat in the up position.

Additionally, the user may lift the seat 1 to the up position at any point in the cycle, for example at intermediate steps 1405 or 1409. However, some other embodiments may not allow the user to lift the seat 1.

FIG. 14 describes a method of lifting a toilet seat 1 in accordance with illustrative embodiments of the invention. It should be noted that this method is substantially simplified from a longer process that may normally be used. Accordingly, the method shown in FIG. 14 may have many other steps that those skilled in the art likely would use. In addition, some of the steps may be performed in a different order than that shown, or at the same time. Furthermore, some of these steps may be optional in some embodiments. Accordingly, the process 1400 is merely exemplary of one process in accordance with illustrative embodiments of the invention. Those skilled in the art therefore can modify the process as appropriate.

Figure 17:
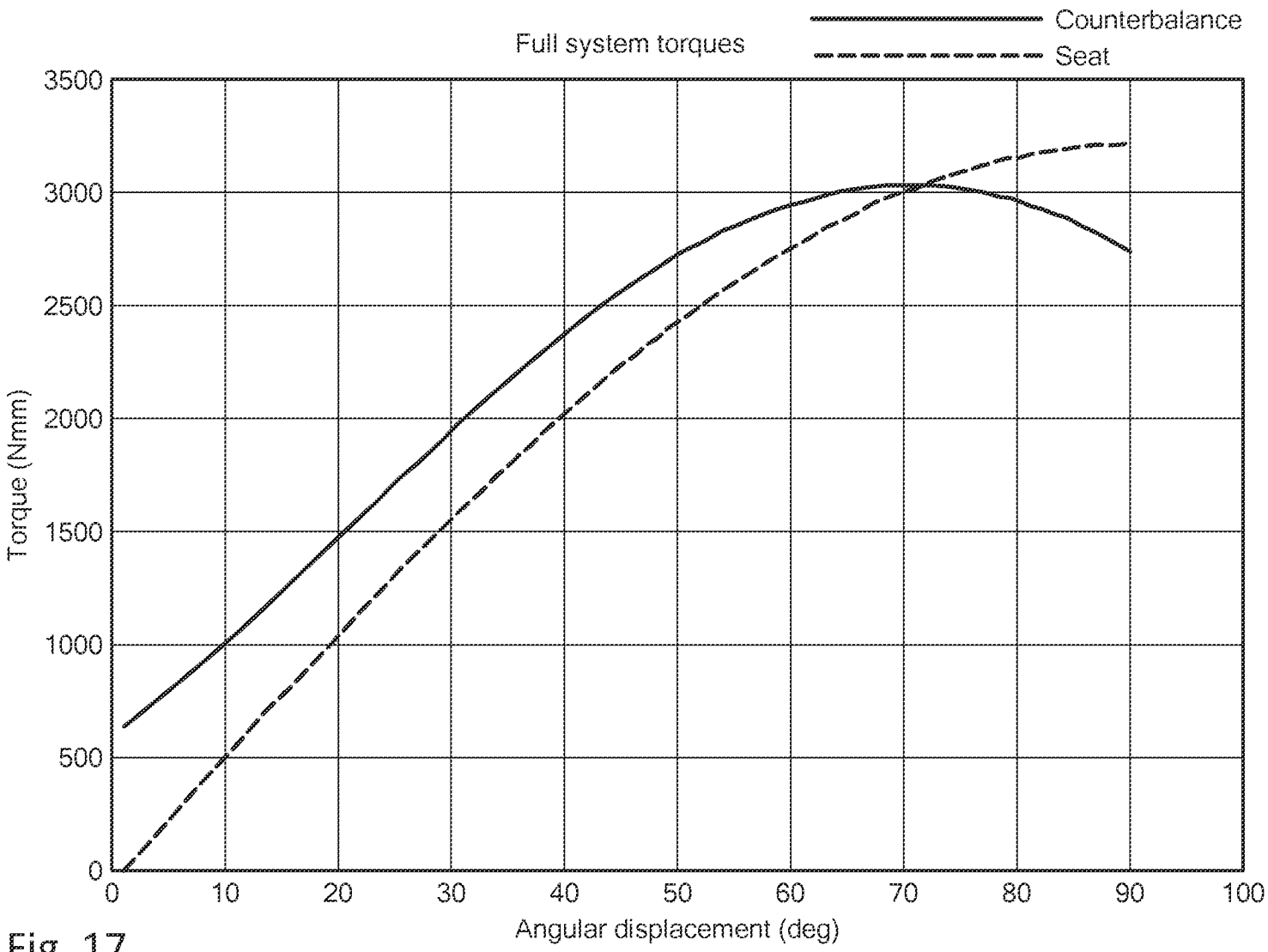
FIG. 17 schematically shows an alternative embodiment of the torque profiles of the seat vs the lifting system in accordance with illustrative embodiments of the invention.
Figure 19:
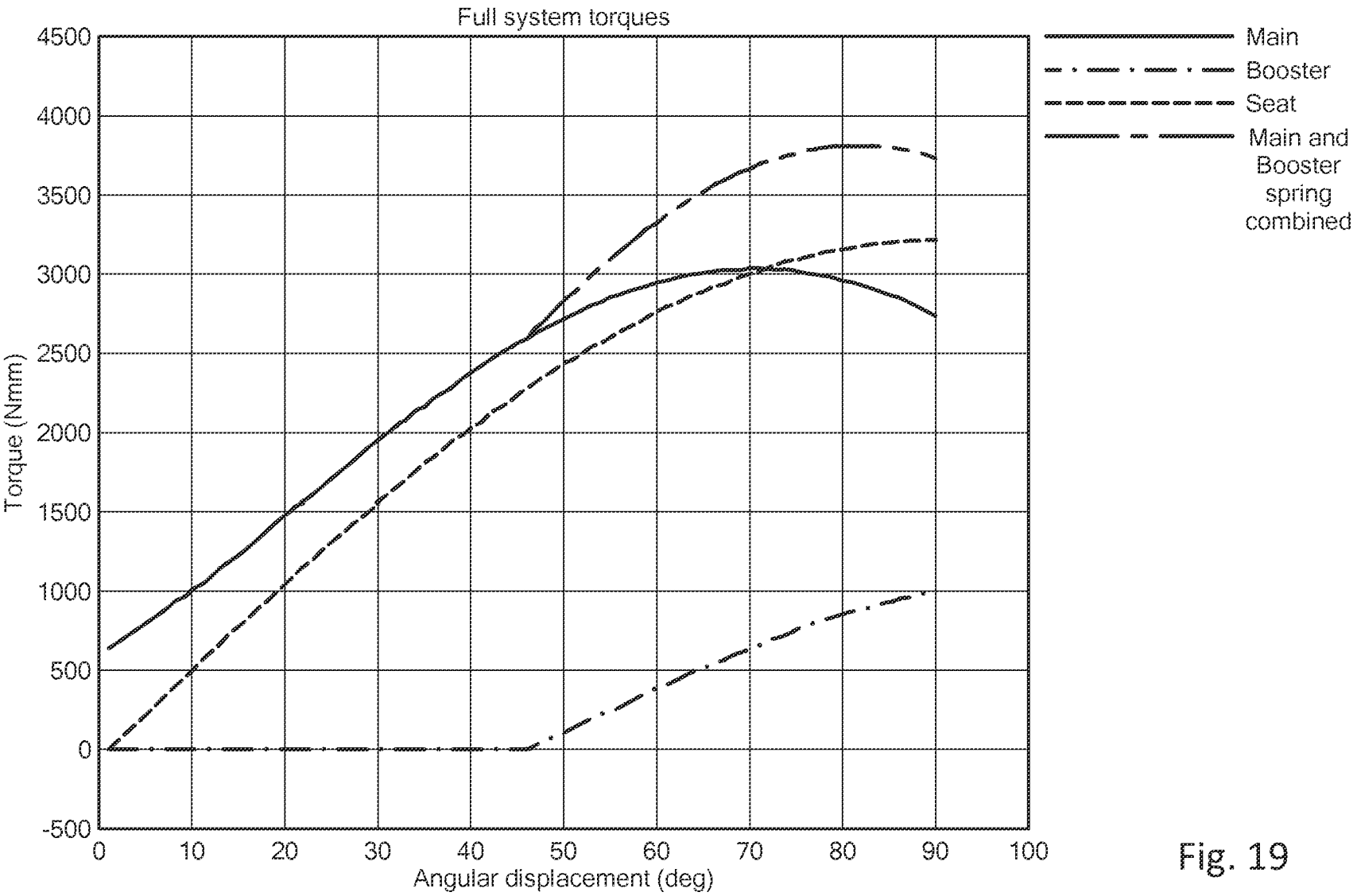
FIG. 19 schematically shows the torque sharing scheme in accordance with illustrative embodiments.

In an alternative embodiment of the self-lifting toilet seat system 100, a different configuration is presented. Here, the spring 9 of the lifting system 52 is a linear spring 9, where the torque of the linear spring is always slightly greater than that of the seat, except in the region where the seat is near the down position 50. In the near down position 50, the spring 9 torque of the lifting system 52 that works to self-lift the seat, falls below the torque of the seat, meaning that the seat will "latch" or "hold" itself down due to the torque imbalance, and stays down indefinitely if no other system acts on it. FIG. 17 schematically shows the torque profiles of the seat 1 vs the lifting system 52 in accordance with such an illustrative embodiment. In contrast to FIG. 10, FIG. 17 shows that the torque profiles of the main spring 9 and the seat 1 are such that the main spring 9 is unable to lift the seat when the seat 1 is in the down position 50. Thus, illustrative embodiments rely on the booster spring unit 62 to help lift the seat 1, for example, as shown in FIG. 19.

Figure 18:
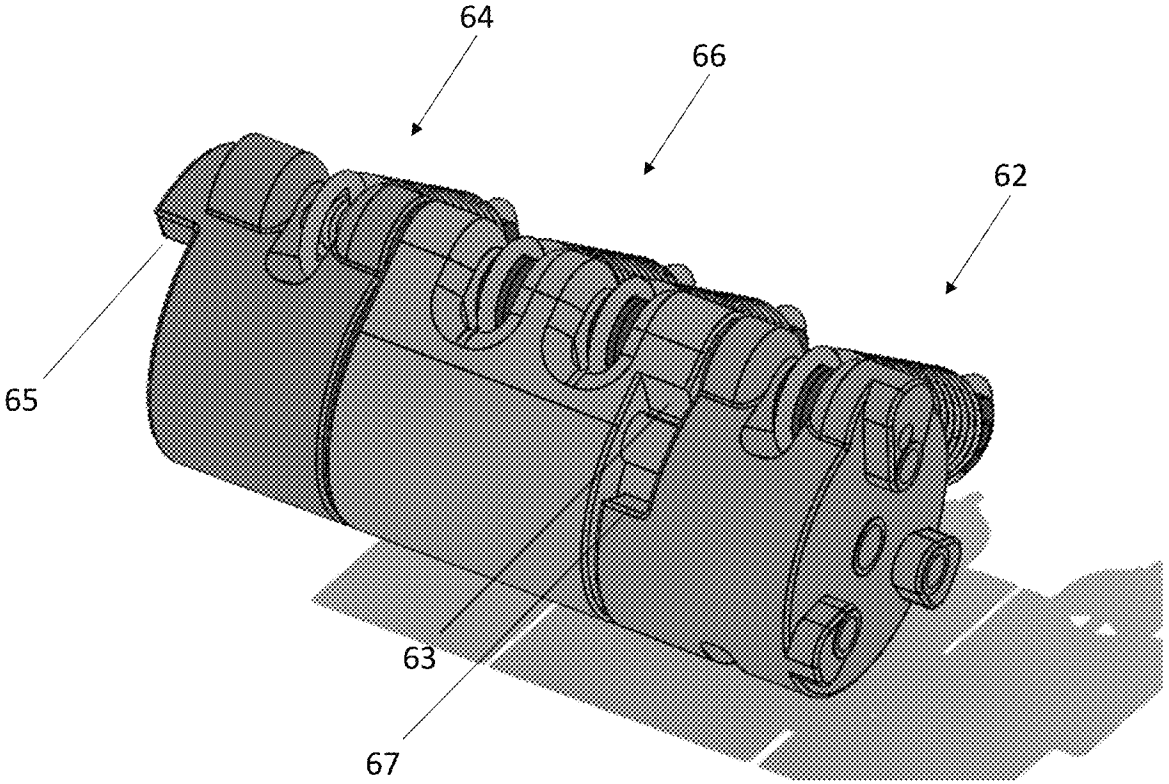
FIG. 18 schematically shows an alternative embodiment of the lifting system in accordance with illustrative embodiments.

FIG. 18 schematically shows an alternative embodiment of the lifting system 52 in accordance with illustrative embodiments. Various embodiments may include a main spring unit 66, which includes a spring directly rotatably coupled to the seat 1, such that for any new position of the seat 1 there is a new deflection of the spring of main spring unit 66. Thus, there is no lost motion in the spring of main spring unit 66. In the present embodiment, the spring 66 is a linear spring on a lever arm, but it may also be a torsion spring or any other type of spring.

Various embodiments may include a booster spring unit 62, which is a spring 62 rotatably coupled to the seat 1, such that it is only engaged during the travel of the seat 1 where it is near the down position 50. In the present embodiment, the booster spring 62 is engaged by a dog-type coupling (e.g., 63, 67) between the mainspring 66 and booster spring 62 units at a seat angle of 45 degrees from the down position 50 Due to the dog coupling between the main spring unit 66 and booster spring unit 62, as well as the "self" latching of the seat 1, the user is able to self-lift the seat 1 to the up position 48 regardless of the state of any of the internal hinge 46 components. Additionally, no further clutching or disengagement system is needed to achieve such functionality. However, the spring 62 type, coupling type, and location of coupling may vary for other embodiments of the system.

Various embodiments may include a neutral spring unit 64, which is a spring 64 rotatably coupled to the seat 1, such that it is only engaged when the seat 1 travels between the neutral state 49A and the down state 50A. In the various embodiments, the neutral position 49A may be about 3 degrees above the down state 50A. Both values can vary by however, based on the desired is implementation. Additionally, it is possible for backlash in the system to raise the seat from the down state to the neutral state without the need for a neutral spring unit 64.

In various embodiments, the seat 1 is user-lowered from the up position 48 until main spring unit 64 engages with booster spring unit 62. The seat 1 is user-lowered from the point of engagement of main spring 64 and booster spring 62 units down until the neutral state 49A (e.g., 3 degrees above the top plane of bowl 44). The seat 1 is then user-lowered to the down state 50A, fully engaging both main 66, booster 62, and neutral spring 64 units. The neutral spring unit 64 then rotates the seat 1 and main spring 64 unit from the down state 50A to the neutral state 49A. The main spring 64 is unable to self-lift the seat from the neutral state 49A due to the designed torque imbalance, therefore the seat 1 remains in the neutral state 49A. Since the booster spring unit 62 is independent of the main spring unit 64, it remains in the position it is placed into by the seat 1 when the seat 1 is user-lowered to the down state 50A. However, when the seat 1 transitions from the down state 50A to the neutral state 49A, the booster spring unit 62 is no longer loaded by seat 1 via contact from the main spring unit 66 and is free to begin to return to its original position. The booster spring unit 62 rotation to re-engage with the main spring unit 66 dog 63 (still in neutral position 49A) is slowed by a heavy gear train.

In some embodiments, after a time delay (e.g., about 30 seconds), the booster spring unit 62 makes contact with the main spring unit 62. The gear train (e.g., 68-80) slowing the booster spring unit 62 down releases near this moment of contact, allowing for the booster spring unit 62 to quickly return to its uncompressed state. In doing so, the booster spring unit 62 self-lifts the seat to the location where the booster spring unit 62 is first engaged by the main spring unit 66 (e.g., 45 degrees). The seat is then self-lifted from the intermediate booster engagement location to the up position by the main spring unit 66 of the lifting system 52.

When seat 1 is in the down state 50A, the booster spring 62 is fully engaged, and the neutral spring 64 self-lifts the seat 1 into the neutral position 49A. This allows the seat 1 to sit at a slightly elevated neutral position 49A, while the booster spring unit 62 winds down the timer of the delay system 54 and approaches the main spring unit 66. The advantage of such an arrangement is that the seat 1 remains perfectly motionless in the neutral state 49A while the booster spring unit 62 rotates. Without the neutral spring unit 64, the seat 1 would slowly creep upwards, coupled with the booster spring unit 62 as the delay system 54 runs down. However, given enough backlash in the gearing systems, the seat 1 may simply lift to the neutral state 49A, or even farther on its own. In that case, the neutral spring system 64 can be removed.

To overcome the torque imbalance when the seat 1 is near the down state 50, the booster spring 62 is engaged to assist in self-lifting the seat 1 to a point where the main counterbalance spring 66 can self-lift the seat on its own. FIG. 19 schematically shows the torque sharing scheme in accordance with illustrative embodiments. Returning to FIG. 18, the booster spring unit 62 may be a linear spring attached to a lever arm, affixed to the main rotating axle of the seat, and coupled to the main counterbalance spring via a dog connection 65. In other embodiments, a torsion spring, or other clutching mechanism may be employed.

The booster spring 62 engages at some point during the lowering of the seat 1, before the seat 1 torque eclipses the main spring unit 66 torque. After the seat is fully user-lowered to the down state 50A, both the booster 62 and main spring units 66 are fully engaged, and self-lifts the seat back into the up position, assuming no other forces are applied to the system. However, two things happen from here that allow the seat 1 to remain lowered for an extended period of time:

1. The neutral spring unit 64 self-lifts the seat 1 a few degrees, such that the dog connection 63 and 67 between the main spring unit 66 and the booster spring units 62 are no longer in contact.
2. The booster spring unit 62 is rotatably coupled to a timing mechanism. The coupling runs through a ratcheting mechanism (eg, 75, 76) to a heavy gear reduction 78, which is arranged such that as the booster spring unit 62 tries to return to the unstretched state, the booster spring unit 62 winds the entire gear train back with it, which causes a delay in the booster spring unit 62 dog connection 67 coming back into contact with the main spring unit 66 dog connection 63. The time it takes for the booster spring unit 62 to catch up to the main spring unit 66 (which is in the neutral state 49A) is what creates the delay of the seat in the down position 50. The gear train then disengages due to a special gear train disengagement mechanism (71-74), and allows the booster spring unit 62 to rapidly return to its unstretched state, which self-lifts the seat 1 to a point where the mainspring unit 66 can self-lift it all the way back to the up position 48.

Figure 20:
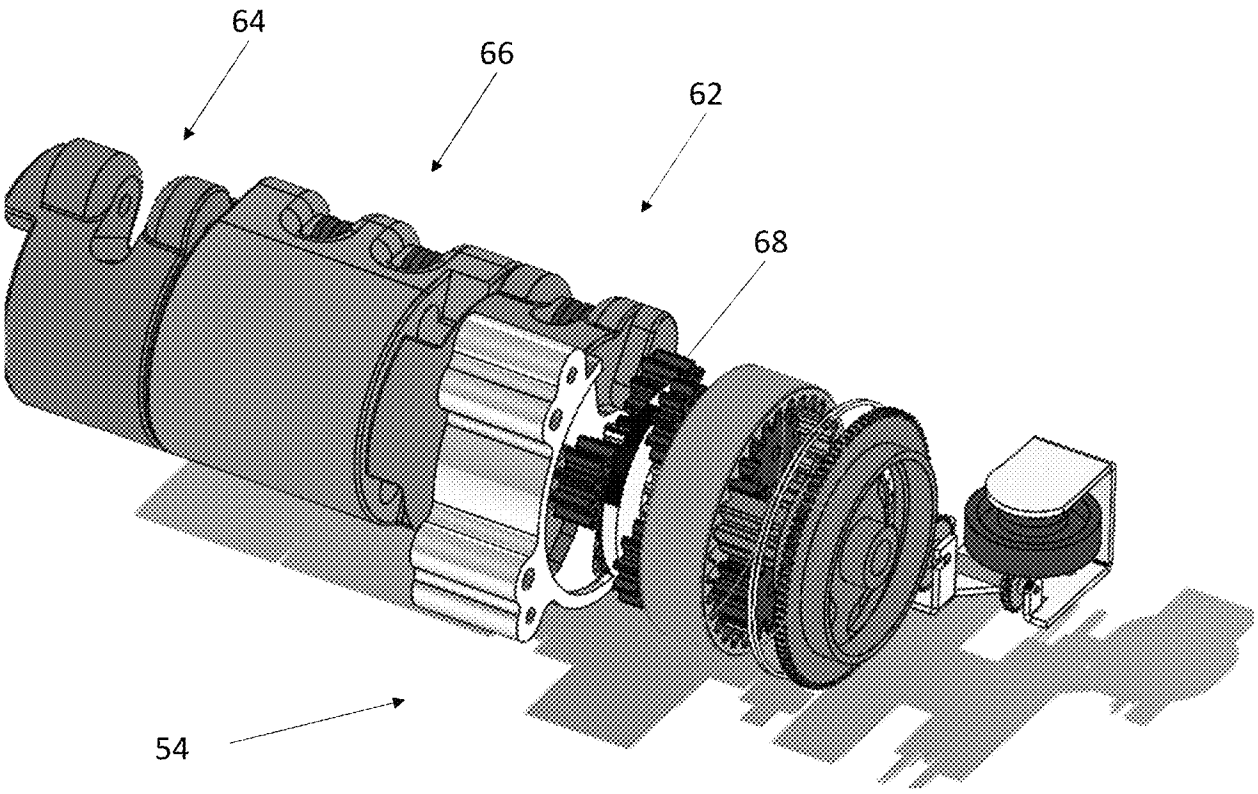
FIG. 20 schematically shows a partially exposed view of the delay system gearing rotatably coupled to the lifting system of FIG. 18.
Figure 21:
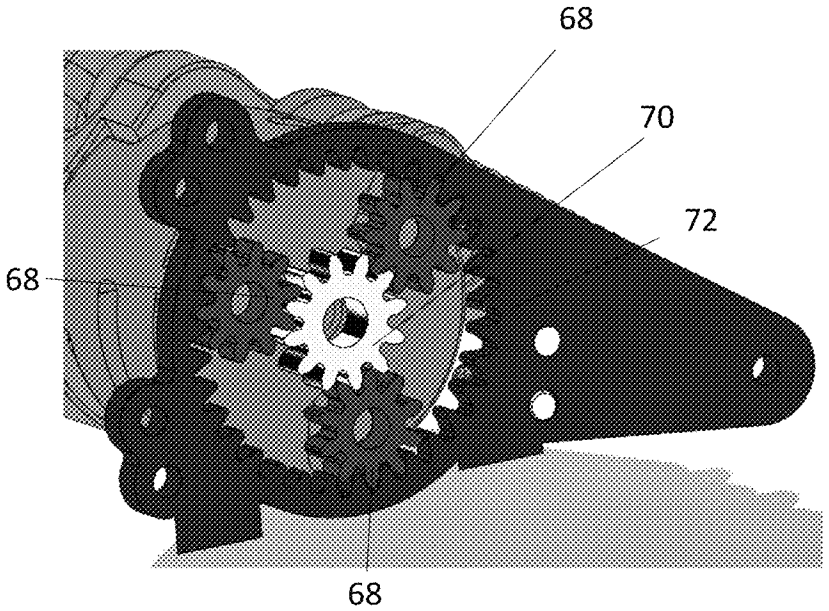
FIG. 21 schematically shows a first planetary gearing set in accordance with illustrative embodiments.

FIG. 20 schematically shows a partially exposed view of the delay system 54 gearing rotatably coupled to the lifting system 52 of FIG. 18. The delay system 54 allows the booster spring 62 to slowly return from its position when the seat is in the down state 50A, to its position when the seat 1 is in the neutral state 49A, to create the desired seat delay period. The delay system 54 engages for the return portion of the cycle, and disengages after the booster spring unit 62 dog connection 67 is nearly engaged with or has just begun to engage with the main spring unit 66 dog connection 63. To accomplish this functionality, the delay system consists of several stages of gearing:

FIG. 21 schematically shows a first planetary gearing set in accordance with illustrative embodiments. The first planetary gearing increase (e.g., as in this first set of gears increases the gear ratio between the input and output of the gear set), takes the planetary gears 68 as input, which are rotatably fixed to the booster spring unit 62, and outputs rotation of sun gear 70. The sun gear 70 output rotates (e.g., 3.75 times) more than the input, but the gear ratio can be modified for other timing schemes by modifying the relative diameters of the ring gear 72, planet gears 68, or sun gear 70.

Figure 22:
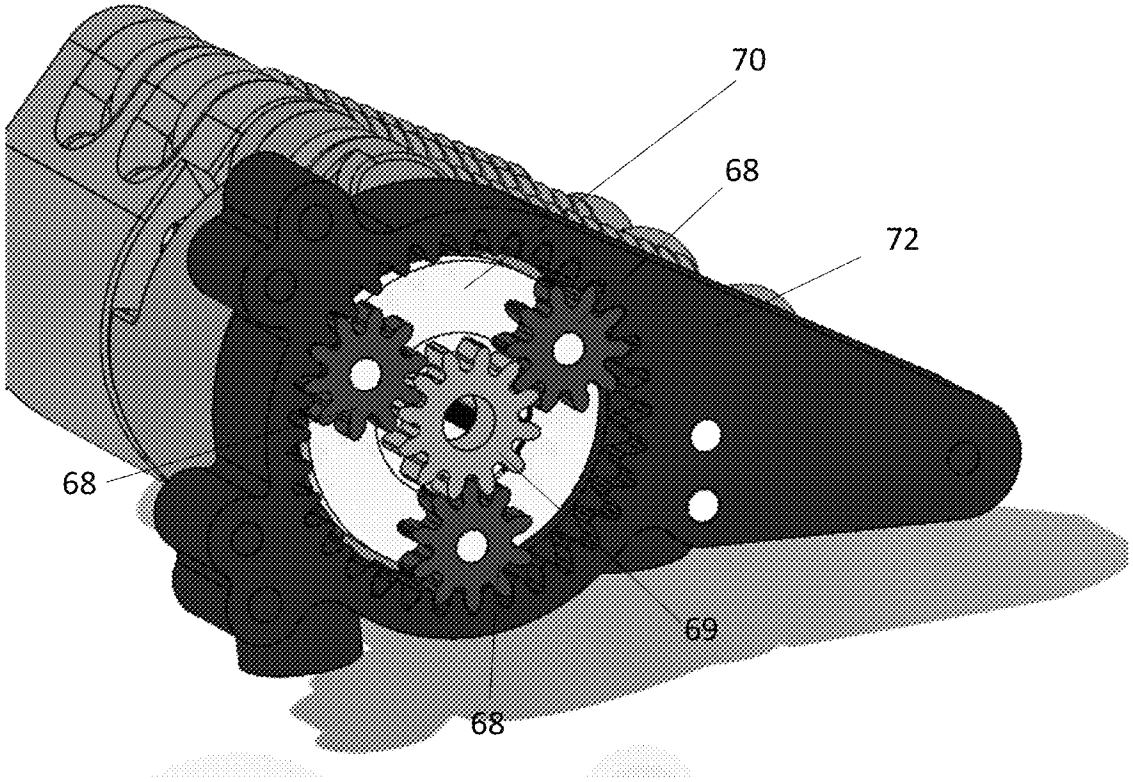
FIG. 22 schematically shows a second planetary gearing increase in accordance with illustrative embodiments.

FIG. 22 schematically shows a second planetary gearing increase in accordance with illustrative embodiments. The sun gear 70 of the first planetary set outputs to the planetary carrier input 70 of the second planetary gearset. The ring 72 remains fixed and the output of the second planetary gearset is the sun gear 69, as in the first set. In the current embodiment, the output speed is (e.g., 3.75×) the input speed, but this may again be adjusted as needed.

Figure 23:
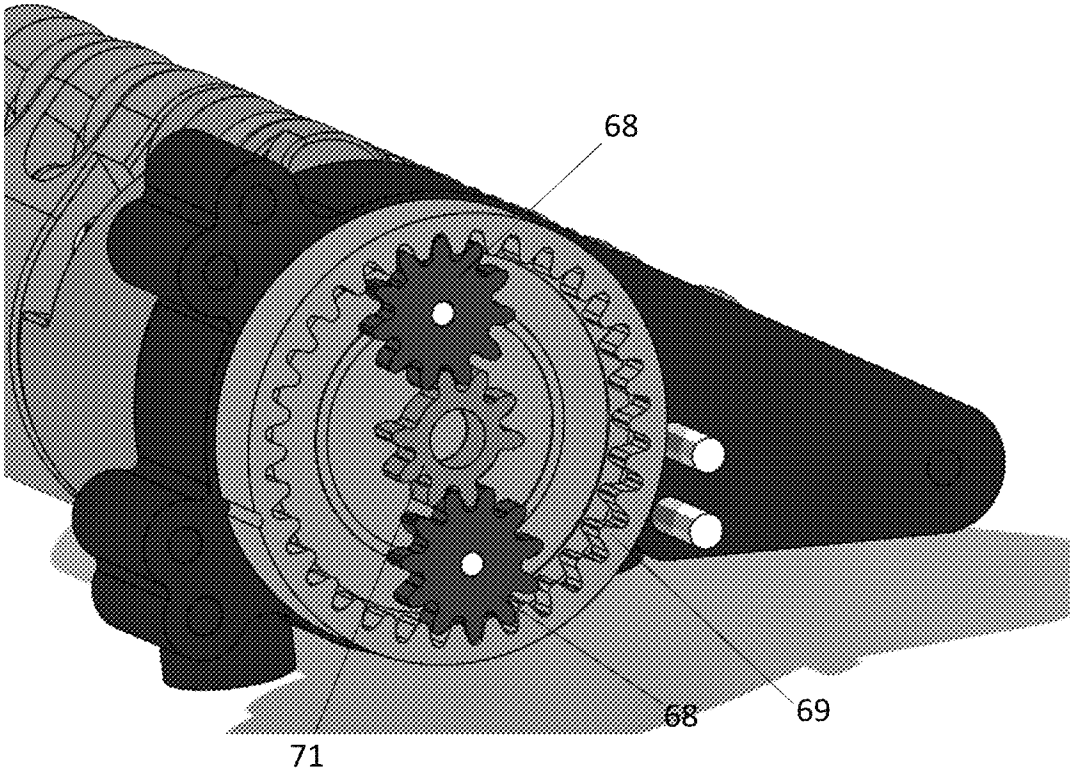
FIG. 23 schematically shows a planetary gearing increase and targeted disengagement mechanism in accordance with illustrative embodiments.

FIG. 23 schematically shows a planetary gearing increase and targeted disengagement gear 71 in accordance with illustrative embodiments. The sun gear 69 output of the second planetary gear set serves as the ring gear input 69 to the third planetary gearset. In this third planetary gearset, there are two, fixed, planetary gears 68. The sun gear 71 is a sector gear with several missing teeth. These missing teeth serve as part of the targeted disengagement mechanism, which allows the booster spring unit 62 return profile to be slow for a very small distance, followed by a longer and much faster motion. This functionality is achieved with the addition of a biasing boss 71A affixed to the sun gear 71 (shown best in FIGS. 24A-27B), along with a bi-directional biasing spring 73.

Figure 24B:
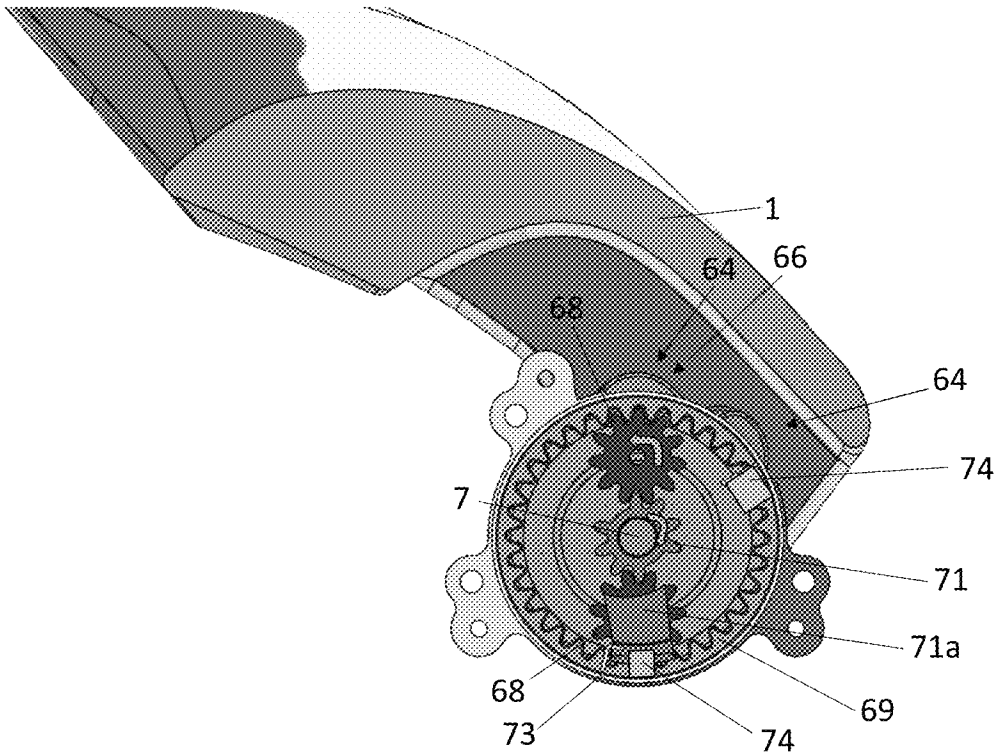
FIG. 24B schematically shows the main spring unit in initial engagement iu with a booster spring unit in accordance with illustrative embodiments.
Figure 24A:
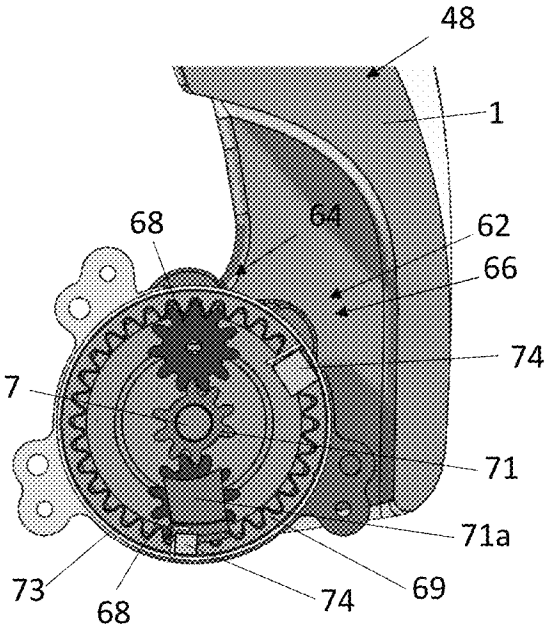
FIG. 24A schematically shows the gears when the seat is in the up position in accordance with illustrative embodiments.

FIG. 24A schematically shows the gears of the third gearset when the seat is in the up position 48 in accordance with illustrative embodiments. FIG. 24B schematically shows the main spring unit 66 engaged with booster spring unit 62 in accordance with illustrative embodiments. The initial orientation with the seat 1 in the up position 48 is shown in FIG. 24A. In this orientation, the booster 62 and main spring units 66 are in the same position. As the seat 1 is user-lowered, the main spring unit 66 rotates with it in the counter-clockwise direction about the central axis of the axle 7. After the seat 1 user-lowers far enough such that the main spring unit 66 engages with the booster spring unit 62, as shown in FIG. 24B, the booster spring unit 62 will also begin to rotate in the counter-clockwise direction with the seat 1. This will cause the ring gear 69, and therefore the planets 68 of this section, to rotate in the counter-clockwise direction as well. After this occurs, the sun gear 71 is rotated in the clockwise direction, which causes the biasing boss 71A on the sun gear 71 to engage with the biasing spring 73, causing a clockwise torque to be applied to the sun gear 71, just as the planets 68 fall into the dead zone of the sun gear 71.

Figure 25B:
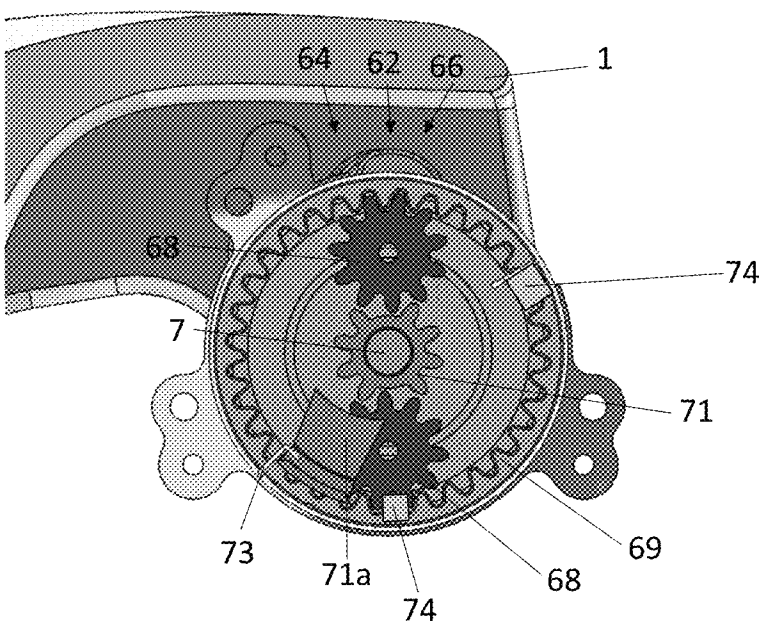
FIG. 25B schematically shows the gears when the seat reaches the down position in accordance with illustrative embodiments.
Figure 25A:
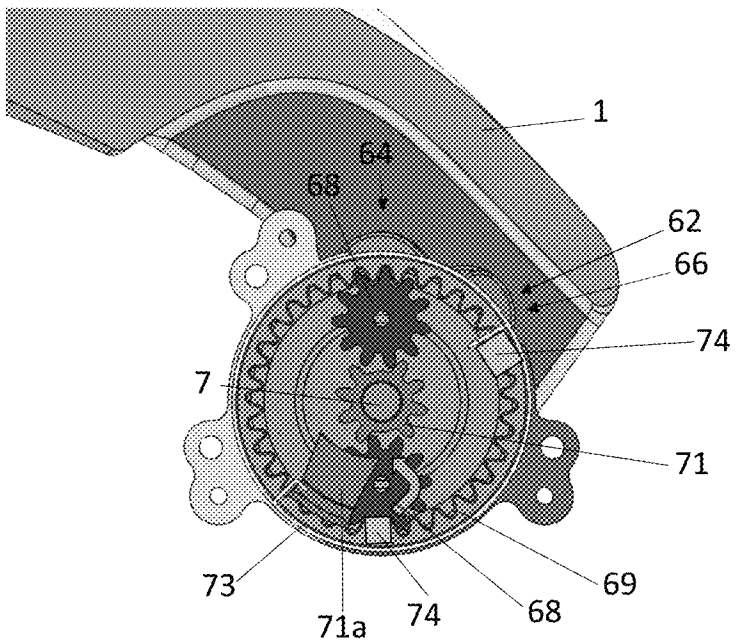
FIG. 25A schematically shows the planets rotate through the sun gear dead zone in accordance with illustrative embodiments.

FIG. 25A schematically shows the planets 68 rotate through the sun gear 71 dead zone in accordance with illustrative embodiments. As the seat continues to lower, the counter-clockwise torque on the sun gear 71, and the planet gears' 68 positions in the dead zone means that for any further lowering of the seat 1, the sun gear 71 remains nearly stationary. Each next tooth on the planet gears 68 simply hits the sun gear 71 and keeps rotating, without ever actually meshing. This position is shown in FIG. 25A. FIG. 25B schematically shows the planet gears 68 when the seat 1 reaches the down position in accordance with illustrative embodiments. As the seat enters the down state, the sun gear 71 remains in the same position.

Figure 26B:
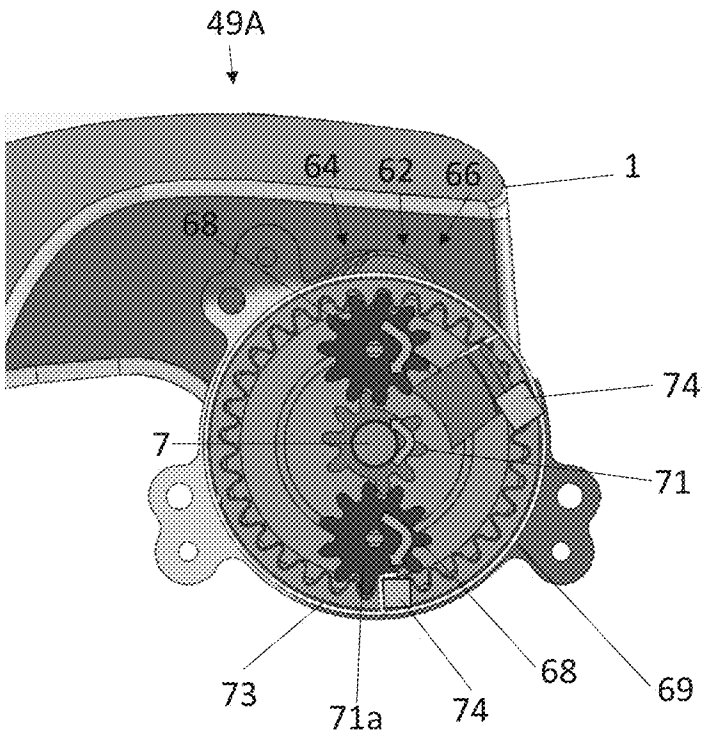
FIG. 26B schematically shows the planet gears disengaged from the sun gear at the sun gear dead zone, concurrent with booster unit contacting main spring unit in accordance with illustrative embodiments.
Figure 26A:
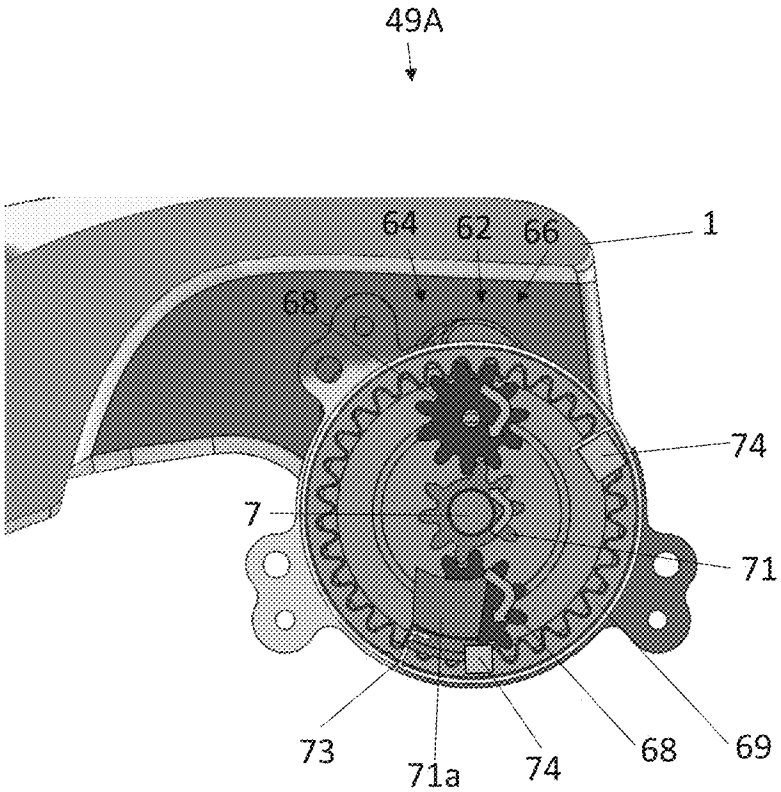
FIG. 26A schematically shows the planet gears engaged with sun gear during initial booster spring unit return period in accordance with illustrative embodiments.

FIG. 26A schematically shows the planet gears 68 engaged with sun gear 71 during initial booster spring unit 62 return period in accordance with illustrative embodiments. FIG. 26B schematically shows the planet gears disengaged from the sun gear 71 at the dead zone, concurrent with booster spring unit 62 contacting main spring unit 66 in accordance with illustrative embodiments.

After the seat 1 is user-lowered, pressure from the user is removed (e.g., as the user prepares to sit on the seat 1). Thus, the return force of the booster spring unit 62 forces the booster spring unit 62 in the clockwise direction. In FIGS. 26A and 26B, it is assumed that the neutral spring unit 64 has already self-lifted the seat 1 into the neutral position 49A, and the seat 1 is stationary as the booster spring unit 62 rotates slowly in the clockwise direction. The clockwise rotation of the booster spring unit 62 forces the ring gear 69 and the planets 68 of this section to rotate in the clockwise direction as well. Since the sun gear 71 is biased into the counter-clockwise direction, and the planets are now rotating in the clockwise direction, they are able to re-mesh with each other. Thus, the sun gear 71 is driven in the counter-clockwise direction by the planets 68 until the next sun gear 71 dead zone is reached. This travel distance translates to the traversal of the booster spring unit 62 from the down state 50A to the neutral state 49A, and means that the main spring unit 66 and the booster spring 62 unit are now back in contact via the dog linkage 63 and 67. As shown in FIG. 26B, after the last tooth of the sun gear 71 has nearly disengaged, the biasing block 74 will have come into contact with the other end of the biasing spring 73, thereby biasing the sun gear 71 into the clockwise direction. Since the planets 68 are turning in the clockwise direction, the teeth of the planets 68 simply skip over the clockwise biased sun gear 71. Thus, the gear train downstream of the sun gear 71 is no longer engaged, and there is little force resisting the booster spring unit 62 torque.

Figure 27B:
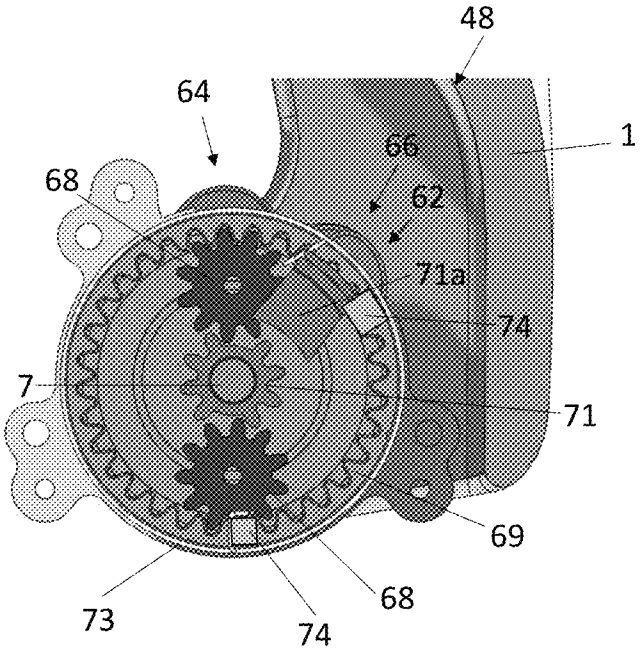
FIG. 27B schematically shows the main spring unit lifting the seat to the up position.
Figure 27A:
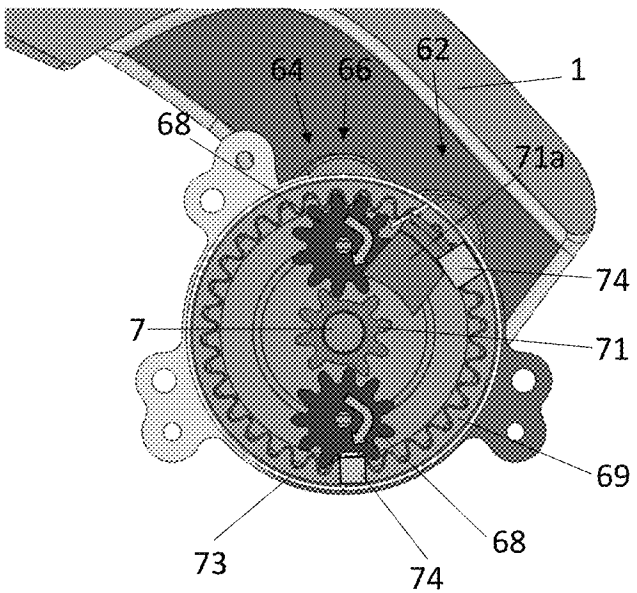
FIG. 27A schematically shows the booster spring and main spring units lifting the seat to 45 deg position in accordance with illustrative embodiments.

FIG. 27A schematically shows the booster spring unit 62 self-lifting the seat 1 to the 45 deg position in accordance with illustrative embodiments. FIG. 27B schematically shows the main spring unit 66 self-lifting the seat 1 to the up position 48. Because the rest of the downstream gear train is disengaged and is not resisting the self-lifting torque of the booster spring unit 62, the booster spring unit 62 quickly restores to its original position, self-lifting the main spring unit 66 (and therefore the seat 1) into the 45 degree position as shown in FIG. 27A. From here, the main spring unit 66 has enough torque to self-lift the seat 1 into the fully up position, and the cycle is ready to run again. From FIG. 27A-27B, the pictured gear train components have not moved, as the booster spring unit 62 remains stationary for the last 45 degrees of seat 1 self-lifting.

Figure 28:
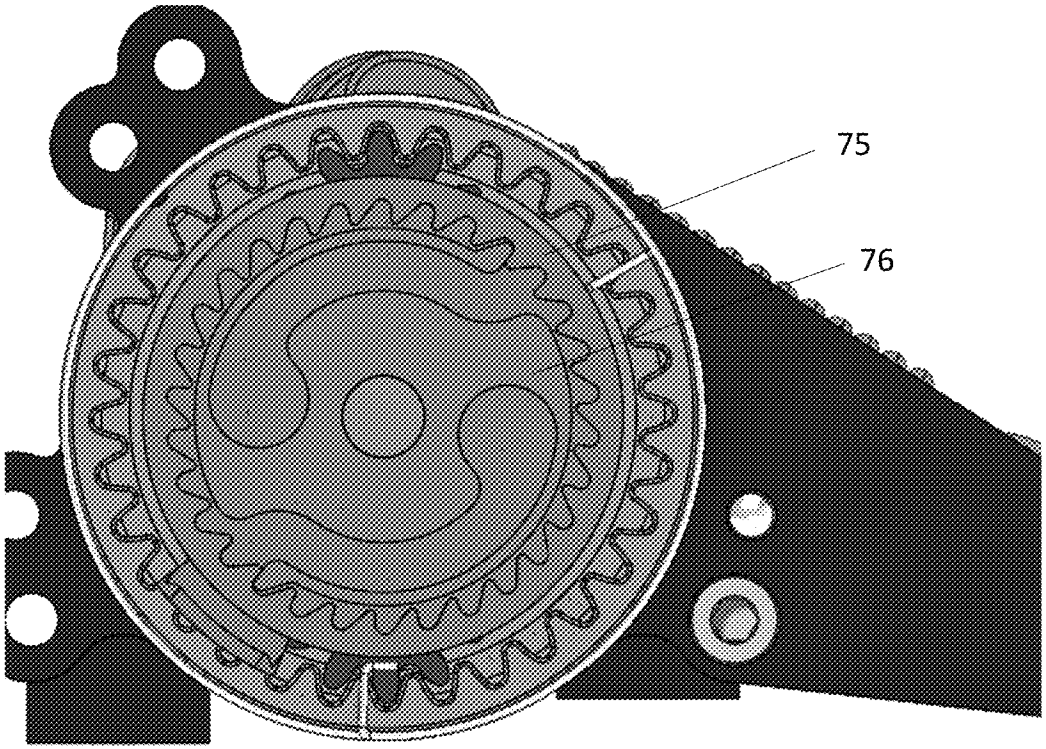
FIG. 28 schematically shows a ratcheting mechanism in accordance with illustrative embodiments.

Downstream of the disengagement mechanism, FIG. 28 schematically shows a ratcheting mechanism (75, 76) in accordance with illustrative embodiments. Various embodiments include a one-way ratchet. There is a further gearing increase after the three planetary gear trains, as the three planetary geartrains alone do not contribute to a significantly large enough gearing increase to achieve the desired timing. However, in order to avoid having to use excessive force to lower the seat, the afore-mentioned ratchet (75, 76) is placed between the three planetary gear trains and the further gearing downstream. This way, upon user-lowering the seat 1, the ratchet clicks through and avoids engaging anything further on, but in the self-lifting direction, the ratchet engages and forces the entire downstream gear train to rotate, thus providing the long delay for the booster spring unit 62 return.

Figure 29:
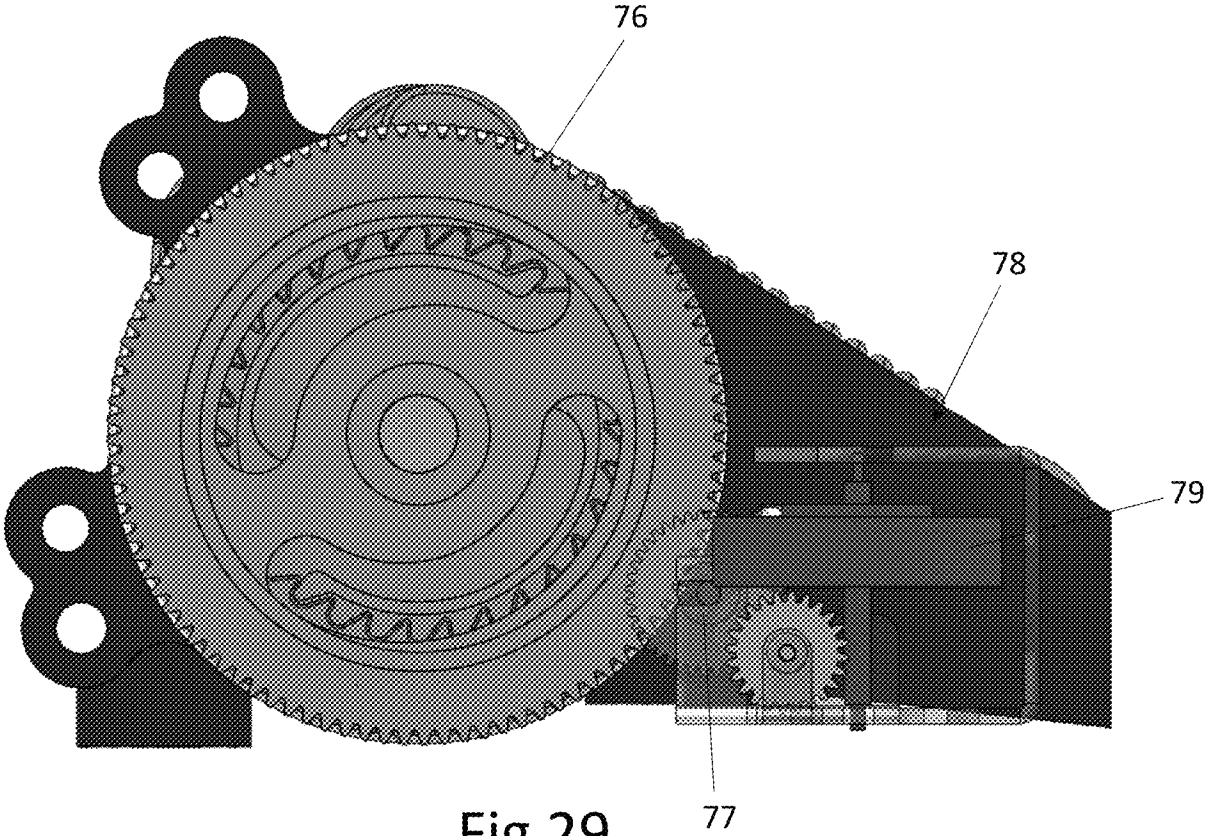
FIG. 29 schematically shows the ratchet input retrofitted to a music box timer mechanism in accordance with illustrative embodiments.

FIG. 29 schematically shows the ratchet output 76 retrofitted to a music box timer mechanism 78 in accordance with illustrative embodiments. The ratchet output 76 is fed through gear 77 directly into a music box timer 78. This creates the desired significant speed increase to the final gear train component—the music box air damper 79. A friction damper may also be used, but it may experience wear from excessive use, and may create some undesirable noise. The music box gear train 78 is advantageous due to its compact design that produces a significant gearing increase. However, a custom gearing solution, along with any other damping or restraining mechanism can be used as well.

Figure 30:
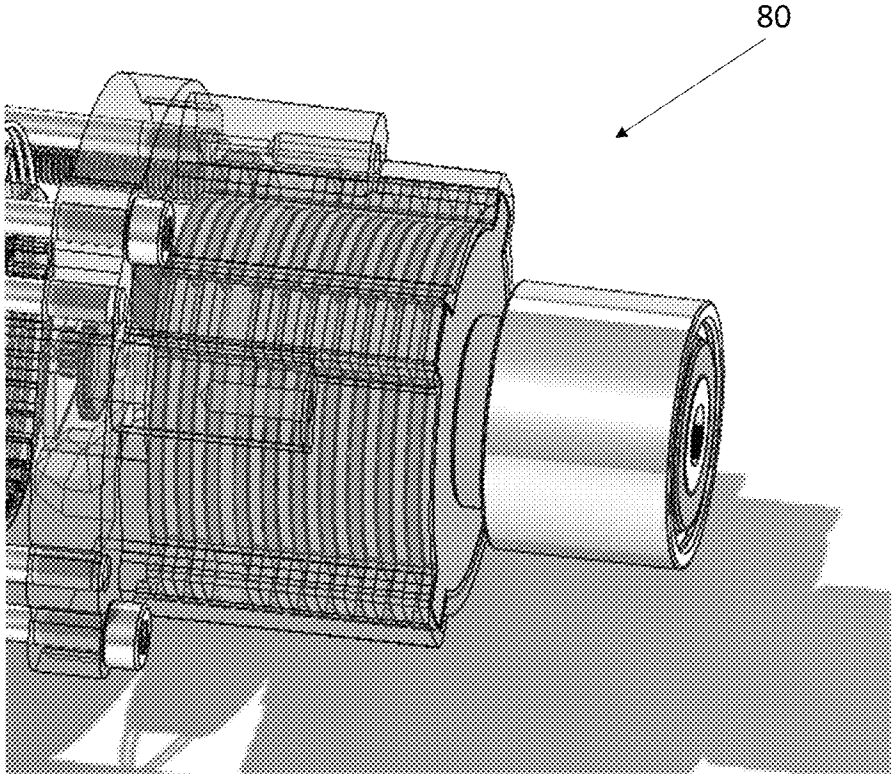
FIG. 30 schematically shows a damping system in accordance with illustrative embodiments.

FIG. 30 schematically shows a damping system 80 in accordance with illustrative embodiments. The damping system 80 is preferred in order to slow the self-lifting of the seat 1 as the booster spring unit 62 and main spring unit 66 self-lift the seat 1 to the up position 48. In the present embodiment, this damper 80 consists of parallel plates, consecutively stacked such that one plate is fixed to the damper housing and the next plate is fixed to the rotating axle 7. The space between each plate is filled with grease, and thus a rotary shear damper is created. Any other damping method is acceptable, such as linear damper 19, and it is preferable that the damping occurs only during the rotation that causes the seat 1 to self-lift, so that the user does not have to fight the damper system 80 to user-lower the seat 1.

It should be understood that the above-described gear mechanism describes one specific mechanism that works to achieve the claimed functionality. There are alternative embodiments that may work as well. For example, in the present embodiment, the seat 1 latches itself due to a torque imbalance between the main spring unit 66 and the seat 1. Alternatively, the main spring unit 66 could be a bistable spring, which rather than simply slowly reducing its torque, changes the directionality of its torque at a point during the lowering of the seat 1. Alternatively, a magnetic hold down mechanism can be used, as well as a physical latching mechanism. A variety of mechanical latches can be implemented.

In some embodiments, the time delay is achieved via an air damper at the end of a long gear train. A standard rotary or linear damper, a leaky shock absorber, a friction damper, among other options, may be used as well. The presented gear train can be modified as well. A worm gear configuration, a cycloidal gearing configuration, and many others are also possible. The gear ratio can be changed as well in order to change the duration of the time delay of the delay system 54. Also, there is no real winding of a timer occurring in the current embodiment, rather just a driving and non-driving phase. This could be reconfigured, such that the timer is sprung itself, rather than having the booster spring unit 62 driving the entire mechanism externally. However, one could consider the booster spring 62, and everything downstream to be a single timer unit as well, and thus in that case, the timer does get wound by the main spring unit 66.

Some embodiments couple the booster spring unit 62 to the main spring unit 66 in a way that allows the seat 1 to be user-lifted and have no effect on the delay system. The dog type coupling (63, 67) is preferred for this reason, however, if someone lifts the seat prematurely, the timer will not immediately return to its original state, and will have to run down as before. This may not be preferable in some instances, and as such, alternative linkages may be used. A barrel cam type linkage, a four-bar linkage, and many others not listed here may be used in advantageous configurations as well.

Figure 31A:
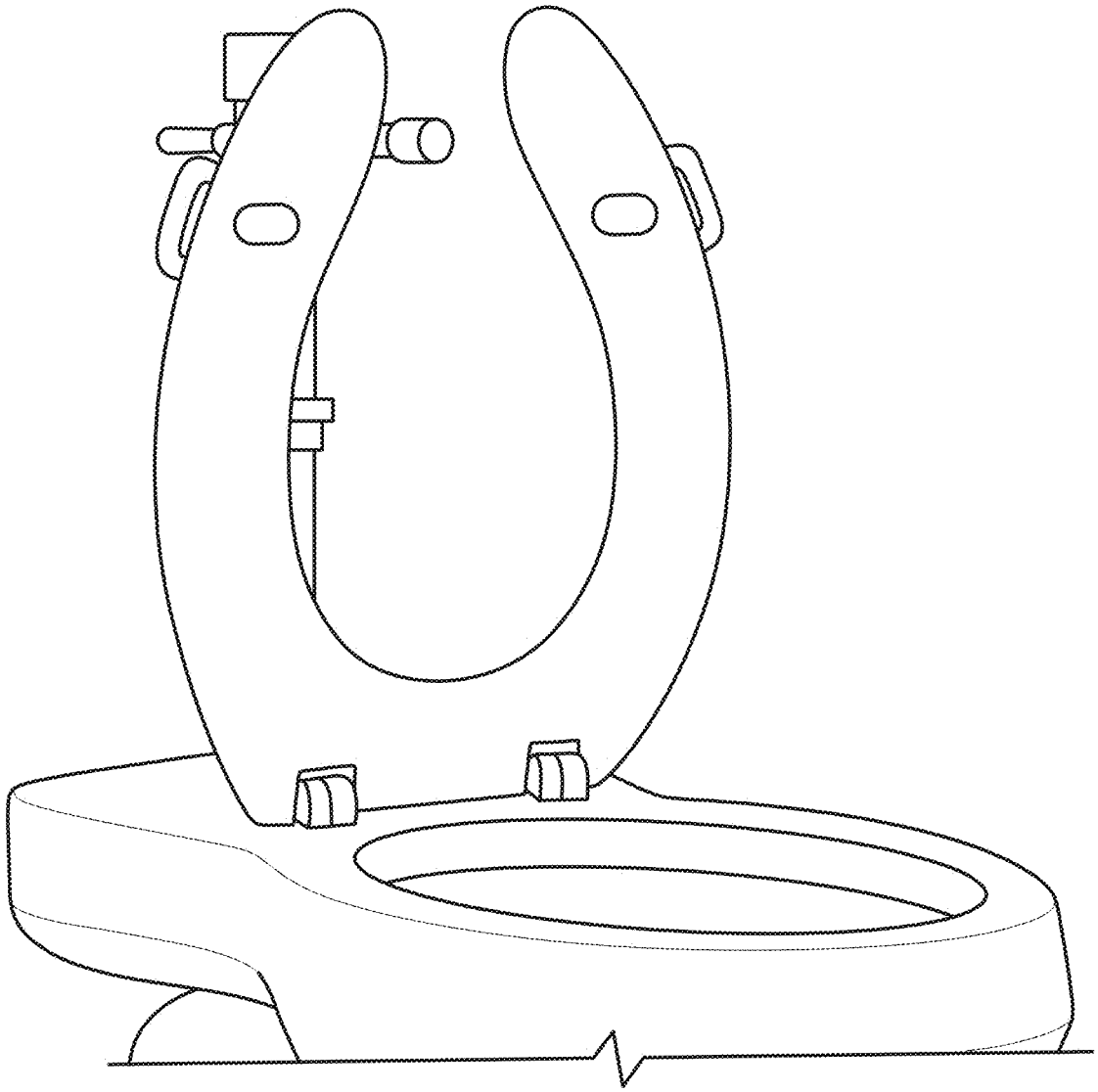
FIG. 31A schematically shows a toilet seat in accordance with illustrative embodiments of the invention.

FIG. 31A schematically shows an alternative embodiment of the self-lifting toilet seat system 100 in accordance with illustrative embodiments of the invention. In various embodiments, a liquid moving under the force of gravity shifts the center of mass of the seat, causing the seat to rotate towards or away from the down position. Various embodiments may use a combination of mechanical elements, including a spring-loaded 9 hinge and liquid flow channels. Some embodiments may include a pneumatic lifter to augment or replace the spring-loaded hinge 9 and liquid flow channels (e.g., 81-87). It will also be appreciated that other means of displacing the center of mass of the seat may be used, such as a counterweight system. However, illustrative embodiments using the spring-loaded hinge 9 and liquid flow channels advantageously provide reduced complication and expense in achieving the system of claim 1.

As will be discussed in greater detail below, the delay system 54 expiration time may be modulated using a controlled flow of liquid 89 to temporarily counterbalance the self-lifting torque provided by the spring 9 of the lifting system 52 to provide a time delay before the seat 1 starts to rise. This liquid-based delay system 54 may provide a simple and passive embodiment of the self-lifting toilet seat system 100. The present disclosure is therefore free of the complications of electrical or hydraulic controls, that may provide a fixed time delay, and that may require no user interaction to raise the seat (e.g., such as pressing a foot-activated switch). Accordingly, various embodiments may provide a passively activated mechanism.

Figure 31B:
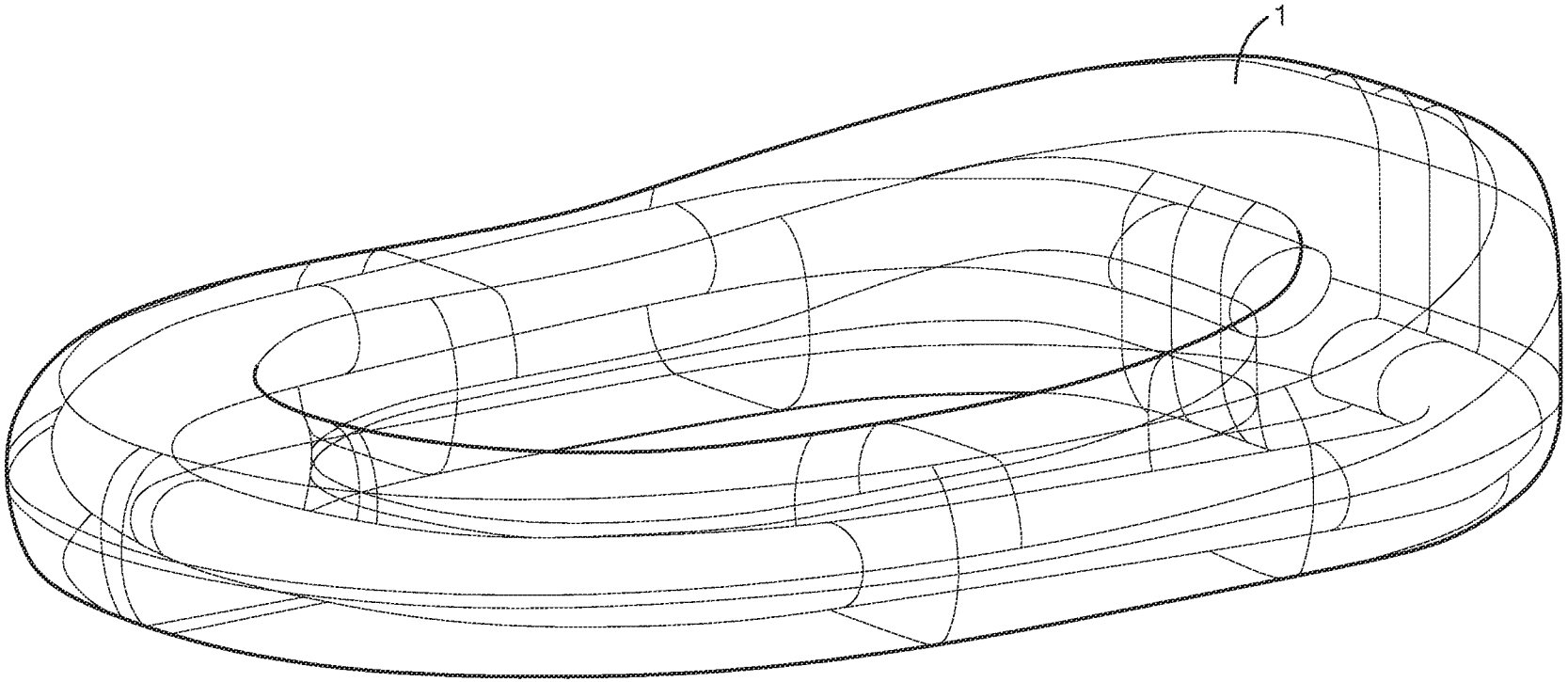
FIG. 31B schematically shows a partially transparent toilet seat with internal channels and chambers for liquid flow in accordance with illustrative embodiments of the invention.

FIG. 31B schematically shows a partially transparent toilet seat 1 with an internal flow loop for liquid flow in accordance with illustrative embodiments of the invention. In some embodiments, and as shown in FIG. 32, the internal flow loop may include a starting chamber 81, forward flow channel 82, frontal holding chamber 83, return flow channel 85, recovery chamber 86, and reset channel 87.

The toilet seat includes a liquid-controlled delay system 54. Illustrative embodiments may provide a method and apparatus to delay the self-lifting action of the seat 1.

Figure 32:
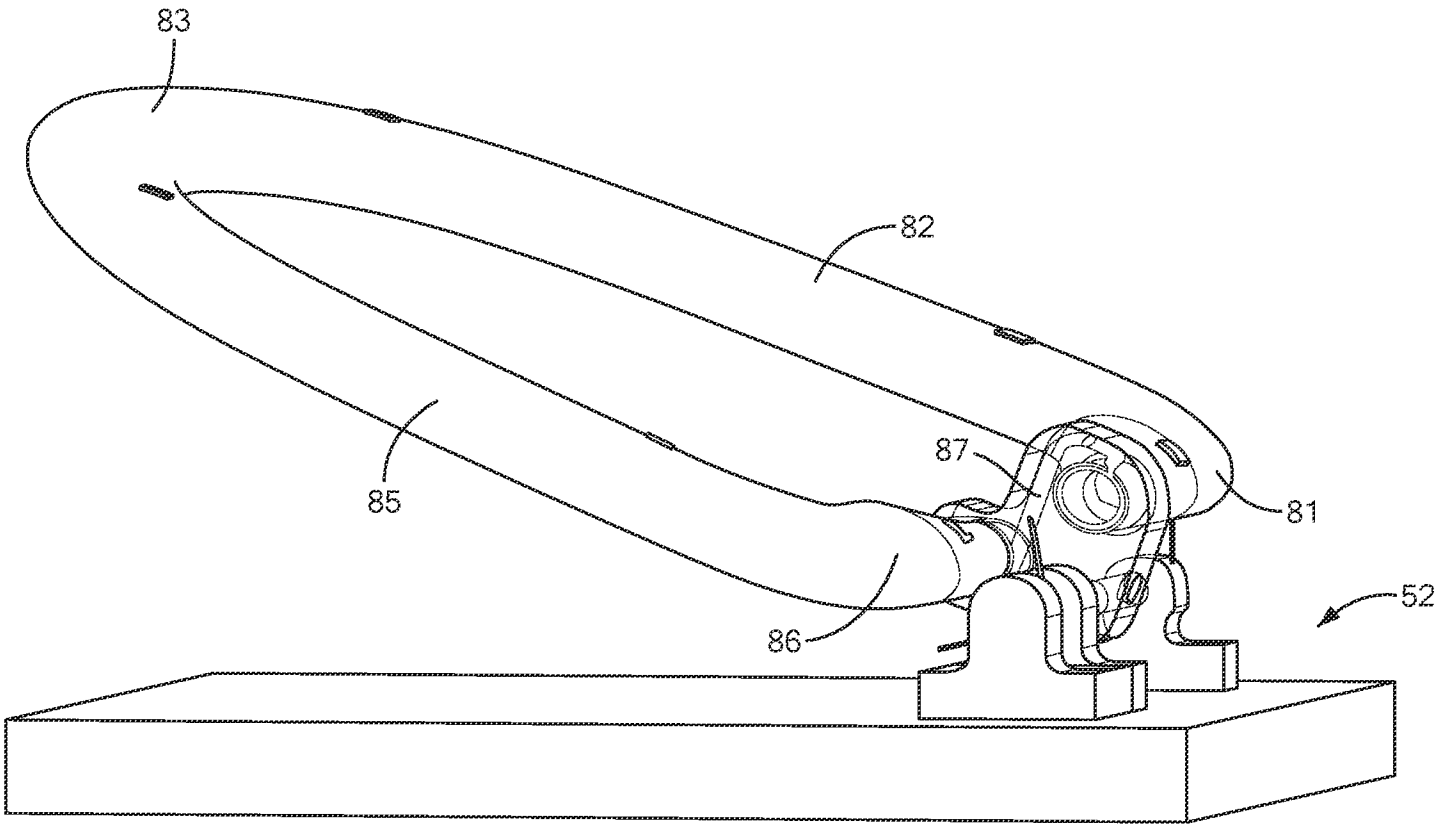
FIG. 32 schematically shows a detailed view of the self-lifting toilet seat mechanism in accordance with illustrative embodiments of the invention.

FIG. 32 schematically shows a detailed view of the self-lifting toilet seat system 100 in accordance with illustrative embodiments of the invention. The lifting system 52 may be positioned within the hinge housing 3 of the toilet seat 1 or within the toilet seat 1 itself (e.g., within the transparent housing shown in FIG. 31B).

Figure 33A:
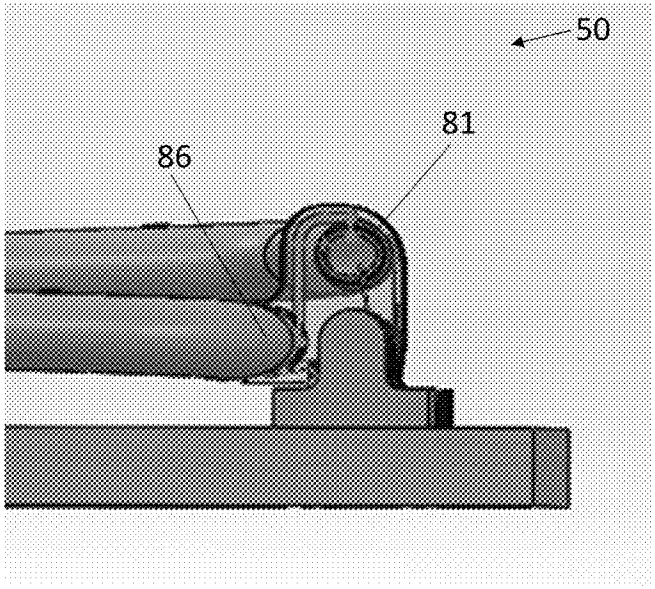
FIG. 33A schematically shows the relative positions of the starting chamber and the recovery chamber of FIG. 32 when the seat is in the down position in accordance with illustrative embodiments of the invention.

FIG. 33A schematically shows the relative positions of the starting 81 and recovery 86 chambers when the seat 1 is in the down position 50. The starting chamber 81 is offset vertically with respect to the recovery chamber 86. This difference in elevation creates a driving force for liquid 89 flow away from the hinge towards the front of the seat when the seat 1 is user-lowered.

Figure 33B:
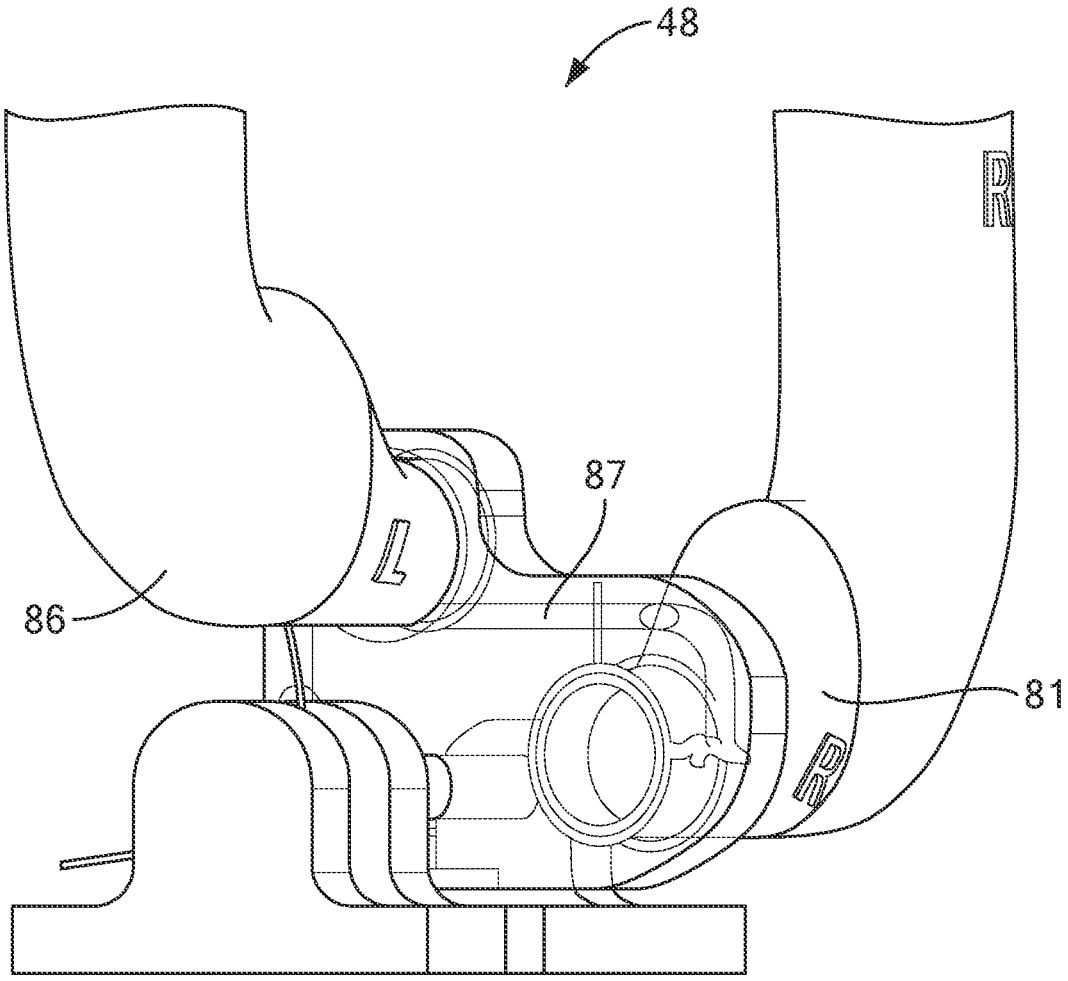
FIG. 33B schematically shows the relative positions of the starting chamber and the recovery chamber of FIG. 32 when the seat is in the up position in accordance with illustrative embodiments of the invention.

FIG. 33B shows the relative positions of the starting 81 and recovery 86 chambers when the seat 1 is in the up position 48. The relative positions of the two chambers are reversed, with the recovery chamber 86 now higher than the starting chamber 81. This elevation difference in this position creates a driving force for the reset flow through the reset channel 87.

In the present disclosure, the liquid flow loop (e.g., 81-87) is integrated into the seat 1, and is partially filled with a liquid 89 (e.g., water with sterilizers and surfactants). The speed of the flow of this liquid 89 forward or backward through the channels of this loop, depending on the position of the seat 1, provides the desired delay of the delay system 54 in self-lifting of the seat 1. It will be appreciated that there are many other liquids 89 that may be used. In various embodiments, the system may include, among other things:

- A toilet seat hinge 46 with attachment blocks of substantially conventional dimensions that allow the seat to be bolted to the main body of the toilet bowl 44.
- A lifting spring 9 that is near the axle 7 of the hinge 46. The strength of the spring 9 is just sufficient to lift the seat from the down position 50 when the front of it is empty of a sufficient mass of liquid 89. In preferred embodiments, the spring 9 may be a coil spring concentric with the axis of the hinge 46, or a linear spring on a lever arm.
- A toilet seat 1 of substantially conventional shape with internal channels that form a flow loop substantially within the seat 1. In illustrative embodiments, the internal channels do not extend past the dimensional envelope of a conventionally sold commercial or residential toilet seat 1, as illustrated for example in FIG. 31B. The channels are angled with respect to a horizontal plane as described below (FIGS. 34 and 35) so as to allow the flow of the liquid 89 forward or backward depending on the orientation of the seat 1.

The self-lifting toilet seat 1 of the present disclosure may incorporate one or more complete flow loops as required for different applications. For applications requiring a full circular design (most commonly seen in residential bathrooms), a single flow loop would be preferred as shown in FIG. 32. For applications requiring a gap at the front (e.g., commercial bathrooms) the use of two complete and independent flow loop systems would be preferred, as illustrated in Figures Some embodiments include:

One or more liquid flow loops located substantially within a toilet seat 1 of substantially conventional shape.

Two sections of the internal liquid flow loop that form a starting chamber 81 and a recovery chamber 86.

Another section of the internal liquid flow loop that forms a front holding chamber 83.

Two sections of the internal liquid flow loop that form a forward flow channel 82 and a return flow channel 85 (FIG. 44).

A reset channel 87 (FIGS. 40 and 44) that allows flow from the recovery chamber 86 to the starting chamber 81 when the seat 1 is in the up position 48. An entry port 88 of this reset channel 87 may be elevated so as to prevent backflow to the recovery chamber 86 when a user begins self-lowering the seat 1 (FIGS. 40 and 53).

A quantity of liquid 89 in the liquid flow loop. The liquid 89 may be water, and/or may contain a surfactant and anti-bacterial agent.

A flow constriction element 84 located in the flow channel between the front holding chamber 83 and the recovery chamber 85 as shown in FIGS. 36 and 49A-49B. The flow constriction element 84 may include a flow restriction orifice of substantially circular or rectangular cross-section. The cross-sectional area of the flow constriction 84 is set (or determined by experiment, FIG. 37) to provide the desired pre-determined delay time (typically 5 to 60 seconds depending on the application) before the seat 1 self-lifts after the user-applied pressure is removed from the seat 1.

A device such as a polymeric bumper, which may be incorporated into seat nubs 5 that serves to partially self-lift the seat 1 to the neutral state 49A (when downward pressure is released by the user) and initiate the delay system 54.

An optional damper element 19, 80 to control the rise rate of the seat 1 as it self-lifts and stop the seat 1 from heavily impacting the rear area of the toilet bowl as it self-lifts to the up position 48.

The above components may be configured so as to provide a self-lifting toilet seat system 100 of simple construction and operation that provides a delay system 54 to delay self-lifting of the seat 1 so as to prevent secondary contact with the user as the toilet seat 1 self-lifts.

It should be appreciated that the illustrative embodiments may be used as replacements for existing toilet seats 1. Toilet seats 1 are attached to the main body of the toilet bowl 44 by two simple bolts, spaced 5.5" apart (an industry standard). The present disclosure may be mounted the same way, and thus be retrofittable to virtually all existing toilet bowls 44.

It will be appreciated that any configurations of the above elements which provide the described functionality will not significantly deviate in look, size, and shape from a standard commercially or residentially sold toilet seat. The conformity of various embodiments of the toilet seat system 100 to a standard commercial toilet seat 1 is shown in the comparison of FIGS. 47 and 48.

It will be appreciated that similar elements, or elements that may perform similarly to those listed above may be used without departing from the scope of the present disclosure. Furthermore, in various embodiments, some or all of the components listed above may be modified and/or are optional. Furthermore, some components listed in the singular may include one or more of the components.

FIGS. 34-36 schematically show a process of activating the delay system 54 in accordance with illustrative embodiments of the invention. FIG. 34 schematically shows the seat 1 in the down state 50A in accordance with illustrative embodiments of the invention. In this position the flow channels are angled slightly downward to enable liquid to flow from the starting chamber 81 towards the frontal holding chamber 83.

To describe the operation of the self-lifting seat system 100, it may be assumed the seat 1 is initially in the up position 48. To start the process, a user grasps the seat 1 (or a handle 2 on the seat, or a foot peg) and self-lowers it downwards into a down position 50 shown in FIG. 34. As the seat approaches the down state 50A, liquid 89 from the starting chamber 81 may flow relatively quickly (over a period of about 0.5 to 2 seconds) towards the front of the seat 1 to the frontal holding chamber 83 due to the inclination of the forward flow channel 82 and the action of gravity. The mass of liquid 89 that becomes concentrated towards the front of the seat 1 creates a torque sufficient to counteract the self-lifting torque of the spring 9 of the lowering system 52. This allows the seat 1 to remain (temporarily) in a down position 50 providing the user enough time to sit down on the seat 1 without the annoyance of having it begin self-lifting too early. Additionally, as there is no physical latch holding the seat 1 in the down position 50, the user is able to easily self-lift the seat 1 into the up position 48 at any point during the operation of the seat 1.

In various embodiments, when the user stops applying downward pressure on the seat 1, and before sitting down, the seat will move to the neutral state 49A, and thus self-lift slightly (preferably about 0.5 to 2.0 inches above the rim of the toilet bowl). In this embodiment, self-lifting to a very specific neutral state 49A is necessary to ensure the channels end up at the correct orientation to promote fluid flow. Thus, an elastomeric (e.g., rubber or other material) bumper may be advantageously positioned near the hinge 46, or as part of the nubs 5 such that it self-lifts the seat 1 to the desired neutral state 49A at the point where the bumper is in the uncompressed state.

In the neutral state 49A of FIG. 35, the liquid-based delay system 54 is activated. The neutral state 49A changes the inclination of the return channel 85 so that liquid 89 begins to flow back to the recovery chamber 86 through a flow orifice 84 as shown in FIG. 36. When a sufficient quantity of liquid 89 is thus transferred to the recovery chamber 86 at the rear of the seat 1, the liquid 89 remaining in the front holding chamber 83 will no longer be sufficient to overcome the self-lifting torque of the spring 9, and the seat 1 begins to self-lift. Thus, the time delay refers to the delay before the seat begins to self-lift towards the up position 48, not necessarily the total time it takes for the seat 1 to reach to up position 48.

The delay system 54 delay time of this mechanism is determined by a number of engineering factors, including the rate of liquid 89 return flow. In general, higher rates of liquid return flow are associated with shorter delay times and vice-versa. In some embodiments, the rate of liquid 89 flow (and hence the delay time) is set in the system by a flow constriction of limited area 84 (effectively a small orifice) positioned between the front holding chamber 83 and the recovery chamber 85, as shown for example in FIGS. 36 and 50.

FIG. 37 shows a chart of measured and extrapolated time delay data plotted against a cross-sectional area of a flow constriction orifice 84 of rectangular cross section. In this case, a constriction area of, for example, 4 square millimeters ($mm^2$), would produce a delay time of about 50 seconds. A larger area of 12 $mm^2$ would produce a delay time of about 10 seconds.

It will be appreciated that while the present disclosure is discussed with a toilet seat 1 to provide a time delay of from 1 to 120 seconds (with a preferred range of 5 to 60 seconds), other delay times may be used without departing from the present disclosure (e.g., up to several minutes if desired).

FIG. 38 schematically shows a rotary damper 19 in accordance with illustrative embodiments of the invention. The rotary damper 19 may be connected to the shaft 7 of the toilet seat hinge 46 by means of connecting gears.

As the liquid 89 drains from the front holding chamber 83 and the seat 1 starts to self-lift, there may be cases in which the seat self-lifts too rapidly due to the action of the lifting system 52 (E.g., spring). To control the self-lift rate, a damper 19 may be used.

FIG. 39 schematically shows the seat in the up position 48 in accordance with illustrative embodiments. In this position, the recovery chamber 86 is offset vertically with respect to the starting chamber 81 to provide a driving force for reset flow to the starting chamber 81 in preparation for the next cycle.

FIG. 40 schematically shows a close-up view of the liquid reset channel 87 that connects the recovery chamber 86 with the starting chamber 81 in accordance with illustrative embodiments. In this view, the seat 1 is in the down position 50. When the seat 1 is later self-lifted to the up position 48, liquid 89 from the recovery chamber 86 will pass through this reset channel 87 to the starting chamber 81 in preparation for the next cycle.

A 3-dimensional geometric arrangement of the recovery 86 and starting chambers 81 may be employed such that when the seat 1 is in the down position 50, the elevation of the starting chamber 81 is higher than that of the recovery chamber 86 (FIG. 33A); and when in the up position 48, the relative elevations are reversed such that the elevation of the recovery chamber 86 becomes higher than that of the starting chamber 81 (FIGS. 33B and 39).

An example feature of this design is that the flow from the reset channel 87 may enter the starting chamber 81 through an elevated port 88. The shape of this port 88 may form an inverted "J", as shown in FIG. 40. The elevated port 88 may not affect the reset flow when the seat 1 is in the up position 48, but it provides an effective means of preventing the backflow of liquid to the recovery chamber 86 that would otherwise occur when the seat is subsequently lowered to the down position 50 at the start of the next cycle of usage.

Illustrative embodiments provide a liquid based delay system 54 to achieve a time delay before the seat 1 self-lifts to the up position 48. As described above, the delay system 54 may begin when the downward force from the user on the seat 1 is released, the seat self-lifts to the neutral state 49A, thus having an initial self-lifting amount (e.g., 0.5 to 2 inches). The initial self-lifting initiates the flow of liquid 89 from the front of the seat 1 towards to hinge 46 though a small opening 84(or orifice). Like the neck of an hourglass, the size of the orifice controls the flowrate.

The overall delay system 54 timing may be set by the size of the orifice 84 and the quantity and viscosity of liquid 89 that flows. This "transfer quantity" is the amount of liquid 89 that shifts the center of gravity sufficiently to counteract the torque of the self-lifting spring 9. The transfer quantity will vary for different applications, as can be determined by straightforward methods by those skilled in the art. In general, the transfer quantity is a function of variables such as the torque of the spring 9, density of the liquid 89, and the displacement over which the liquid 89 flows front-to-rear as the seat 1 moves through its cycle.

Various embodiments of the liquid flow loop of the self-lifting toilet seat system 100 may include:

- One-Way Rotary Dampers: As mentioned previously, the rotary dampers 19 used in illustrative embodiments may be one-way dampers. They may be oriented such that they provide effective damping only as the toilet seat 1 is self-lifted and no damping (or very low damping) as the toilet seat is user-lowered. Dampers 19 should not affect the force distributions about the hinge 46, but rather just slow the motion of the seat 1.
- Handles or foot-pegs: The toilet seat used in various embodiments may incorporate one or two handles 2 or one or two foot-pegs to enable the user to user-lower the seat 1 without touching the main body of the seat 1.
- Top Stop: The housing structure used in various embodiments may provide a positive stop to the upward motion of the seat at the up position 48. The stop prevents the seat 1 from rotating too far as it self-lifts.

Furthermore, various embodiments may use a variety of liquids 89. It should be understood that the higher the liquid 89 density, the less volume is needed to sufficiently change the torque of the seat 1 to overpower the lifting system 52. Water is the preferred liquid 89 because it has relatively high mass density, is non-toxic, and inexpensive. Water is also non-permeable through most plastic materials used in the fabrication of toilet seats 1. In some embodiments, an anti-foaming agent or surfactant may be added to the water to decrease the liquid surface tension, and a disinfectant may be added to keep bacteria from proliferating inside of the seat 1.

Some embodiments may further use the liquid 89 itself to help self-lift the toilet seat (e.g., in addition to, or as an alternative to, the spring 9 of the lifting system 52). Various embodiments position the recovery chamber 86 some distance behind the axle 7 of the toilet seat hinge 46. With such a positioning, the mass of liquid 89 entering the recovery chamber 86 provides a torque to add to the torque provided by the spring 9 of the lifting system 52. In such embodiments, however, it is envisioned that the recovery chamber 86 extends outwardly from the side of the toilet seat 1 in order to provide sufficient clearance between the seat 1 and the toilet bowl base 44, so as to enable the full range of angular motion of the seat 1.

- Use with open front toilet seats 1: In some embodiments, the delay system 54 of the present disclosure may be used in the toilet seat 1 with an open front, as required for use in many commercial applications and shown in FIG. 47. In such implementations, the flow channels 82 and 85 that connect the starting 81 and recovery chambers 86 to the frontal holding chamber 83 may both be incorporated along the same side of the seat 1 (left or right side). In other implementations, there may be two such pairs of channels, one pair running along the left side and the other along the right side of the seat 1.

It will be appreciated that one or more components may be optional without departing from the scope of the present disclosure. Furthermore, it will be appreciated that although illustrative embodiments operate with toilet seats 1 having a gap, some other embodiments may have a toilet seat 1 without a gap.

FIG. 41 schematically shows a split open view of an internal channel geometry in accordance with illustrative embodiments. Here, the toilet seat 1 has a gap at the front (FIG. 31A), as compared to a closed front design (FIG. 31B). The gap towards the front of the seat complies with the regulatory (ADA and IPC) codes. The single liquid flow loop of the previous design has been reallocated to two separate sides of the seat 1, with one complete loop on each side of the gap. In some embodiments, these two loops are completely separate, each as a closed environment to themselves (Thus, there is no mixing of liquid 89 between the two loops). In other embodiments, the two loops may share a common starting 81 and/or recovery chamber 86.

FIG. 42 shows a transparent view of the toilet seat 1 in accordance with illustrative embodiments. The gap model is more robust compared to the single flow loop used in the closed seat design, as there is less volume in the frontal holding chamber 83 for liquid 89 to slosh back and forth. This sloshing motion could cause the seat 1 to temporarily bounce up and down when first lowered by the user, thus forcing the user to continue applying a force to the seat 1 for some additional time until the liquid 89 motion subsides. With the reduced volume, it is expected that the seat 1 becomes steady (while held in the down state 50A) within 1 second or less under most circumstances.

FIGS. 43A-43B shows a cross-sectional view of the front holding chamber 83 of FIG. 41, in which the toilet seat 1 has an open front.

FIG. 44 provides a cross-sectional view of the two independent flow loops that may be used in some embodiments. In the figure, liquid 89 is shown in one of the starting chambers 81 with the seat 1 in the up position 48. In this position, the seat is prepared for a user to begin lowering the seat 1.

FIG. 45 schematically shows a side view with a curved line from the starting chamber 81 to the frontal holding 83 chamber in accordance with illustrative embodiments. The shape of the forward flow channel 82 of the toilet seat 1 may approximate a "curve of maximum descent" (also known as a Brachistochrone curve), which is shown as the blue curve in the figure. The advantage with this shape is that the liquid 89 in the starting chamber 81 flows more quickly to the frontal holding chamber 83 when the seat 1 is lowered, which minimizes the time that the seat 1 is held down by the user before the delay system 54 is active.

FIG. 46 schematically shows a cut open view of the toilet seat 1 in accordance with illustrative embodiments of the invention. As shown, the internal flow loop may be shaped to conform within the shape of the seat 1. This provides a consistent wall thickness that benefits the molding process that may be used in the manufacture of the commercial seats. For those familiar with the injection molding process, it is well known that a consistent wall thickness provides dimensional stability for the finished articles (i.e., minimal shrinkage and warping on cooling). A consistent wall thickness also reduces the amount of plastic required to fabricate the seat 1 as well as the weight of the finished article.

FIG. 47 schematically shows a top view of an industry standard shaped toilet seat 1. FIG. 53 schematically shows a top view of the toilet seat 1 in accordance with illustrative embodiments of the invention. As seen in the comparison, illustrative embodiments have a similar shape to existing toilet seats land may be retrofitted onto existing toilets 40.

Various embodiments may be manufactured using a variety of methods. For example, a clamshell method may be used, where top and bottom portions of the seat 1 are molded separately, and then bonded together to create a finished seat 1. Other methods include over-molding, where the internal flow channels are formed to the correct shape in a blow molding process, and then over-molded with a second plastic to form a completed seat 1. Yet another method may include a sandwich method, which is a combination method in which blow molded internal channels are enclosed within (separately molded) top and bottom portions of an outer shell.

FIGS. 49A-53 schematically show the liquid-flow 89 process of using the toilet seat 1 in accordance with illustrative embodiments. It may be noted that this process is greatly simplified from a longer process that normally would be used to use the self-lifting toilet seat. Accordingly, the process of self-lifting the toilet seat 1 likely has many steps that those skilled in the art likely would use. In addition, some of the steps may be performed in a different order than that shown. Additionally, or alternatively, some of the steps may be performed at the same time, or skipped entirely. Those skilled in the art therefore can modify the process as appropriate.

FIG. 49A shows the seat 1 in the down state 50A with pressure applied by the user. This pressure may be hand-applied pressure applied by the user (prior to sitting down), or it may be the weight of the user when sitting on the seat 1. In this state, liquid 89 from the starting chamber 81 flows by gravity towards the front of the seat 1 through the forward flow channels 82 and accumulates in the front holding chamber 83. In the down state 49A, the frontal holding chamber 83 is vertically lower than either the starting chamber 82 or the recovery chamber 86. Thus, the liquid 89 remains pooled in the frontal holding chamber 83 due to gravity until user pressure is removed from the seat.

In some embodiments, the forward flow channel 82 or the front holding chamber 83 may contain one or more baffles 90 to limit the rate of flow of liquid 89 through the forward flow channel 82 as the seat 1 is lowered for use by the user. Such baffles 90 have been found desirable for use in some embodiments to prevent excessive sloshing of the liquid 89 as it rushes forward through the forward flow channel 82 into the front holding chamber 83. It has been found that, in some cases, such sloshing of liquid 89 can cause an undesirable bouncing of the seat 1 up and down after it is first lowered for use.

FIG. 49B shows the seat in the neutral state 49A after the user-applied pressure is removed, such as when the user stands up. In this position, the delay system 54 is active, and the seat 1 is temporarily prevented from self-lifting due to the weight of liquid 89 contained in the front holding chamber 83. In this condition, the weight of liquid 89 in the front holding chamber 83 is sufficient to overcome the self-lifting torque of the spring 9 of the lifting system 52.

With the seat in the neutral state 49A, the liquid 89 in the front holding chamber 83 begins flowing (relatively slowly) through a flow limiting orifice 84 to a recovery chamber 86 located near the hinge 46 of the seat 1, as illustrated in FIG. 50. When a sufficient quantity of liquid 89 has been transferred from the front of the seat to the recovery chamber 86, the torque of liquid 89 remaining in the front holding chamber 83 becomes insufficient to counteract the self-lifting torque of the lifting system 52, and the seat 1 self-lifts to the up position 48, FIG. 51. The duration of the delay system 54 is thus controlled by the rate of flow, and hence the size of the flow-limiting orifice 83.

If the seat 1 is user-lowered to the down state 50A before enough liquid 89 has flowed from the frontal holding chamber 83 to the reset chamber 86 in order to allow the lifting system 52 to self-lift the seat, then the liquid 89 will flow back into the frontal holding chamber 83. The vertical displacement of the frontal holding chamber 83 relative to all the other channels when the seat 1 is in the down state 50A is the driving reason behind this "reset" flow. Thus, the delay system 54 may be reset by the application of user force to the seat 1.

FIG. 52A shows the liquid 89 accumulation in the recovery chamber 86 immediately after the seat 1 rises to the up position 48. Because of the elevated position of the recovery chamber 86 with respect to the starting chamber 81, a "reset" flow of liquid is enabled through a reset channel 87 to the starting chamber 81 in preparation for the next cycle of use. The liquid 89 pools or rests in the starting chamber 81, as shown in FIG. 52B.

FIG. 53 is a rear cutaway view showing liquid 89 in the starting chambers 81 immediately after the seat 1 is lowered for the next cycle of use. Because the entry ports 88 from the reset channels 87 are elevated with respect to the starting chambers 81 (as shown), liquid 89 is prevented from back-flowing into the recovery chamber 86, and is therefore forced to flow, as intended, towards the frontal holding chamber 83 at the front of the seat.

It should be understood that various embodiments provide a number of advantages. Illustrative embodiments advantageously eliminate the need for side tanks employed in prior art implementations of the liquid displacement method. Furthermore, various advantages include that the system may prevent the seat 1 from self-lifting as soon as the seat is user-lowered. Various embodiments do not require user interaction to self-lift the seat 1 after use (e.g., the system 100 may be passive), thereby reducing the likelihood of future users soiling the seat. Furthermore, various embodiments provide a simplified and elegant solution that does not involve complicated electronic components that are costly and vulnerable to durability-related failure. Aesthetically, the toilet seat 1 may appear similar to an ordinary toilet seat, without requiring the use of a large gearbox or other lifting system 52 that cannot fit into the hinge 46 of the product. In some embodiments, the toilet seats 1 are retrofittable to standard toilets 40 because by having industry standard mounting points. Thus, some embodiments may simply provide a retrofittable toilet seat 1(as opposed to an entire toilet system).

As mentioned at the beginning of the disclosure, another embodiment of the toilet seat system 100 exists wherein the lifting system 52 becomes a lowering system 52. The lifting system 52 and/or delay system 54 may be flipped in orientation, such that the delay system 54 is engaged when the seat 1 is in the up position 48, and the lifting system 52 is instantiated as a lowering, rather than lifting, system. The lowering system 52 may be preferred in the home and residential environments, where a user may be more likely to user-lift the seat 1 to urinate, but then fail to user-lower the seat 1 after use. Thus, in some embodiments, when the seat is user-lifted to the up position 48, the suction cups 13 engage and hold it in the up position 48 for anywhere from 1 second to 5 minutes, after which the delay mechanism 54 disengages, and a lowering system 52 self-lowers the seat 1 into the down position 50. The user may reset the time delay at any point in the cycle by simply user-lowering the seat to the down position. A damping system (e.g., 19, 80) may be added to prevent the seat 1 from slamming into the toilet bowl 44 upon self-lowering, such as a one-way rotary damper.

As with the suction cup 13 and plate 14 self-lifting embodiment, it should be understood that the position and/or dimensions of the plate 14, as well as the internal linkages (e.g., 10,11,12), position, and size of the suction cup 13 may be tuned to engage at any point along the transition of the seat 1 from the down position 50 to the up position 48 of the self-lowering embodiment.

In the illustrative embodiments, the up position 48 is a general callout to the location of the seat 1, regardless of system states. In various embodiments, in the up position 48, the bottom plane of the seat 1 is substantially perpendicular to the top plane of the bowl 44 (e.g., vertical or at an acute angle to vertical—about 80-115 degrees from the down position).

The down position 50 is a general callout to the location of the seat 1, regardless of system states. In the down position, the bottom plane of the seat 1 is substantially parallel to the top plane of the bowl 44 (e.g., about −15 degrees to about 25 degrees from horizontal). For self-lowering configurations, in the down position 50, the seat 1 is at its resting position unless an outside force is applied (e.g., by a user sitting or lifting the toilet seat 1).

In the up state 48A a user force is applied sufficient to hold the seat 1 in the up position 48. In the up state 48A, the delay system 54 is engaged, and the time delay begins right after or concurrently with the toilet seat 1 entering the neutral state 49B (e.g., after the user removes their applied force from the toilet seat 1). In various embodiments, the time delay 54 may be reset or paused by the user forcing the seat back to the up state 48A.

In self-lowering embodiments, the neutral state 49B is the state of the seat 1 after the seat 1 has been user-lifted to the up state 48A and there is no more user applied force to the seat 1. In the neutral state 49B, the user force is removed and the delay system 54 applies a force to hold the seat 1 in the up position 48 until a predetermined time delay expires. The delay system 54 temporarily prevents the lowering system 52 from self-lowering the toilet seat 1 to the down position 50. The angular location of the seat 1 about hinge 46 relative to the top plane of the bowl 44 with such a loading case is the neutral position. Although still considered to be in the up position 48, the neutral state 49B may, in some embodiments, have an angular offset of between about 0 and about 20 degrees from the position of the toilet seat in the up state 48A.

For illustrative embodiments configured to be self-lowering, the seat 1 may be either in the neutral state 49B or the up state 48A and still considered to be in the up position 48. For the self-lowering toilet seat system 100, the seat is "self-lowered" when the lowering system 52 applies a force sufficient to transition the seat 1 from the up position 48 to the down position 50. When a user lifts the seat 1 from the down position 50 and forces it to the up state 48A, this is referred to as "user-lifting" the seat.

Figure 15:
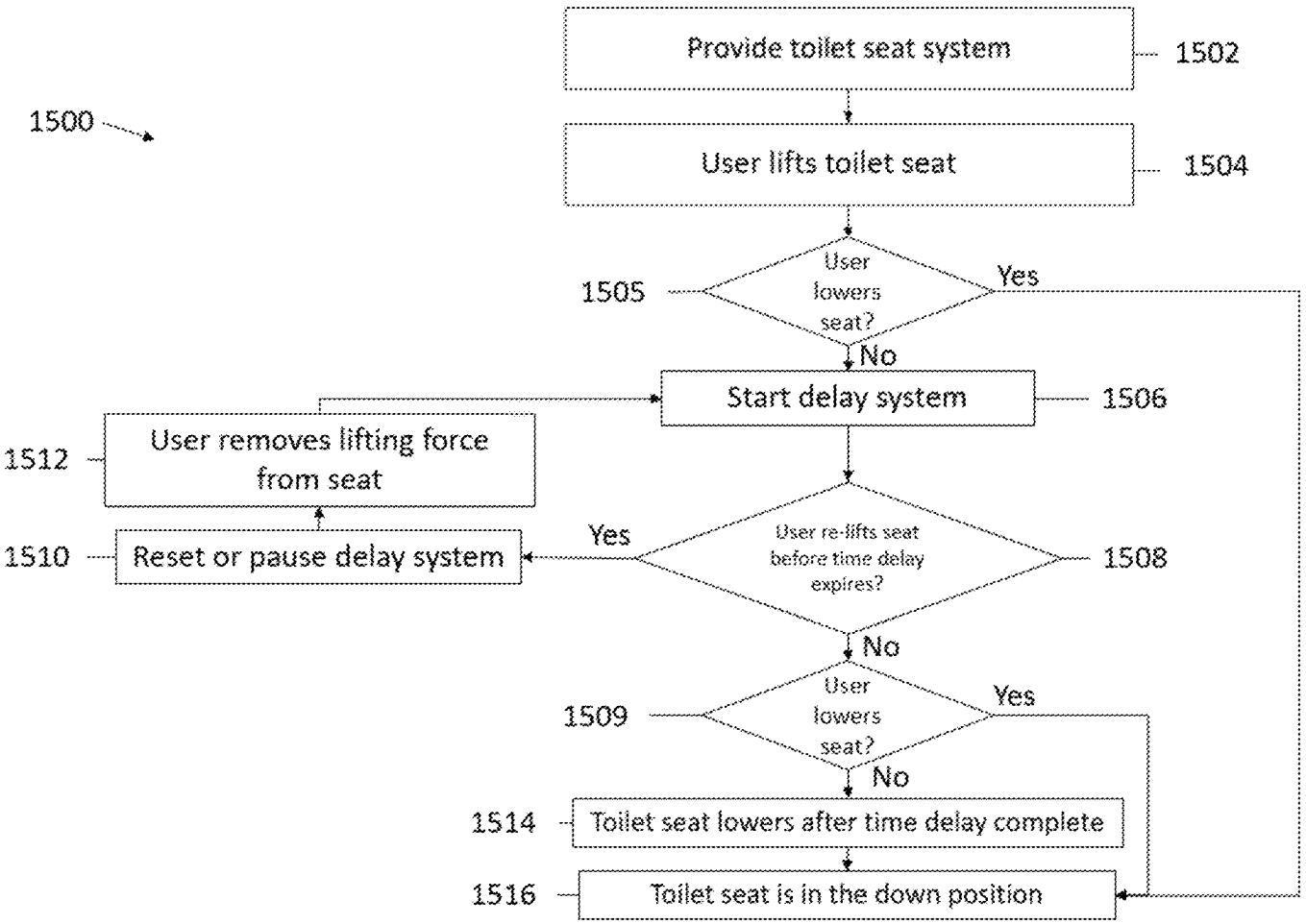
FIG. 15 shows a method of self-lowering a toilet seat in accordance with illustrative embodiments of the invention.

FIG. 15 shows a process of self-lowering the toilet seat 1 in accordance with illustrative embodiments of the invention. The process begins at step 1502, which provides the toilet seat system 100 as described herein. In various embodiments, the toilet seat system 100 includes the toilet seat 1, the toilet bowl 44, and the hinge 46. In some embodiments, the toilet bowl 44 may already be installed at a desired location. Therefore, the system may include the toilet seat 1 and the hinge 46, which may be retrofitted to couple with the toilet bowl 44. In various embodiments, the hinge 46 (e.g., the housing 3 and housing base 4) may be configured to bolt or otherwise couple with the toilet bowl 44. As discussed below, the hinge 46 also couples to the seat 1 and preferably allows the seat 1 to move and/or rotate relative to the bowl 44.

In various embodiments, the hinge 46 preferably includes a housing 3 and housing base 4. Preferably, the housing 3 and housing base 4 are sealed and waterproof. Preferably, the rotation of the axle 7 is also sealed via rotary seal 17. Inside of the housing 3 and housing base 4 is the delay system 54. Additionally, the housing 3 and housing base 4 may contain the lifting system 52 and the linkages (e.g., 10-12,30-33). In some embodiments, as shown in FIG. 8, the cup 13 and the plate 14 is further isolated within this housing 3 using a bellows 55 or other seal that encloses the plate 14 and cup 13 in a fully dustproof manner while continuing to allow the full range of motion of the suction cup 13.

At step 1504, the user lifts the toilet seat 1. When the toilet seat 1 is user-lifted, the lowering system 52 begins to provide a counter torque to the seat 1 towards the down position 50. At some point during the lifting of the seat 1, preferably when the seat approaches or reaches the up state 48A, a delay system 54 engages, causing the toilet seat 1 to remain in the in the up state 48A until the user removes their applied force from the seat 1.

The process then proceeds to step 1506, which begins the time delay once the user's applied lifting force is removed. When the user applied lifting force is removed, the seat will transition to the neutral state 49B due to the torque applied to the system by the lowering system 52, which is configured to overcome the torque of the seat 1 when the time delay of delay system 54 expires. As described previously, the delay system 54 may include a suction cup 13 and a plate 14. In some other embodiments, the delay system 54 may include some other type of adhesive. Furthermore, some embodiments may include a gear-based delay system or a fluid-channel based delay system 54, as described in alternative embodiments further below.

At step 1507, the process asks whether a user decides to lower the seat back into the down position? If so, the toilet seat system is transitioned by the user back into the down position and the process is complete at step 1516. If not, the process continues to step 1508. At step 1508, the process asks whether a user re-applies lifting force before the time delay expires? If so, in some embodiments, the time delay is reset. However, in some other embodiments, the time delay is paused as the user re-applies their force. Thus, if a user lifts, or otherwise applies a threshold lifting force to the toilet seat 1 prior to the expiration of the delay system 54, the toilet seat 1 will not self-lower via the lowering system 52 to the down position 50. Instead, the process moves to step 1510 where the delay system will experience a reset or pause to its delay.

After the user has finished re-applying a lifting force to the toilet 40 in step 1512, the user may continue using the toilet 40. This causes the seat 1 to transition down to a neutral position 49B. FIGS. 54A-54C schematically show the seat 1 in different positions. FIG. 54A schematically shows the seat 1 in the up state 48A. FIG. 54B schematically shows the seat 1 in the neutral state 49B, and FIG. 54C schematically shows the seat 1 in the down position 50. To that end, some embodiments may include a component that moves the seat 1 back to the neutral position 49B as soon as the user removes their user-lifting force (i.e., before the time delay expires). Additionally, or alternatively, the delay system 54 may have some slack that causes the seat 1 to move to the neutral position 49B as the user removes their lifting force.

After the user removes force from the seat in step 1512, the system loops back to step 1506 and the delay system 54 resumes or restarts, after which the process once again asks whether a user lowers the seat. If not, the system once again asks if the user applies force before the time delay expires. If they do, the cycle continues as described above, however, if a user does not otherwise apply a threshold lifting force to the toilet seat 1 prior to the expiration of the delay system 54, the process moves to step 1514, and the toilet seat 1 will self-lower to the down position 50, and the process is complete at step 1516 with the seat in the down position.

Additionally, the user may reset the seat 1 to the down position at any point in the cycle, for example at intermediate steps 1505 or 1509.

FIG. 15 describes a method of self-lowering a toilet seat 1 in accordance with illustrative embodiments of the invention. It should be noted that this method is substantially simplified from a longer process that may normally be used. Accordingly, the method shown in FIG. 15 may have many other steps that those skilled in the art likely would use. In addition, some of the steps may be performed in a different order than that shown, or at the same time. Furthermore, some of these steps may be optional in some embodiments. Accordingly, the process 1500 is merely exemplary of one process in accordance with illustrative embodiments of the invention. Those skilled in the art therefore can modify the process as appropriate.

In FIG. 55A, a rear perspective view of the seat 1 is shown in the down position 50. FIG. 55B shows a front perspective view of the seat 1 in the up position 48.

FIGS. 56A-56C schematically show the self-lowering toilet seat system 100 as it lifts from the down position 50 in FIG. 56A, to the neutral state 49B in FIG. 56C, to the up state 48A in FIG. 56C.

As used in this specification and the claims, the singular forms "a," "an," and "the" refer to plural referents unless the context clearly dictates otherwise. For example, reference to "the suction cup" in the singular includes a plurality of suction cups, and reference to "the plate" in the singular includes one or more plates and equivalents known to those skilled in the art. Thus, in various embodiments, any reference to the singular includes a plurality, and any reference to more than one component can include the singular.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein.

It is, therefore, to be understood that the foregoing embodiments are presented by way of example only and that, within the scope of the appended claims and equivalents thereto, inventive embodiments may be practiced otherwise than as specifically described and claimed. Illustrative embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure. Disclosed embodiments, or portions thereof, may be combined in ways not listed above and/or not explicitly claimed. Thus, one or more features from variously disclosed examples and embodiments may be combined in various ways. For example, it is to be understood that the present disclosure contemplates that, to the extent possible, one or more features of any embodiment can be combined with one or more features of any other embodiment.

Various inventive concepts may be embodied as one or more methods, of which examples have been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Although the above discussion discloses various exemplary embodiments of the invention, it should be apparent that those skilled in the art can make various modifications that will achieve some of the advantages of the invention without departing from the true scope of the invention.

What is claimed is:

1. A self-lifting toilet seat system comprising:

a toilet seat configured to be sat upon by a user;

a hinge configured to rotatably couple the toilet seat and a toilet bowl, the hinge configured so that the toilet seat is transitionable from an up position to a down position;

a lifting system configured to raise the toilet seat towards the up position;

a substantially sealed hinge housing having at least a portion of a delay system therein, the substantially sealed hinge housing having a quantity of air therein, the delay system configured to cause a time delay before the lifting system causes the toilet seat to self-lift towards the up position, the delay system configured so that the time delay begins after removal of a threshold downward force on the toilet seat, wherein the delay system comprises a suction cup and an attachment surface, wherein temporary adhesion of the cup to the attachment surface prevents the toilet seat from self-lifting to the up position, wherein the suction cup is coupled with the toilet seat through a linkage configured to provide linear motion of the suction cup relative to the contact surface.

2. The system of claim 1, wherein the time delay is reset upon application of the threshold downward force on the toilet seat.

3. The system of claim 1, wherein the time delay is paused upon the application of the threshold downward force on the toilet seat.

4. The system of claim 1, wherein the threshold downward force is applied by the user sitting on the toilet seat or pushing the seat down.

5. The system of claim 1, wherein the lifting system comprises a spring.

6. The system of claim 1, wherein the attachment surface includes one or more controlled leakage channels.

7. The system of claim 6, wherein the suction cup is configured to overlap with at least a portion of the one of more controlled leakage channels when the user lowers the toilet seat to the down position.

8. The system of claim 6, wherein the one or more controlled leakage channels are configured to be positioned to be under the suction cup when the suction cup is adhered to the attachment surface.

9. The system of claim 8, wherein the one or more of the controlled leakage channels are sealed by a porous film restricting fluid flow into the suction cup.

10. The system of claim 1, wherein the attachment surface is fluid permeable, and the rate of fluid influx while the suction cup is adhered determines the time delay.

11. The system of claim 1, where the suction cup comprises an elastomer that is fluid permeable, and the rate of influx of fluid while the suction cup is adhered to the attachment surface determines the time delay.

12. The system of claim 1, wherein the time delay is between 1 second and 5 minutes.

13. The system of claim 1, wherein the lifting system is passive.

14. The system of claim 1, wherein all of the delay system is sealed in the hinge housing.

15. A self-lifting toilet seat system comprising:

a toilet seat configured to be sat upon by a user;

a hinge configured to rotatably couple the toilet seat and a toilet bowl, the hinge configured so that the toilet seat is transitionable from an up position to a down position;

a lifting system configured to raise the toilet seat towards the up position;

a sealed hinge housing having at least a portion of a delay system therein, wherein the hinge housing is sealed to prevent ingress of liquids and dust into an interior of the housing, the delay system configured to cause a time delay before the lifting system causes the toilet seat to self-lift towards the up position, the delay system configured so that the time delay begins after removal of a threshold downward force on the toilet seat, wherein the delay system comprises a suction cup and an attachment surface, wherein temporary adhesion of the cup to the attachment surface prevents the toilet seat from self-lifting to the up position, and wherein the lifting system comprises a spring, the suction cup being coupled with the toilet seat through a linkage configured to provide linear motion of the suction cup relative to the contact surface.

16. The system of claim 15, wherein the time delay is reset upon application of the threshold downward force on the toilet seat.

17. The system of claim 15, wherein the attachment surface includes one or more one of more controlled leakage channels, and the suction cup is configured to overlap with at least a portion of the controlled leakage channel when the user lowers the toilet seat to the down position.

18. The system of claim 15, further comprising one or more controlled leakage channels that are sealed by a porous film restricting fluid flow towards a contact portion of the suction cup.

19. A self-lifting toilet seat system comprising:

a toilet seat configured to be sat upon by a user;

a hinge configured to rotatably couple the toilet seat and a toilet bowl, the hinge configured so that the toilet seat is transitionable from an up position to a down position;

a lifting system configured to raise the toilet seat towards the up position;

a substantially sealed hinge housing having at least a portion of a delay system therein, the delay system configured to cause a time delay before the lifting system causes the toilet seat to self-lift towards the up position, the delay system configured so that the time delay begins after removal of a threshold downward force on the toilet seat, the delay system configured to operate independently of exchange of air from outside of the hinge housing.

20. The system of claim 19, wherein the delay system comprises a suction cup and an attachment surface, wherein temporary adhesion of the cup to the attachment surface prevents the toilet seat from self-lifting to the up position, and wherein the lifting system comprises a spring.

21. The system of claim 20, where the suction cup comprises an elastomer that is fluid permeable, and the rate of influx of fluid while the suction cup is adhered to the attachment surface determines the time delay.

22. The system of claim 19, wherein the time delay is between 1 second and 5 minutes.

23. The system of claim 19, wherein the lifting system is passive.

* * * * *